US012396512B2

(12) United States Patent
Berrian et al.

(10) Patent No.: US 12,396,512 B2
(45) Date of Patent: Aug. 26, 2025

(54) ARTICLES OF FOOTWEAR WITH KNITTED COMPONENTS AND METHODS OF MANUFACTURING THE SAME

(71) Applicant: NIKE, Inc., Beaverton, OR (US)

(72) Inventors: Travis J. Berrian, Portland, OR (US); John S. MacGilbert, Tigard, OR (US); Stuart D. Reinhardt, Portland, OR (US); Colin Runkle, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 12 days.

(21) Appl. No.: 17/971,309

(22) Filed: Oct. 21, 2022

(65) Prior Publication Data

US 2023/0129224 A1 Apr. 27, 2023

Related U.S. Application Data

(60) Provisional application No. 63/389,617, filed on Jul. 15, 2022, provisional application No. 63/270,987, filed on Oct. 22, 2021.

(51) Int. Cl.
*A43B 1/04* (2022.01)
*A43B 5/02* (2006.01)
(Continued)

(52) U.S. Cl.
CPC ..... *A43B 1/04* (2013.01); *A43B 5/025* (2013.01); *A43B 23/0205* (2013.01);
(Continued)

(58) Field of Classification Search
CPC ..... A43B 1/04; A43B 5/025; A43B 23/0265; A43B 23/027; A43B 23/0275; A43B 23/045
See application file for complete search history.

(56) References Cited

U.S. PATENT DOCUMENTS 2,047,724 A * 7/1936 Zuckerman ..... A43B 1/04 36/11
2,400,692 A * 5/1946 Herbert ..... D04B 1/108 66/171
(Continued)

FOREIGN PATENT DOCUMENTS

CN 206197216 U 5/2017
CN 111549434 A 8/2020
(Continued)

OTHER PUBLICATIONS

Final Office Action received for U.S. Appl. No. 17/970,951, mailed on Aug. 23, 2023, 14 pages.
(Continued)

*Primary Examiner* — Sharon M Prange
(74) *Attorney, Agent, or Firm* — Shook, Hardy & Bacon LLP

(57) ABSTRACT

Footwear with integrally knit uppers having features for increasing containment around a wearer's foot, improving strength and durability, and incorporating touch feedback through increased coefficient of friction while removing weight due to traditional additional components. The knitted component may be radially knitted so that courses converge towards a common area, like the throat region of the upper. Additionally, a fusible yarn may be knit on at least the exterior-facing surface of a containment area of the knitted component to create additional lock-down along lines of containment. Further, tensile elements may be incorporated within the containment area to provide strength and lock-down along desired lines of containment. Additionally, the fusible yarn may be a grip yarn that creates areas with greater coefficients of friction.

22 Claims, 10 Drawing Sheets

(51) Int. Cl.
*A43B 23/02* (2006.01)
*D04B 1/22* (2006.01)

(52) U.S. Cl.
CPC ..... *A43B 23/0265* (2013.01); *D04B 1/22* (2013.01); *D10B 2501/043* (2013.01)

(56) References Cited

U.S. PATENT DOCUMENTS

| | | | | |
|---|---|---|---|---|
| 9,078,488 | B1 | 7/2015 | Meir et al. | |
| 10,398,196 | B2 * | 9/2019 | Minami | A43B 23/0265 |
| 11,168,416 | B2 * | 11/2021 | Huffa | D04B 7/30 |
| 2004/0118018 | A1 * | 6/2004 | Dua | A43D 8/24 36/3 A |
| 2005/0115284 | A1 | 6/2005 | Dua | |
| 2012/0233882 | A1 * | 9/2012 | Huffa | D04B 15/56 36/45 |
| 2014/0245633 | A1 * | 9/2014 | Podhajny | D04B 1/123 66/170 |
| 2015/0075031 | A1 * | 3/2015 | Podhajny | A43B 1/04 66/196 |
| 2015/0272274 | A1 | 10/2015 | Berns et al. | |
| 2015/0289592 | A1 | 10/2015 | Song | |
| 2015/0351483 | A1 * | 12/2015 | Podhajny | D04B 1/24 66/202 |
| 2016/0029736 | A1 * | 2/2016 | Meir | A43B 23/0245 66/170 |
| 2016/0058099 | A1 | 3/2016 | Panian et al. | |
| 2016/0058100 | A1 | 3/2016 | Dealey et al. | |
| 2016/0088899 | A1 | 3/2016 | Liles et al. | |
| 2016/0174660 | A1 | 6/2016 | Iuchi et al. | |
| 2016/0255913 | A1 | 9/2016 | Uchikawa et al. | |
| 2016/0302527 | A1 * | 10/2016 | Meir | A43B 23/0245 |
| 2016/0331083 | A1 | 11/2016 | Uesato | |
| 2017/0325547 | A1 | 11/2017 | Cai et al. | |
| 2019/0037968 | A1 | 2/2019 | Dewillie et al. | |
| 2019/0116914 | A1 * | 4/2019 | Schoppel | D04B 1/22 |
| 2019/0223541 | A1 * | 7/2019 | Aceves Tinajero | D04B 21/10 |
| 2019/0274392 | A1 * | 9/2019 | Amis | A43B 23/0245 |
| 2019/0365049 | A1 | 12/2019 | Verfl | |
| 2020/0022456 | A1 * | 1/2020 | Brinkman | A43B 1/028 |
| 2020/0029655 | A1 | 1/2020 | Nishiwaki et al. | |
| 2020/0046074 | A1 | 2/2020 | Berrian et al. | |
| 2022/0259780 | A1 | 8/2022 | Green et al. | |
| 2023/0323574 | A1 | 10/2023 | McFarland et al. | |

FOREIGN PATENT DOCUMENTS

| | | | |
|---|---|---|---|
| CN | 113331530 | A | 9/2021 |
| CN | 113367448 | A | 9/2021 |
| CN | 113403735 | A | 9/2021 |
| EP | 2199444 | A1 | 6/2010 |
| GB | 0547900 | A | 9/1942 |
| GB | 0661947 | A | 11/1951 |
| GB | 1149724 | A | 4/1969 |
| TW | 1520690 | B | 2/2016 |
| TW | 201636470 | A | 10/2016 |
| TW | 201726014 | A | 8/2017 |
| TW | 202042692 | A | 12/2020 |
| TW | 202118410 | A | 5/2021 |
| TW | 202207832 | A | 3/2022 |
| TW | 202216001 | A | 5/2022 |
| WO | 2014/137826 | A1 | 9/2014 |
| WO | 2016/018904 | A1 | 2/2016 |
| WO | 2016/168046 | A2 | 10/2016 |

OTHER PUBLICATIONS

Final Office Action received for U.S. Appl. No. 17/970,951, mailed on Jun. 27, 2024, 16 pages.
Non-Final Office Action received for U.S. Appl. No. 17/970,951, mailed on Feb. 16, 2024, 13 pages.
International Search Report and Written Opinion received for PCT Patent Application No. PCT/US2022/047504, mailed on Apr. 3, 2023, 20 pages.
International Search Report and Written Opinion received for PCT Patent Application No. PCT/US2022/047505, mailed on Apr. 4, 2023, 18 pages.
Invitation to Pay Additional Fees received for PCT Patent Application No. PCT/US2022/047504, mailed on Feb. 10, 2023, 15 pages.
Invitation to Pay Additional Fees received for PCT Patent Application No. PCT/US2022/047505, mailed on Feb. 14, 2023, 13 pages.
Non-Final Office Action received for U.S. Appl. No. 17/970,951, mailed on May 23, 2023, 14 pages.
Communication pursuant to Rules 161(1) and 162 EPC received for European Application No. 22812904.5, mailed on May 29, 2024, 3 pages.
Extended European search report received for European Application No. 24176260.8, mailed on Aug. 9, 2024, 10 pages.

* cited by examiner

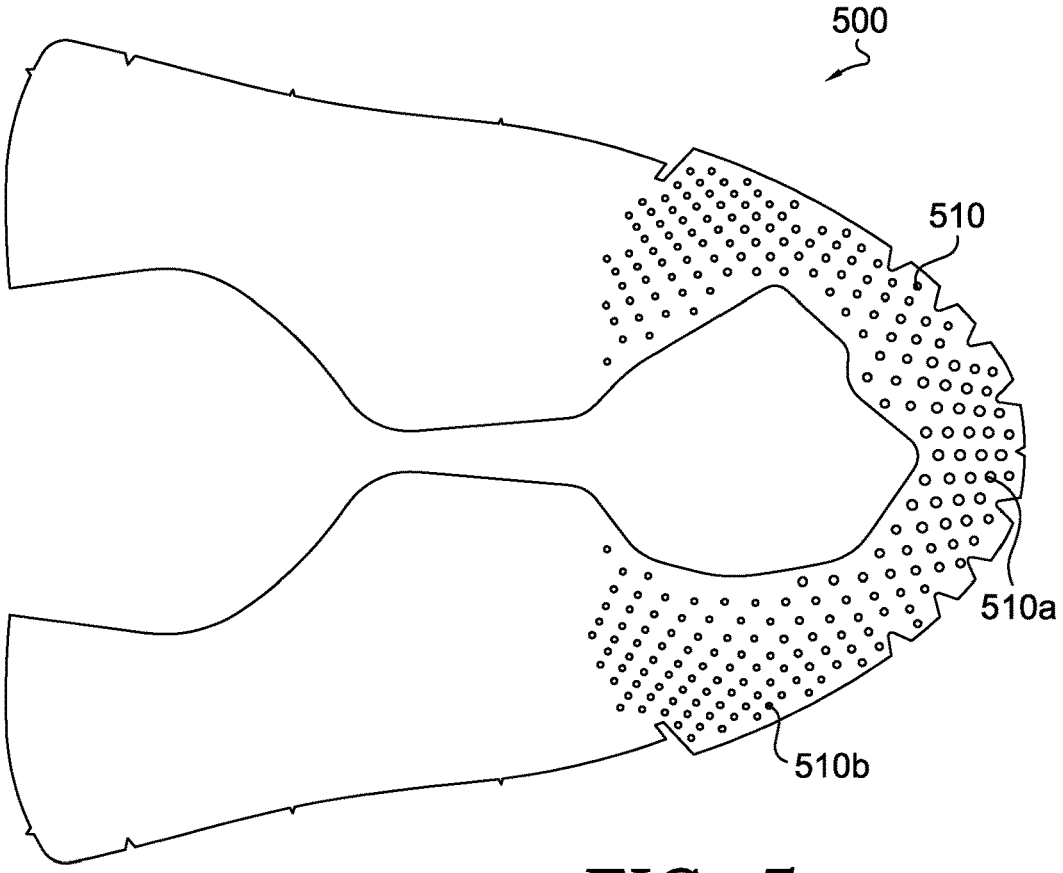
FIG. 5.
FIG. 6.
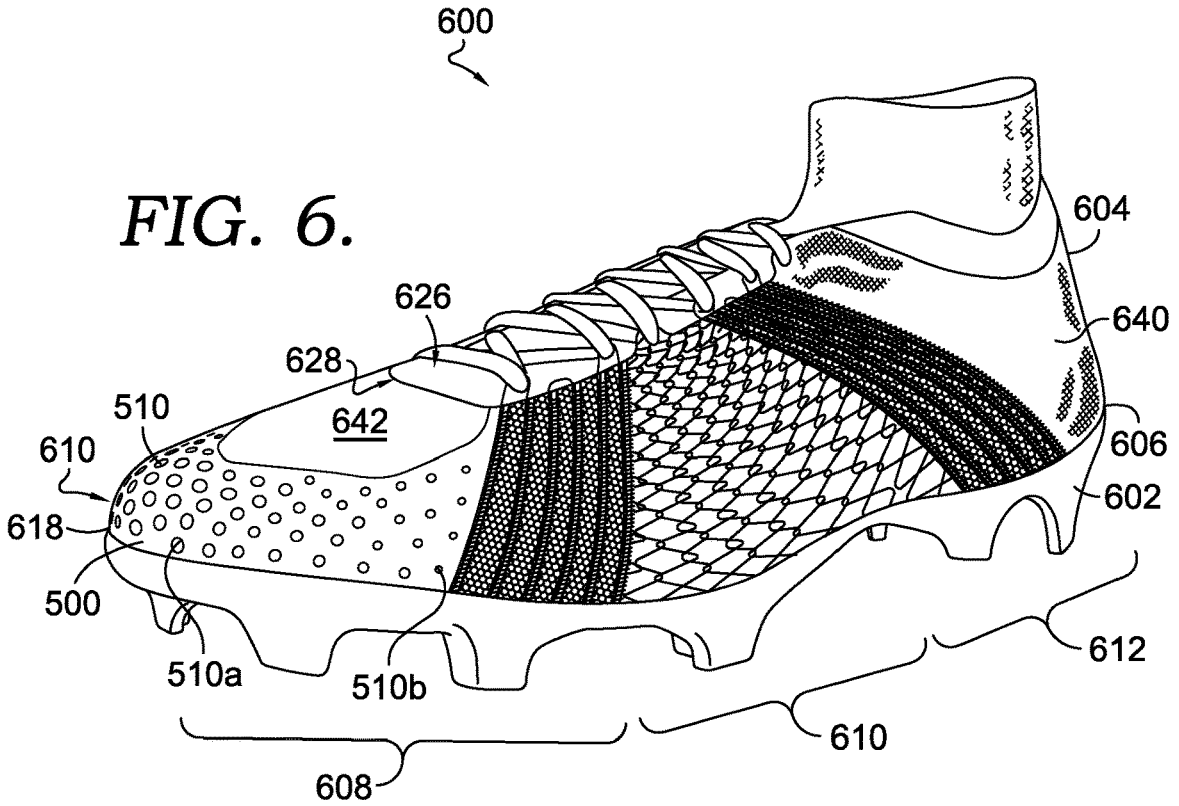

ARTICLES OF FOOTWEAR WITH KNITTED COMPONENTS AND METHODS OF MANUFACTURING THE SAME

CROSS-REFERENCE TO RELATED APPLICATIONS AND PRIORITY CLAIM

This non-provisional patent application claims priority to U.S. provisional patent app. No. 63/270,987, filed on Oct. 22, 2021, and titled "Articles of Footwear with Knitted Components and Methods of Manufacturing the Same," and claims priority to U.S. provisional patent app. No. 63/389,617, filed on Jul. 15, 2022, and titled "Articles of Footwear with Knitted Components and Methods of Manufacturing the Same." The contents of both of the aforementioned applications is herein incorporated by reference in the entirety. This application is also related by subject matter to U.S. patent application Ser. No. 17/970,951, filed concurrently on Oct. 21, 2022, the entire contents of which is also incorporated herein by reference.

BACKGROUND

Conventional articles of footwear generally include two primary elements: an upper and a sole structure. The upper is secured to the sole structure and forms a void within the footwear for comfortably and securely receiving a foot. Uppers may be formed by a variety of materials, including knitted textiles. When an athlete moves their foot within a knitted upper, a force may be exerted on the athlete's foot that pushes the foot partially off the sole structure. Performance and comfort may be improved by keeping the foot contained over the sole structure during movement. Various components may be added to a knitted upper through post-knitting processes to keep the foot contained. However, such components added post-knitting may increase the weight of the upper, increase production time, and reduce recyclability of the upper. Similarly, to increase durability and/or water resistance of an upper, additional components (e.g., synthetic leather textiles, laminate film layers) may be added and secured (e.g., glued, stitched) to the textile, but these components may also increase the weight of the upper, increase production time, and reduce recyclability. These additional components may also reduce the ability of the upper to conform with the wearer's foot and provide proprioceptive feedback, which can be particularly useful for athletes during certain sporting activities.

BRIEF DESCRIPTION OF THE DRAWINGS

The articles of footwear and methods of manufacturing the same described herein are discussed in detail in connection with the attached drawing figures, wherein:

FIG. 5 depicts a polymer layer for an article of footwear, in accordance with aspects hereof;

FIG. 6 depicts a lateral side perspective view of an article of footwear with the polymer layer of FIG. 5, in accordance with aspects hereof;

DETAILED DESCRIPTION

Figure 1A:
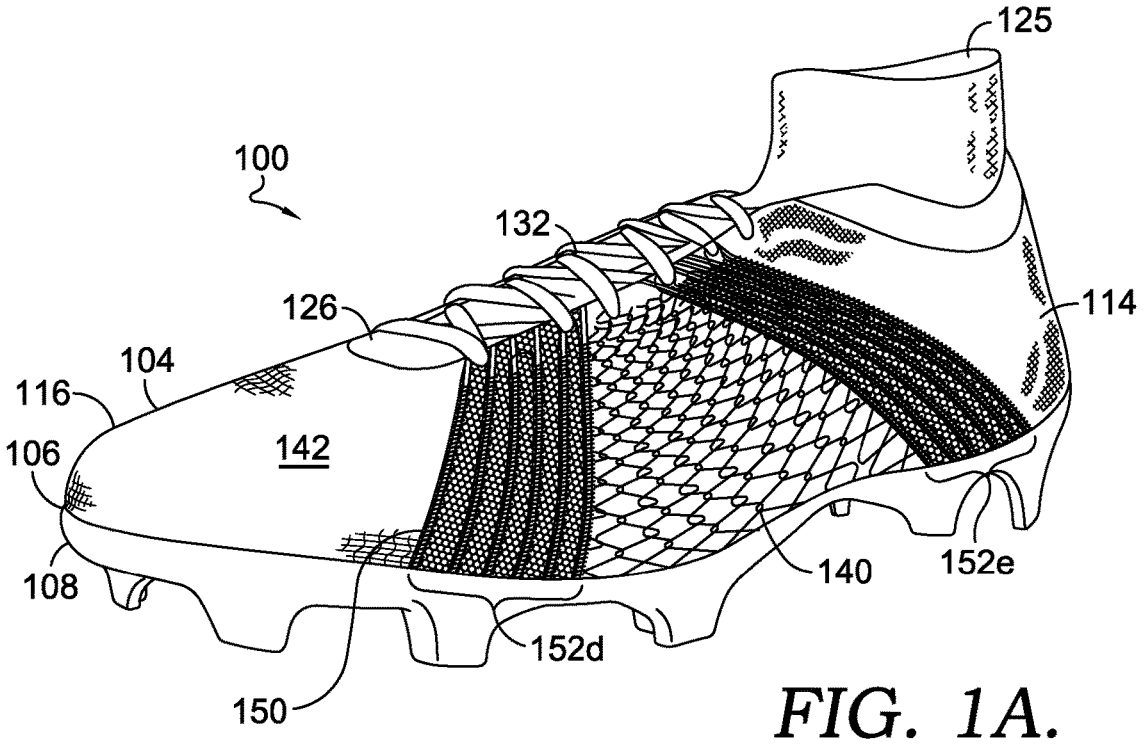
FIG. 1A depicts a lateral side perspective view of an article of footwear, in accordance with aspects hereof.

This detailed description is related to knitted components for articles of footwear that provide containment and support while maintaining a light weight of the upper, reducing production time, and improving recyclability, among other benefits. In at least some examples, an upper may be formed with a knitted component with radially-extending courses such that the courses converge towards a common area, e.g., the throat region of the upper, which can arrange courses along desired lines of containment for the upper. Additionally, a fusible yarn, such as a grip yarn, may be knit on at least the exterior-facing surface of a radially-extending containment area of the upper to create additional lock-down or restriction along lines of containment. Additionally, some examples herein also include radially-extending tensile elements within the containment areas, such that the tensile elements can provide strength and lock-down along desired lines of containment while also combining with the strength created by a fusible yarn that is incorporated. In contrast to the subject matter of the present disclosure, conventional footwear can require several post-knitting processes, such as sewing or bonding additional components to a knitted component, so that the footwear can provide a desired amount of containment around a wearer's foot or have other properties, such as water resistance and durability. These components added post-knitting may increase the weight of the upper, increase production time, and reduce recyclability of the upper.

As such, examples of this disclosure include an upper formed with a knitted component with radially-extending courses that may be aligned along desired lines of containment. Additionally, a fusible yarn, such as a grip yarn, may be knit on at least the exterior-facing surface of a radially-extending containment area of the upper. The fusible yarn may be used to create fused areas to create additional lock-down along lines of containment as well as to increase abrasion-resistance, water-resistance, and wear-resistance, among other things. Further, where the fusible yarn is a grip yarn as described herein, the containment area may have a greater coefficient of friction than portions of the knitted component without the fusible grip material, which may provide additional benefits to increase a wearer's ability to effectively control a ball, such as a global football, using the upper.

Further examples include knitted components with tensile elements, such as inlaid tensile elements, that may be within containment areas fused with a fusible yarn, such as a grip yarn. The tensile elements may impart stretch-resistance and lock-down to the upper, which may be enhanced by the fusible material knit with the tensile elements. In some aspects, the tensile elements can be incorporated into a radially-knit upper such that the tensile elements are radially-extending along desired line(s) of containment along the upper.

Additional aspects of this disclosure include applying a polymer layer (e.g., a skin layer) over the exterior-facing surface of the knitted component. In some aspects, the polymer layer includes apertures that expose portions of the exterior-facing surface that include a fusible grip material to maintain touch properties (e.g., a greater coefficient of friction) created by the fusible grip material.

Further aspects of this disclosure include incorporating a tensile element through knitting in a manner that may simulate strength and stretch-resistance provided by an inlaid tensile element but through knitting. For example, the tensile element may be formed with a knit sequence repeated across the course, where the knit sequence is at least one knit stitch and a float stitch spanning a plurality of wales (e.g., needle positions). For example, the tensile element, within one course, may have a repeated sequence of one knit stitch and one float stitch extending 5 wales.

As described herein, certain aspects of the present disclosure relate to articles of footwear or aspects thereof that are at least partially formed from knit textiles. In an illustrative example, aspects are directed to an upper formed at least partially of a knitted component. As used herein, the term "upper" refers to a footwear component that extends over the in step and toe areas of the foot, along the medial and lateral sides of the foot, and around the heel area of the foot to form a void for receiving a wearer's foot. Illustrative, non-limiting examples of uppers may include uppers incorporated into a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. Further, in other aspects, the upper may also be incorporated into a non-athletic shoe, such as a dress shoe, a loafer, and a sandal. Accordingly, the concepts disclosed herein with respect to articles of footwear apply to a wide variety of footwear types. Although the figures may illustrate an article of footwear intended for use on only one foot (e.g., a left foot) of a wearer, one skilled in the art will recognize that a corresponding article of footwear for the other foot (e.g., a right foot) would be a mirror image of the right article of footwear.

Positional terms used when describing articles of footwear or aspects thereof, such as top, bottom, front, sides, back, superior, inferior, lateral, medial, right, left, interior, exterior, interior-facing, and exterior-facing and the like, are used with respect to the article of footwear or upper being worn as intended with the wearer standing upright such that the wearer's foot is in the foot-receiving void and the wearer's ankle or leg extends through the ankle opening. For example, an "upwardly-facing surface" and/or an "upper surface" of an upper refers to the surface oriented in the "superior" anatomical direction (i.e., toward the head of a wearer) when the article of footwear is being worn by the wearer. Similarly, the directional terms "downwardly" and/or "lower" refer to the anatomical direction "inferior" (i.e., toward the ground and away from the head of the wearer). "Front" or "forward" means "anterior" (e.g., towards the toes), and "rear" means "posterior" (e.g., towards the heel). "Medial" means "toward the midline of the body," and "lateral" means "away from the midline of the body." "Longitudinal axis" refers to a centerline of the article extending between the heel region and the forefoot region. Similarly, a "longitudinal length" refers to a length of the article along the longitudinal axis, and a "longitudinal direction" refers to a direction along the longitudinal axis. It should be understood, however, that use of positional terms do not depend on the actual presence of a human being for interpretative purposes.

The term "knitted component" refers to a textile piece that is formed from at least one yarn that is manipulated (e.g., with a knitting machine) to form a plurality of intermeshed loops that define courses and wales. The term "course," as used herein, refers to a predominantly horizontal row of knit loops (in an upright textile as it is knit on the knitting machine) that is produced by adjacent needles during the same knitting cycle. The course may comprise one or more stitch types, such as a knit stitch, a missed stitch, a tuck stitch, a transfer stitch, a rib stitch, and the like as these terms are known in the art of knitting. The term "wale," as used herein, is a predominantly vertical column of intermeshed or interlooped knit loops, generally produced by the same needle at successive (but not necessarily all) courses or knitting cycles.

The term "integrally knit," as used herein, may mean a knitted component having a yarn from one or more knitted courses in a first area or region being interlooped with one or more knitted courses of another area or region. The interlooping may be through a simple knit stitch, a tuck stitch, a held stitch, a float or miss stitch, and the like. In this way, areas that are integrally knit together have a seamless transition.

In one aspect, a radial knit process or a sequential knit process can be performed such that medial and lateral sides of a knitted component can generally be formed sequentially, rather than simultaneously. For example, instead of forming medial and lateral sides simultaneously, all (or substantially all, e.g., within 5% by length) of the medial side can be formed, then all (or substantially all, e.g., within 5% by length) of the lateral side can be formed next. Alternatively, the lateral side can be formed first and the medial side can be formed subsequently. In some aspects, a portion of a first side (either the medial or lateral) can be formed first, and then the second side (e.g., the other side) can be formed before completing the knitted component by knitting the remaining portion of the first side. In some aspects, a reverse sequence may be used. In this way, a plurality of adjacent courses forming at least part of a first side (e.g., the medial or lateral side) may be knit prior to a plurality of adjacent courses forming at least part of a second side (e.g., the other of the medial or lateral side).

The term "radially extending," as used herein, refers to an orientation of an elongate structure, such as a knit course and/or an inlaid strand segment, that radiates out from a common portion of the knitted component. Specifically, the knit course and/or inlaid strand may be radially extending if it extends between an outer perimeter of the knitted component and the common portion. In this manner, the courses and/or strand segments may radiate inwards from the outer perimeter towards the common portion and do not, for example, extend continuously across the body of the knitted component from a lateral side edge to a medial side edge of the outer perimeter. The structures of the knitted component may be radially extending from the common portion when the knitted component is laid out in a flat configuration after knitting, but it is also contemplated that determining whether structures are radially extending may be based on the orientation of the structures towards the common portion after the knitted component is folded into the shape of an upper or a portion of an upper.

The term "common portion," as used herein, refers to an area of the knitted component towards which multiple similar structures (e.g., multiple courses or multiple inlaid strand segments) extend. As such, courses or inlaid strand segments may extend from an outer perimeter to a single common portion rather than extending from the outer perimeter to different portions, e.g., along a common direction. The common portion is spaced-apart from the outer perimeter and, in various aspects, may be relatively centrally located within the knitted component. In this way, the common portion may encompass and/or be directly adjacent to the longitudinal axis of the knitted component. In some examples disclosed herein, the common portion may include a throat region or a portion thereof.

As used herein, the term "throat region" refers to an area on a top (upward-facing) side of an upper generally extending between an ankle opening and a forefoot region. The throat region may include an opening formed between a lateral side and medial side of the upper when formed into the shape of the article of footwear, and in some aspects, the throat region may include a tongue extending across the opening in the throat region. In some aspects, the throat region does not have an opening but, rather, includes a continuous integrally knit area of a knit component extending between the medial and lateral sides, e.g., one that can be formed of elastic yarns, material, and/or other components that include a degree of stretchability.

As used herein, the term "perimeter" refers to an area forming the boundary of the object referred to. For example, a perimeter of a knitted component is the area that extends along the boundary of that structure. The "outer perimeter" may refer to portions of a perimeter of a knitted component that, once formed into an article of footwear, are secured to the sole structure or form a seam between two ends of the outer perimeter (such that they may at least partially extend under the foot of the wearer when the article of footwear is worn. In contrast, an "inner perimeter" may refer to portions of the perimeter of a knitted component that, once formed into an article of footwear, define openings, such as an opening in a throat region and/or the ankle opening. The perimeter (outer perimeter or inner perimeter) may refer to an edge of the knitted component or to a peripheral area adjacent to the edge.

Different aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional assembly. Additionally, there are various measurements provided herein. Unless indicated otherwise, the term "about" or "substantially" with respect to a measurement means within ±10% of the indicated value.

Figure 1B:
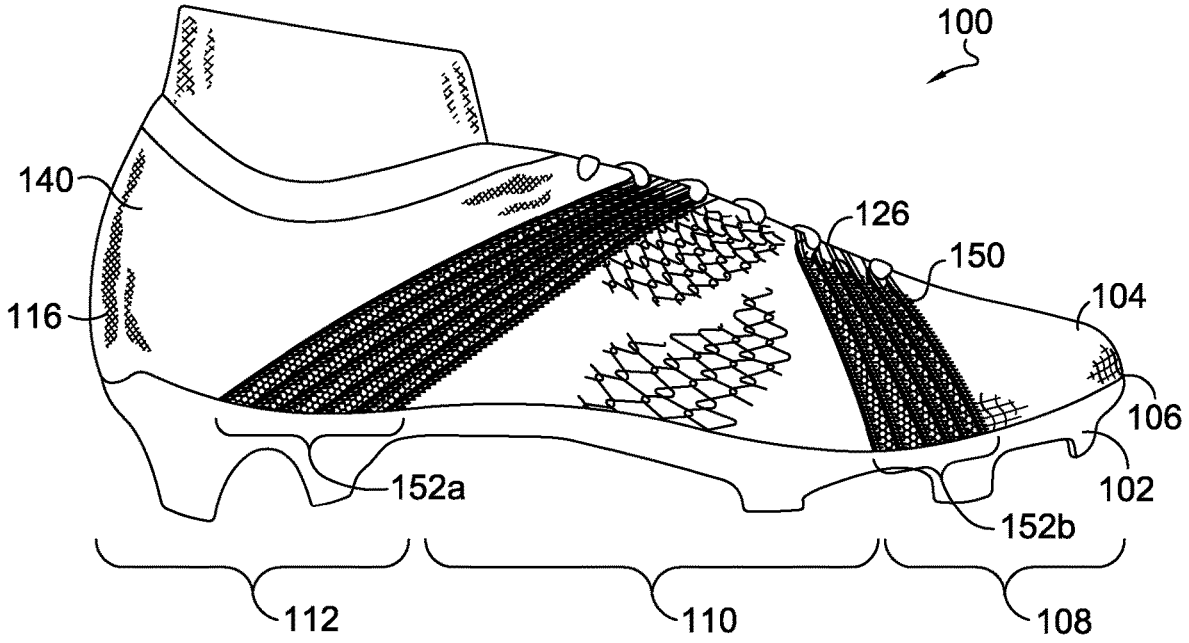
FIG. 1B depicts a medial side view of the article of footwear of FIG. 1A, in accordance with aspects hereof.

FIGS. 1A and 1B depict a lateral side perspective view and a medial side view, respectively, of an article of footwear 100 and its components, according to aspects hereof. The article of footwear 100 comprises a sole structure 102 and an upper 104. The upper 104 is coupled to, and extends from, the sole structure 102 and forms a foot-receiving cavity between the sole structure 102 and the upper 104. The area of the article of footwear 100 where the sole structure 102 joins the upper 104 may be referred to as the bite-line 106. The upper 104 may be joined to the sole structure 102 in a fixed manner using any suitable technique, such as through the use of an adhesive, by sewing, etc. It is contemplated that the upper 104 may extend partially or completely around the foot of a wearer, may extend under the foot of a wearer, and/or may be integral with the sole. A sockliner, which may be referred to as a strobel, may or may not be used. The sockliner can comprise various materials including textile, leather, foam, and/or other types of materials.

The article of footwear 100 (and/or its components) can be divided into one or more regions (which can also be referred to as "areas," or "portions"). For example, in an anterior-to-posterior direction, the article of footwear 100 (and/or its components) can be divided into (and/or include) a forefoot region 108, a midfoot region 110, and a heel region 112. The forefoot region 108 of the article of footwear 100 can correspond to anterior portions of a foot, including toes and joints connecting metatarsal bones with phalanx bones of the foot. The midfoot region 110 of the article of footwear 100 can correspond with an arch area of the foot. The heel region 112 of the article of footwear 100 can correspond with posterior portions of the foot, including a calcaneus bone. In a medial-to-lateral direction, the article of footwear 100 (and/or its components) can be divided into a lateral side 114 and a medial side 116, both of which extend through the forefoot region 108, the midfoot region 110, and the heel region 112. More particularly, the lateral side 114 corresponds with an outside area of the foot (i.e., a side that faces away from the other foot) when the article of footwear 100 is worn, while the medial side 116 corresponds with an inside area of the foot (i.e., a side that faces towards the other foot) when the article of footwear 100 is worn. The lateral side 114 and the medial side 116 are separated by a longitudinal axis 118. These regions 108, 110, and 112 and sides 114 and 116 are not intended to demarcate precise areas of the article of footwear 100 but, rather, are intended to represent general areas of the article of footwear 100 to aid in understanding the various descriptions provided herein.

The sole structure 102 generally extends between the foot and the ground when the article of footwear 100 is worn. The sole structure 102 may include multiple components, such as an outsole, a midsole, and an insole or sockliner. Various materials may be used to form the sole structure 102, such as rubber, ethylene vinyl acetate (EVA), thermoplastic polyurethane (TPU), thermoplastic elastomer (e.g., polyether block amide), and the like. The sole structure 102 may also include various other elements, such as a heel counter and a toe cap. The sole structure 102 may include various other features to attenuate forces, enhance stability, and/or provide traction, such as treads as understood by one skilled in the art. For example, the sole structure 102 may include cleats as illustrated in FIGS. 1A and 1B as seen in soccer (global football) boots. However, it should be understood that this disclosure may apply to footwear without cleats.

The upper 104 defines a void within the article of footwear 100 for receiving and securing a foot relative to the sole structure 102. Access to the void is provided by an ankle opening 125 located in at least the heel region 112. The upper 104 includes a throat region 126 disposed in the midfoot region 110 between the ankle opening 125 and the forefoot region 108. The throat region 126 may be configured to cover a top side of the wearer's foot and, therefore, form part of a top side (or overfoot region) of the upper 104 between the lateral side 114 and the medial side 116. The article of footwear 100 can also include a closure system in the throat region 126 to adjust the foot-receiving cavity. In this manner, the closure system can be used, for example, to secure and/or release the article of footwear 100 to and/or from a wearer's foot. Example closure systems include laces 132 (as shown in FIGS. 1A and 1B), straps, bands, cables, cords, ratcheting mechanisms, hook-and-loop connections, and the like.

Figure 2:
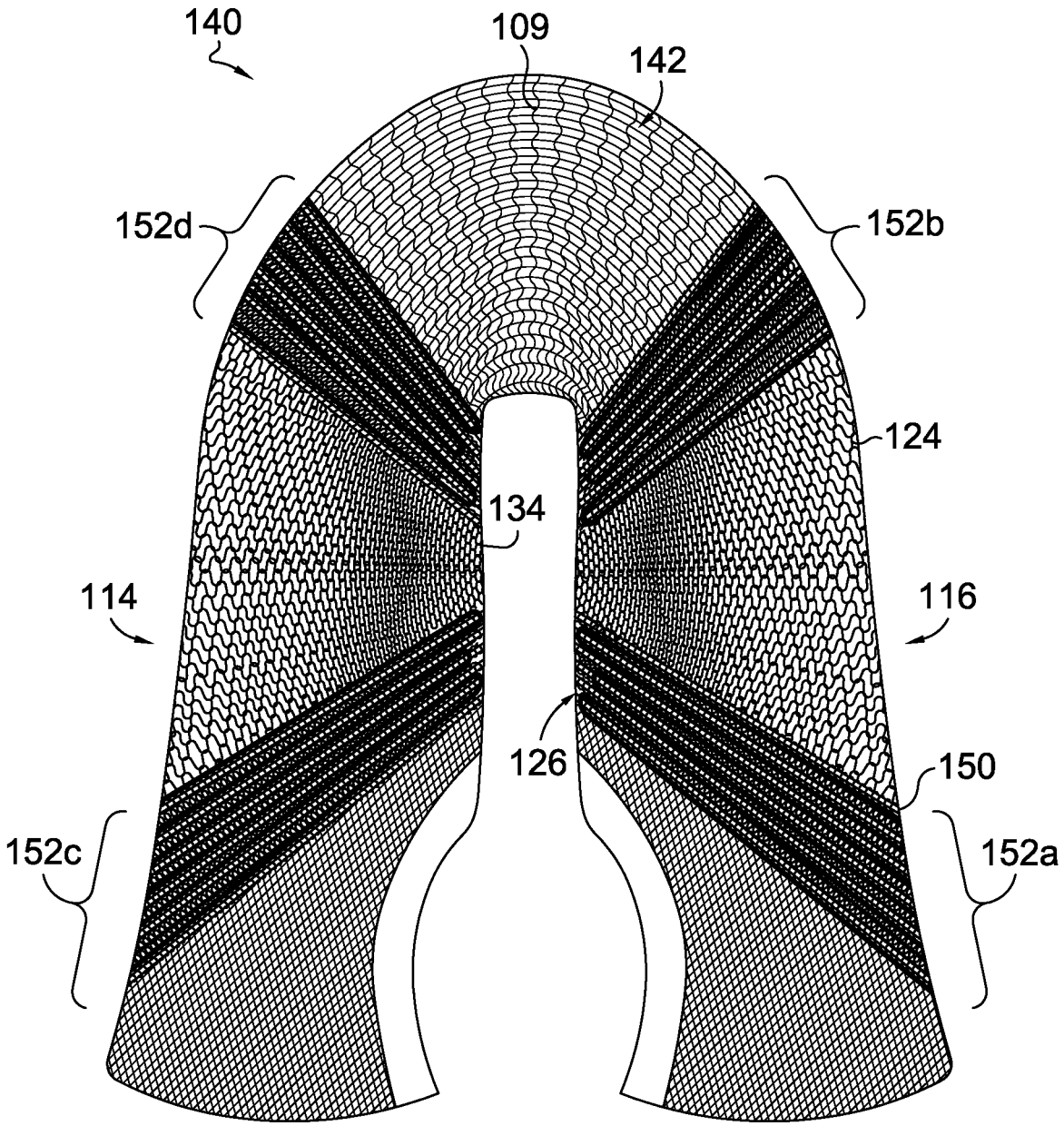
FIG. 2 depicts a knitted component of the article of footwear of FIG. 1A, in accordance with aspects hereof.

At least a portion of the upper 104 may include at least one knitted component 140 formed by a knitting process, such as by a weft-knitting process on a flat knitting machine, for example. In some aspects, the entire or substantially the entire upper 104 may be formed of the knitted component 140. FIG. 2 depicts another view of the knitted component 140 prior to being shaped into the upper 104 shown in FIGS. 1A and 1B.

The knitted component 140 may incorporate various types of yarn that impart different properties to separate areas of the upper 104. That is, one area of the knitted component 140 may be formed from a first type of yarn that imparts a first set of properties, and another area of the knitted component 140 may be formed from a second type of yarn that imparts a second set of properties. With this configuration, properties may vary throughout the upper 104 by selecting specific yarns for different areas of the knitted component 140. The properties that a particular type of yarn will impart to an area of the knitted component 140 partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the yarns selected for the knitted component 140 may affect the properties of the upper 104. For example, a yarn forming the knitted component 140 may be a mono-filament yarn or a multi-filament yarn. As such, unless otherwise specified, the term "yarn", as used herein, does not require multiple filaments or fibers. The yarn may also include separate filaments that are each formed of different materials. In addition, the yarn may include filaments that are each formed of two or more different materials, such as a bi-component yarn with filaments having a sheath-core configuration or two halves formed of different materials. Different degrees of twist and crimping, as well as different deniers, may also affect the properties of the upper 104. Accordingly, both the materials forming the yarn and other aspects of the yarn may be selected to impart a variety of properties to separate areas of the upper 104. Additional properties of yarn(s) used in various aspects of this disclosure are described in further detail below.

The knitted component 140 may be formed as a single integral one-piece element during a knitting process, e.g., such as weft-knitting or another suitable knitting process. Additional elements, such as an underfoot portion and/or a heel element (including, but not limited to, a heel counter or other elements or components) may be integrally formed with the upper 104 as a one-piece unitary structure, e.g., in a single knitting process performed on a knitting machine. Alternatively, one or more such additional elements may be formed separately from the upper 104 and then later attached, secured, or otherwise assembled and/or integrated as needed. Forming the upper 104 with the knitted component may provide the upper 104 with advantageous characteristics including, but not limited to, a particular degree of elasticity, breathability, bendability, strength, moisture absorption, weight, abrasion resistance, and/or a combination of such properties. Further, forming the upper 104 from an integrally-knit knitted component may form various features and structures of the upper 104 without the need for significant additional manufacturing steps or processes, thereby increasing production efficiency.

Looking at FIGS. 1A and 1B and FIG. 2, knitted component 140 may include radially-extending courses. That is, the knitted component 140 may include knit courses that extend from an outer perimeter 124 (e.g., as shown in FIG. 2) of the knitted component 140 (which may form or be adjacent to the bite-line 106 when the knitted component 140 is formed into the upper 104 and joined to the sole structure 102) to a common portion of the knitted component 140. The common portion may be an area of the knitted component 140 that all courses extend towards when the knitted component 140 is formed into the shape of the upper 104 or otherwise constructed. In some aspects, the common portion is positioned along a longitudinal axis of the upper 104 that separates the lateral side 114 and the medial side 116. In some aspects, the common portion is adjacent to the longitudinal axis. For example, the common portion may include the throat region 126, which extends along the longitudinal axis between the medial side 116 and the lateral side 114. As further described with respect to FIG. 3, radially-extending courses within a knitted component, such as the knitted component 140, may create courses that align with many different lines of containment such that the knit courses may provide containment around the wearer's entire foot.

Figure 3:
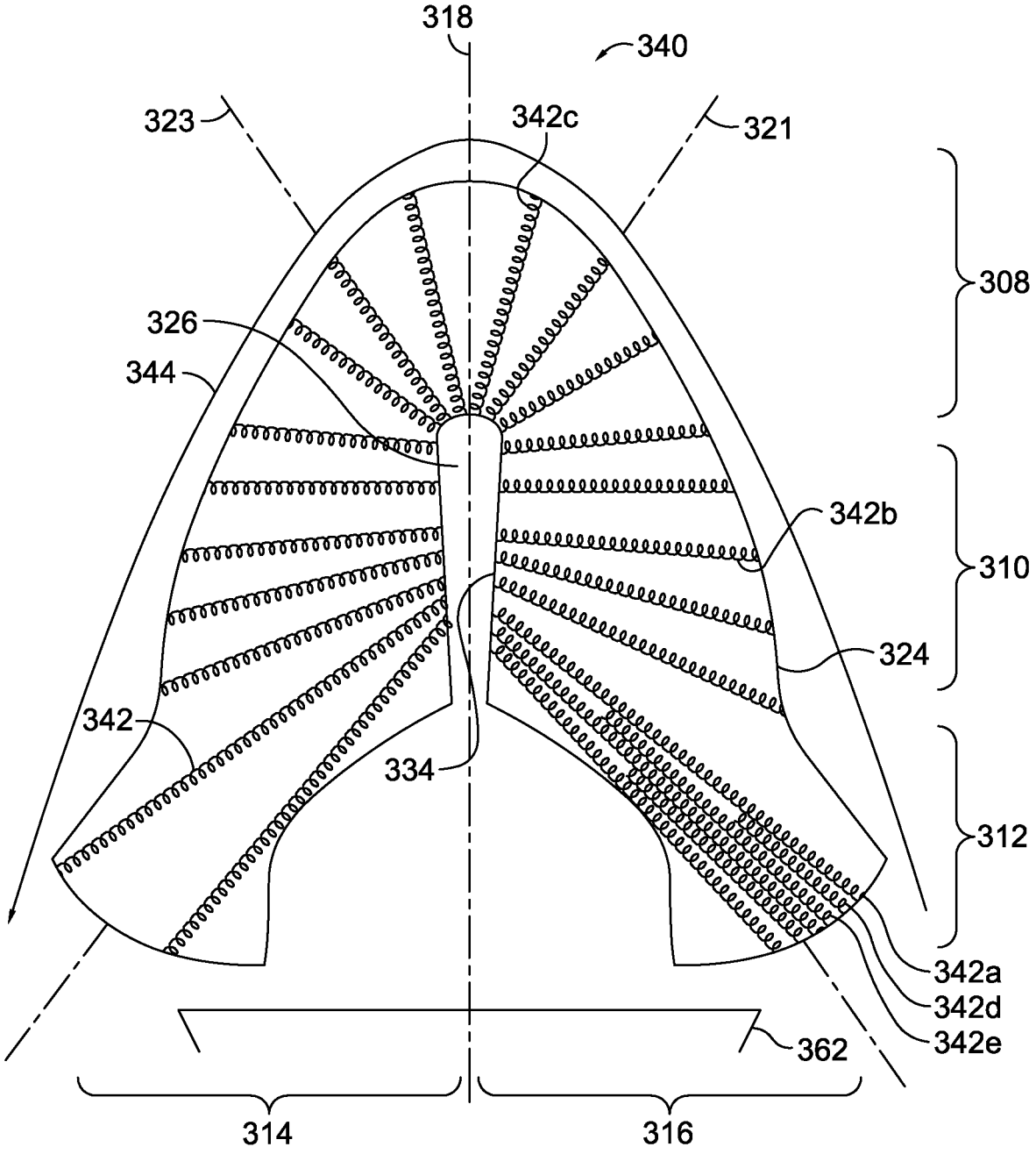
FIG. 3 depicts a schematic representation of a radially knitted component, in accordance with aspects hereof.

FIG. 3 illustrates a schematic view of a knitted component 340 having radially-extending courses. The knitted component 340 of FIG. 3 is intended to depict radially-extending courses generally and the details disclosed with respect to the knitted component 340 may apply to any of the other knitted components disclosed herein (including the knitted components 140, 440, 640, 840, 940, and 1040) unless indicated otherwise. The knitted component 340 has radially extending courses, such as courses 342*a-e*, which may collectively be referred to as "courses 342." The courses 342 are depicted as each having a strand of knitted loops in a simplified form, and it should be understood that these strands of loops do not necessarily represent the stitch sequence used. For example, the courses 342 may include other types of stitches, such as float stitches, tuck stitches, transfer stitches, and the like. Similarly, only a few courses are depicted throughout the knitted component 340 as representative of the various directions in which the courses 342 may extend, but it should be understood that there may be additional courses located between the courses 342 depicted in FIG. 3 that radially extend from a common portion of the knitted component 340 in a similar manner as described below (as with numerous other aspects depicted herein).

The courses 342 extend from an outer perimeter 324 to a common portion or region. In the example shown in FIG. 3, the common portion is the throat region 326, which may include a tongue component, an opening for a tongue component, and/or an inner perimeter 334 of the knitted component 340 defining a space through which a tongue component may extend. In some aspects, the throat region 326 is knit continuously from the lateral side 314 to the medial side 316 such that there may not be an opening or space for a tongue component.

Each of the forefoot region 308, the midfoot region 310, and the heel region 312 may include radially-extending courses that extend in different directions such that at least some of the courses are not parallel, e.g., are at an angle, to one another. For example, at least a forefoot course in the forefoot region 308, such as course 342*c*, extends in a direction that is not parallel to a midfoot course in the midfoot region 310, such as course 342*b*. In other words, at least some courses, including forefoot course 342*c* and midfoot course 342*b*, may be angled relative to each other, where the angle is greater than 0 degrees and less than 180 degrees.

Rather, the courses 342 may extend in different directions that may represent different lines or angles of containment once the knitted component 340 is worn in an article of footwear, such as the article of footwear 100 shown in FIGS. 1A and 1B. The lines of containment may be represented by a knit course extending towards the a common portion of the knitted component while another knit course extends towards the common portion from an opposite direction but at the same or substantially the same angle as the first course. A kitted component knitted in a traditionally manner with all or most courses extending horizontally across the upper, such lines of containment may be limited to the same angle. In contrast, the different courses in a radially-knit knitted component may extend in effectively 360 degrees around the length of the wearer's foot, to form additional lines of containment. At least some containment may be solely due to the radially-extending directions of the knit courses. In some aspects, greater containment is achieved by utilizing yarns of higher tensile strength, higher tenacity, and/or higher stretch-resistance for courses along certain lines of containment, utilizing certain knit stitches, such as floats, for reducing stretch in courses along certain lines of containment, or a combination thereof. At least some of the knitted components described herein, such as the knitted component 140, are described as including one or more containment areas in at least some aspects. These containment areas may represent areas within the knitted component that including one or more features, such as a particular yarn type, fused areas, and/or certain knit stitches, that increase containment beyond what may be provided solely through the direction and alignment of radially knit courses.

In example aspects, the knitted component 340 includes courses that are parallel to a first diagonal line of containment (shown by a first axis 321) and courses that are parallel to a second diagonal line of containment (shown by a second axis 323) that intersects with the first line of diagonal containment in the common portion of the knitted component 340. The first axis 321 may extend from a portion of the knitted component 340 configured to cover a first metatarsal of the wearer to the heel region 312 on the lateral side 314, and the second axis 323 may extend from a portion of the knitted component 340 configured to cover a fifth metatarsal of the wearer to the heel region 312 on the medial side 316. These axes 321 and 323 may collectively form an x-shape and may represent lines of containment that may improve the stability of a wearer's foot within an upper for many types of movements (including turning or changing the direction of movement, side-to-side movements, forward movements, and backward movements). As such, containing the wearer's foot within an upper, such as the upper 104, through courses limiting stretch or otherwise providing support along these axes 321 and 323 may enhance performance of the article of footwear, such as the article of footwear 100.

The knitted component 340 with radially-extending courses 342 may be achieved through a radial knit process in which the lateral and medial sides 314, 316 of the knitted component 340 are formed sequentially, as opposed to simultaneously. As shown in FIG. 3, the knitted component 340 is formed by a knitting machine 362 (e.g., having a front needle bed 361 and a back needle bed 361) by starting at the heel region 312 on the medial side 316 of the knitted component 340, knitting in a knit direction 344 from the heel region 312 to the forefoot region 308, and then knitting the lateral side 314 of the knitted component starting at the forefoot region 308 and finishing at the heel region 312 on the lateral side 314, as shown by knit direction 344. In this way, the knitted component 340 may be formed by knitting the medial side 316 (or at least a plurality of courses on the medial side 316), knitting the forefoot region 308 after knitting the courses on the medial side 316, and knitting the lateral side 314 (or at least a plurality of courses on the lateral side 314) after knitting the forefoot region 308.

In other aspects, a similar but opposite knitting direction may be utilized to form the knitted component 340. For example, the knitted component 340 may be formed by knitting the lateral side 314 (or at least a plurality of courses on the lateral side 314), knitting the forefoot region 308 after knitting the courses on the lateral side 314, and knitting the medial side 316 (or at least a plurality of courses on the medial side 316) after knitting the forefoot region 308.

This knit process for making the knitted component 340 may be performed on a knitting machine 362, which may include an automated knitting machine. The knitting machine 362 in FIG. 3 is intended to be a simplified representation. In example aspects, the knitting machine 362 may be a flat knitting machine, such as a flat V-bed knitting machine with a front needle bed and a back needle bed. The knitted component 340 may be formed by needles from a single needle bed or by needles from both needle beds.

In accordance with this knit process in which the lateral and medial sides 314, 316 are formed sequentially, at least some of the needles utilized to form the lateral side 314 are also utilized to form the medial side 316. In this way, a smaller number of needles on a knitting bed of the knitting machine 362 may be required to create the knitted component 340 compared to a traditional knitting process in which heel and/or midfoot portions of the lateral and medial sides 314, 316 are formed at the same time. Additionally, the same feeder(s) may be utilized for the yarn forming for both the lateral and medial sides 314, 316, rather than requiring duplicate feeders for each side. In this way, the disclosed knitting process may make more needles and/or feeders on the knitting machine 362 available to knit a separate article, such as another knitted component for another upper, at the same time that the knitted component 340 is being knit.

Further, radially-extending courses within the knitted component 340 may divide the knitted component 340 into wedge-shaped portions. For example, looking in the forefoot region 308, a wedge-shaped portion between axis 321 and axis 318 may have radially-knit courses, and a wedge-shaped portion between axis 318 and 323 may have additional radially-knit courses. In some aspects, the courses forming the wedge-shaped portion between axes 321 and 318 is knit before the wedge-shaped portion between the axes 318 and 323. The rest of the knitted component 340 may similarly be divided into various wedge-shaped portions. These wedge-shaped portions may be formed by knitting full-length, radially-extending courses and partial-length, radially-extending courses. A full-length knit course, such as course 342*a*, may extend from one edge of the knitted component 340 (e.g., at the outer perimeter 324) to another edge of the knitted component 340 (e.g., at the inner perimeter 334 in a throat region 326). A partial-length knit course, such as courses 342*d* and 342*e*, may not extend between two edges of the knitted component 340. One or both ends of a partial-length knit course may end before the edge of the knitted component 340. However, the partial-length knit courses, such as courses 342*d* and 342*e* may still be considered radially-extending as they extend in a direction from the outer perimeter 324 towards the common portion (e.g., the throat region 326). Forming partial-length knit courses distributed between full-length knit courses may create shape and dimension in the knitted component 340 while also enabling the courses to extend radially.

In one aspect, a forefoot region comprises a set of wedges that are configured to form a curved structure with a higher curvature, e.g., a smaller radius of curvature. For example, each of the set of wedges in a forefoot region may have a smaller surface area than the set of wedges in a midfoot area. Additionally, or alternatively, a total number of wedges in the forefoot region may be increased. Thus, by incorporating a plurality of wedges in the forefoot region, the curved structure of the knitted component of the upper in the forefoot region is generated.

In this way, the knitted component can comprise a stack of wedges, such that when knitting from a medial to lateral direction, a first set of wedges are configured to form a medial side of the knitted component, a second set of wedges are configured to form a toe region of the knitted component, and a third set of wedges are configured to form a lateral side of the knitted component. In one aspect, additionally, a fourth set of wedges may be included to form a heel region of the knitted component. In a second example, which optionally includes the first example, a number of wedges in the second set of wedges is greater than a number of wedges in the first set of wedges or a number of wedges in the third set of wedges, in addition to other possibilities.

As described with respect to FIG. 3, an entire side (e.g., the medial side 316) may be knit before knitting the other side (e.g., the lateral side 314). However, in other aspects, the areas of a knitted component in which the knitting processes starts and stops may vary. For example, some example knitted components may have other shapes and configurations prior to being formed into an upper, such as where a portion of a medial side in the heel region of the knitted component is integrally knit in a seamless manner with a portion of the lateral side in the heel region. In this way, a seam may be formed on a medial side or a lateral side in the heel region, rather than a central seam in the heel region. Nonetheless, the sequential manner described with respect to FIG. 3 may be maintained for these configurations as the lateral and medial sides of the knitted component are not knit simultaneously. Rather, where the seam of the knitted component will be formed on the medial side, a medial side heel portion may be knit first, then the lateral side (e.g., the heel, midfoot, and forefoot regions on the lateral side), followed by the rest of the medial side (e.g., the forefoot and midfoot regions on the medial side). Where the seam of the knitted component will be formed on the lateral side, a lateral side heel portion may be knit first, then the medial side (e.g., the heel, midfoot, and forefoot regions on the medial side), followed by the rest of the lateral side (e.g., the forefoot and midfoot regions on the lateral side.

Returning to the example knitted component 140 shown in FIGS. 1A to 1B and FIG. 2, the knitted component 140 includes radially-extending knit courses as described with respect to the knitted component 340 FIG. 3. Additionally, the knitted component 140 includes radially-extending tensile elements 150. Similar to the knitted courses of the knitted component 140, the tensile elements 150 extend from an outer perimeter 124 to a common portion or region, such as the throat region 126 in FIGS. 1A and 1B, which may include a tongue, an opening for a tongue, and/or an inner perimeter 134 of the knitted component 140.

Similar to the knit courses, the tensile elements 150 may extend along lines of containment. Additionally, tensile elements 150 may provide additional strength and structure to the underlying knit structure of the knitted component 140 due to the material composition and/or manner of integration of the tensile elements 150. In this way, the tensile elements 150 may be positioned in areas of the knitted component 140 corresponding to particular lines of containment desired or suitable for the article of footwear 100. In the example knitted component 140, tensile elements 150 are arranged into groupings of tensile elements 150 that, when viewed from the top, collectively have an X-shaped configuration. FIG. 2, for example, shows the knitted component 140 prior to being shaped into the upper 104 and more clearly depicts the X-shaped configuration of the groupings, which may be referred to herein as containment areas (or containment vectors) 152*a*, 152*b*, 152*c*, and 152*d*. The first containment area 152*a* includes tensile elements 150 and knit courses extending from part of the outer perimeter 124 at least partially in the heel region 112 on the medial side 116 to the common portion, or throat region 126 in the midfoot region 110 on the medial side 116. The second containment area 152*b* includes tensile elements 150 and knit courses extending from part of the outer perimeter 124 at least partially in the forefoot region 108 on the medial side 116 to the common portion, or throat region 126 in the midfoot region 110 on the medial side 116. The third containment area 152*c* includes tensile elements 150 and knit courses extending from part of the outer perimeter 124 at least partially in the heel region 112 on the lateral side 114 to the common portion, or throat region 126 in the midfoot region 110 on the lateral side 114. The fourth containment area 152*d* includes tensile elements 150 and knit courses extending from part of the outer perimeter 124 at least partially in the forefoot region 108 on the lateral side 114 to the common portion, or throat region 126 in the midfoot region 110 on the lateral side 114. The distance, which may be measured by the number of courses, between adjacent tensile elements 150 within a single containment area (e.g., containment area 152*a*) is less than the distance between tensile elements 150 in separate containment areas.

The placement (including density) and orientation of the tensile elements 150 within the knitted component 140 may vary based on an intended activity for the article of footwear 100. Generally, containment provided by a tensile element 150 on one side (e.g., lateral side 114) may be improved from containment on the other side (e.g., medial side 116) to serve as an anchor. In this way, the first containment area 152*a* of tensile elements 150 extending towards the heel region 112 on the medial side 116 may anchor the fourth containment area 152*d* of tensile elements 150 extending into the forefoot region 108 on the lateral side 114, while the second containment area 152*b* of tensile elements 150 extending towards the forefoot region 108 on the medial side 116 may anchor the third containment area 152*c* extending towards the heel region 112 on the lateral side 114.

The tensile elements 150 may each have the configuration of a multi-filament yarn, a filament (e.g., a mono-filament yarn), thread, rope, webbing, cable, or chain, for example. The tensile elements 150 may comprise a material having a property to increase the strength of the knitted component 140 in areas with the tensile elements 150. For example, the tensile elements 150 may comprise a yarn having a high tenacity, such as a tenacity greater than 5 grams/denier. In some embodiments, the tenacity of the tensile elements 150 may be greater than other yarn(s) of the knitted component 140. In one example, the tensile elements 150 are formed from a high tenacity polyester yarn, such as Gral, produced by the Coats Group PLC. In another example, the tensile elements 150 are formed by a high-tenacity nylon yarn. Further, in some examples the tensile element 150 may exhibit greater stretch-resistance than the rest of the knitted component 140 and may be formed from a variety of engineering filaments that are utilized for high tensile strength applications, including glass, aramids (e.g., para-aramid and meta-aramid), ultra-high molecular weight polyethylene, and liquid crystal polymer.

The tensile elements 150 may be incorporated into the knitted structure of the knitted component 140 in a variety of ways. For example, the tensile elements 150 may each be inlaid within the structure of the knitted component 140. When tensile elements 150 are inlaid, the tensile elements 150 may each extend, in an unlooped state, along a course formed by knit loops of one or more other yarns. The inlaid tensile elements 150 may include a loop at each end of the tensile element 150 to anchor it into the knitted structure of the knitted component 140 but may generally otherwise extend through a course without being interlooped with another strand. For instance, the tensile element 150 may alternate between being located behind loops of another yarn and in front of loops of another yarn within a course such that the tensile element 150 extends through the interlooping structure formed by another yarn of the knitted component. In some aspects, the knitted component 140 includes a double-knit textile construction formed with at least two ends of yarns that switch between needles on two needle beds of the knitted component. In this configuration, the tensile element 150 may be inlaid so that it generally extends between surfaces formed by loops created on both needle beds. In other examples, the knitted component 140 includes a first layer and a second layer that are coextensive and overlap one another to form a channel extending in the course-wise direction, and the tensile elements 150 may each extend through a channel.

In other examples, the tensile elements 150 may be knit into the knitted structure of the knitted component 140 using a knit sequence to simulate an inlaid structure as described above. For example, a course of the tensile element 150 may be knit with a repeating sequence of float stitches and knit stitches as the tensile element 150 extends from the outer perimeter 124 to the inner perimeter 134 of the knitted component 140. Further details of this knitting technique referred to herein as a mock inlay are discussed with respect to FIG. 9.

At least some of the tensile elements 150 may form loops around lace apertures formed in the knitted component 140 as shown in FIGS. 1A-1B and FIG. 2, which may strengthen the knitted component 140 to withstand the additional tension applied to the knitted component 140 in those areas when laces 132 are tensioned. In other examples, at least some of the tensile elements 150 may extend out of the knitted component 140 and form loops for receiving laces 132.

In some examples, the knitted component 140 may be at least partially formed with a fusible yarn. For example, the knitted component 140 may be formed with a first yarn knit with at least a second yarn, where the first yarn has a first melting temperature and the second yarn has a second temperature that is greater than the first melting temperature of the first yarn, where the second temperature is the lower of a decomposition temperature or melting temperature of the second yarn. As such, the first yarn, which may be referred to as a fusible yarn, may be at least partially melted or softened when heat is applied while the second yarn may retain its solid structure. Once fully melted, partially melted or softened, the fusible yarn may fuse with other portions of the fusible yarn and/or the second yarn. Activation of a fusible yarn within the knitted component may result in certain properties of the upper 104. For example, the fused areas formed by the fusible yarn may provide increased abrasion-resistance and/or water-resistance in select areas and may limit stretch of the knitted component 140, thereby imparting stretch-resistance and containment, in select areas. Example fusible yarns in the knitted component 140 may have one of the following structures: a multi-filament yarn having some filaments formed from a low-melt material and some filaments formed from a high-melt material, a multi-filament yarn made entirely of filaments with low-melt material, a bi-component yarn having a low-melt material and a high-melt material (arranged either in a core/sheath configuration or a side-by-side configuration), or a mono-filament yarn made entirely of a low-melt material.

As described further below with respect to specific examples, the fusible yarn in the knitted component 140 may be activated by being heated to a temperature above the melting temperature of the fusible material, such as a thermoplastic polymer material, in the fusible yarn and the melted fusible material may bond with one or more other knitted strands or structures within the knitted component 140. For example, the fusible yarn may be a coated yarn (e.g., have a core-sheath configuration) where the coating is a first material (which may comprise a thermoplastic polymer) and has a lower melting temperature than the melting temperature of a second material (which may exclude the thermoplastic polymer from the first material) forming the core. This example fusible yarn may be activated by softening, partially melting, or fully melting the coating while at least the core substantially retains its solid structure. In one example where the fusible yarn is a coated yarn, the coating may be softened so that portions of the coating may be fused with adjacent other portions of the coated yarn (as well as any other yarns or tensile elements) within interlooped courses of the coated yarn. In another example where the fusible yarn is a coated yarn, the coating may be partially melted so that the melted first material of the coating may be reflowed and solidified between adjacent structures within the knitted component. In this way, the partially melted coating may fuse together adjacent portions of the coated yarn, which comprises the core yarn and remaining (non-melted) portions of the coating, as well as fuse to other yarns or tensile elements. In another example where the fusible yarn is a coated yarn, the coating may be fully melted, re-flowed, and solidified so that the re-solidified coating fuses together portions of the remaining core and other yarns or tensile elements. In another example, the fusible yarn is a mono-filament yarn made entirely of a thermoplastic polymer material that may be either heated to partially melt and re-solidified to fuse non-melted portions of the mono-filament yarn to other non-melted portions of the mono-filament yarn and/or to other yarn(s) or tensile elements knit with the fusible yarn or heated to fully melt and re-solidify to fuse together other yarn(s) knit with the fusible yarn.

The knitted component 140 may have an exterior-facing surface 142 and an opposite interior-facing surface. Although not visible in the views of the knitted component 140 in FIGS. 1A, 1B, and 2, the interior-facing surface of the knitted component 140 should be understood to generally face away from the exterior-facing surface 142 and towards a foot-receiving opening when the knitted component 140 is formed into the upper 104. In some aspects, the exterior-facing surface 142 is formed by a first layer of the knitted component 140 and the interior-facing surface is formed by a second layer that is integrally knit with the first layer. For example, the knitted component may have a double knit structure (e.g., double-knit jacquard structure) such that the exterior-facing surface 142 is formed by yarn on a first needle bed (e.g., a front needle bed) and the interior-facing surface is formed by yarn on a second needle bed (e.g., a back needle bed). Further, as described below, the knitted component 140 may have a jacquard double knit structure such that yarn(s) knit on the first needle bed to form the exterior-facing surface in some areas of the knitted component 140 may selectively be moved to the second needle bed to form the interior-facing surface in other areas of the knitted component 140 and yarn(s) knit on the second needle bed to form the interior-facing surface in some areas may be selectively moved to the first needle bed to form the exterior-facing surface 142 in other areas.

At least the exterior-facing surface 142 of the knitted component 140 is formed with fusible yarn in areas having the tensile elements 150 (e.g., containment areas 152*a-d*). The fusible yarn may be knit on an exterior-facing surface 142 to form the courses that include the tensile elements 150. As such, once the fusible yarn is activated (e.g., through heat), the fusible yarn may be at least partially melted to fuse to the tensile elements 150. Additionally, aspects of this disclosure may include the fusible yarn being knit on the exterior-facing surface 142 to form the courses that are positioned between and separating adjacent tensile elements 150 within a containment area (e.g., 152*a-d*) of the tensile elements 150. When fully melted or partially melted, the fusible material of the fusible yarn may flow to fill in spaces between the remaining knitted structures as described further below. For example, the fusible yarn may be a yarn having a sheath around a core, where the sheath is formed of a material with a lower melting temperature than the material forming the core. In this aspect, the sheath of the fusible yarn may at least partially melt and fill in spaces between knitted loops formed by the remaining core of the fusible yarn. Additionally or alternatively, the fusible material of the fusible yarn may be at least partially melted to fill in spaces between other yarns or structures, such as the tensile elements 150 and/or the second yarn forming the knitted component 140. The use of fusible yarn to create fused areas along courses within the containment areas 152*a-d* can help to increase the containment or lock-down provided by the tensile elements 150 as well as provides other benefits such as increased abrasion resistance and water resistance while minimizing or even eliminating the need of additional layers and post-knitting processes. Minimizing or eliminating the need for additional layers helps the upper 104 maintain a light weight. For example, aspects of the upper 104 may have a weight that is about 50 grams or less in some aspects, about 40 grams or less in some aspects, or about 30 grams or less in some aspects.

In other areas of the knitted component 140, such as areas extending between the containment areas 152*a-d* of the tensile elements 150, the exterior-facing surface 142 of the knitted component 140 does not include the fusible yarn. Instead, the exterior-facing surface 142 within these areas may be formed with the second yarn having a greater melting or decomposition temperature than the fusible yarn. In this way, fused areas on the exterior-facing surface 142 may be created in only select portions of the knitted component 140 when heat is applied.

The fusible yarn may comprise a thermoplastic polymer material. Example materials of the fusible yarn may include a polyurethane, such as thermoplastic polyurethane (TPU), polyethylene terephthalate (PET), low-melt polyamide (nylon) yarns (such as nylon-6, nylon-11, or nylon-12), low-melt polyester, or a combination thereof. In some aspects, the melting temperature of the fusible yarn is less than about 115 degrees Celsius, in some aspects, less than about degrees Celsius or, in some aspects, less than about 100 degrees Celsius. In contrast, the second yarn knitted with the fusible yarn and/or the material forming the tensile elements 150 may have a melting temperature or decomposition temperature greater than about 150 degrees Celsius in some aspects, greater than about 185 degrees Celsius in some aspects, or greater than about degrees Celsius in some aspects.

In example aspects, the fusible yarn also includes "grip" properties that, when knit into the knitted component 140, form areas having a greater coefficient of friction relative to areas without or with a lower concentration of the grip yarns. Creating areas within the knitted component 140 having a greater coefficient of friction on the exterior-facing surface 142 may help a wearer of the footwear 100 with ball control as the upper 104 having the knitted component 140 may better grip a ball, such as a global football. References herein to differences in coefficients of friction in various portions of the knitted component 140 or other knitted components of this disclosure may be determined using the Textile-Ball Coefficient of Friction test disclosed herein.

In examples of this disclosure, the fusible yarn with grip properties (referred to herein as grip yarn) may have a coating with a first polymeric composition around a core having a second material composition that is different than the first polymeric composition. The first polymeric composition may include a thermoplastic elastomer that is absent from the second composition. The thermoplastic elastomer may include one or more of a thermoplastic co-polyester elastomer, a thermoplastic polyether block amide elastomer, a thermoplastic polyurethane elastomer, a polyolefin based-copolymer elastomer, a thermoplastic styrenic copolymer elastomer, a thermoplastic ionomer elastomer, or any combination thereof. In one aspect, the first polymeric composition comprises a thermoplastic elastomeric styrenic co-polymer. In a further aspect, the thermoplastic elastomeric styrenic co-polymer may be a styrene butadiene styrene (SBS) block copolymer, a styrene ethylene/butylene styrene (SEBS) resin, a styrene acrylonitrile (SAN) resin, or any combination thereof. In one aspect, a polymeric composition comprises a thermoplastic elastomeric polyester polyurethane, a thermoplastic polyether polyurethane, or any combination thereof. In some aspects, the thermoplastic elastomeric polyester polyurethane may be an aromatic polyester, an aliphatic composition, or a combination thereof. It should be understood that other thermoplastic polymeric materials not specifically described below are also contemplated for use in the grip yarn as described herein. In an aspect, the coating for the grip yarn described herein is produced from fibers or filaments composed of only a single thermoplastic elastomer. In other aspects, the coating is composed of a blend of two or more different thermoplastic elastomers.

In one aspect, a first polymeric composition comprising a thermoplastic elastomer has a melting temperature greater than about 110 degrees Celsius and less than about 170 degrees Celsius. In another aspect, a first polymeric composition comprises a thermoplastic elastomer having a melting temperature of about 110 degrees Celsius to about 170 degrees Celsius, about 115 degrees Celsius to about 160 degrees Celsius, about 120 degrees Celsius to about 150 degrees Celsius, about 125 degrees Celsius to about 140 degrees Celsius, about 110 degrees Celsius to about 150 degrees Celsius, or about 110 degrees Celsius to about 125 degrees Celsius.

Additionally, the second material composition of the core yarn may be a thermoplastic composition or a thermoset composition. The core yarn may be any material which retains its strength at the temperature at which the first polymeric material is extruded during the coating process. The core yarn may be natural fibers or regenerated fibers or filaments, or synthetic fibers or filaments, and may have the structure of a staple yarn, a multi-filament yarn, or a mono-filament yarn. In one aspect, the core yarn may be composed of a cotton, silk, wool, rayon, nylon, elastane, polyester, polyamide, polyurethane, and/or polyolefin. In one aspect, the core yarn is composed of polyethylene terephthalate (PET). The second material composition of the core yarn may have a second melting or deformation temperature that is at least 20 degrees Celsius greater, at least 50 degrees Celsius greater, at least 75 degrees Celsius greater, or at least 100 degrees Celsius greater than the first melting temperature of the first polymeric composition. Further details of various examples of the grip yarn are disclosed further below.

In some embodiments, the grip yarn is heated to partially or fully melt the thermoplastic elastomer forming the coating. Once the coating is either partially or fully melted, it may flow into spaces between remaining interlooped structures (e.g., interlooped portions of the remaining coating and core where the coating is only partially melted, interlooped portions of the remaining core where the coating is fully melting, and/or interlooped portions of another strands, such as the tensile element 150). When the knitted component 140 is cooled, the re-flowed coating from the grip yarn effectively fuses together these various structures as described above with respect to fusible yarns more generally. The remaining structure may be referenced herein as a fused network of interlooped yarns as there may be interlooped yarns remaining within the fused area. The re-flowed coating and, in some aspects, the remaining (un-melted coating) of the grip yarn may contribute to providing a greater co-efficient of friction to the fused areas while also providing increased containment due to fusing together loops within a course and/or in adjacent courses. In some aspects, the grip yarn may be heated through steaming. In some aspects, the grip yarn may be heated through a thermoforming process in which heat and pressure is applied to the knitted component 140 in a mold. In these aspects, the remaining structure once cooled may be referred to herein as a thermoformed network of interlooped yarns.

In example aspects herein, a knitted component is formed such that it includes grip yarns in one or more regions. During such process, one or more of a temperature, pressure, humidity, and duration of post-processing applied to the knitted component including the grip yarn may be adjusted based on one or more of a desired coefficient of friction, a desired level of containment, and a desired level of breathability. The post-processing can include processing the knitted component after knitting. In one example, post-processing grip yarns can include at least partially melting the grip material of the grip yarn(s). Further, post-processing the grip yarns may include at least partially re-flowing the grip material. Further, post-processing the grip yarns may include solidifying the grip material after melting and re-flowing. In one example, the knitted component may be entirely subject to the same post-processing conditions. In another example, one or more regions of the knitted component may be selectively post-processed. For example, one or more containment areas where the grip yarn is present on an exterior-facing surface of the knitted component may be selectively processed by applying heat and/or pressure to those grip areas while the remaining areas of the knitted component where the grip yarn is not present on the exterior surface may be shielded from the application of heat and/or pressure, or a different amount heat and/or pressure may be applied.

As one non-limiting example, to process the grip yarns, e.g., melt, re-flow, and then re-solidify them at least partially, the knitted component is placed in a steam chamber. Then, steam and/or heat is applied at least at a melting temperature of the grip material, but lower than a melting temperature of remaining yarns forming the knitted component. This allows the grip material of the yarns to melt and re-flow a desired amount. In one instance, this process can be performed at 150 degrees Celsius to 153 degrees Celsius, at 1-3 bar, and for 10-15 seconds. Then, once the heating and steaming process is at a desired level of completion, e.g., with the fusible materials at least partially melted, re-flowed, and beginning to solidify, the knitted component can be transferred to a cooling chamber, and cooled at atmospheric pressure until the knitted component reaches 20-25 degrees Celsius.

In different aspects, fusible yarns can be processed, e.g., heated, melted, and/or reflowed to different degrees. In some aspects, certain portions of a knitted component that include fusible materials (e.g., yarns) may not be processed, e.g., heated, melted, and/or reflowed at all. In other aspects, some areas of a knitted component that include fusible materials (e.g., yarns) may be processed, e.g., heated, melted, and/or reflowed, and others may not be processed. In still further aspects, some areas of a knitted component that include fusible materials (e.g., yarns) may be processed more than other areas that include fusible materials, e.g., being exposed to higher heat, to a greater duration of steam, being exposed to a greater duration of heat and/or steam, or otherwise being processed so that different material changes occur, e.g., an amount of melting, re-flowing, and re-solidifying of the fusible materials, and/or an extent of formation of a thermoformed network of interlooped yarns caused by the same.

In some embodiments, a grip yarn is not included on at least an exterior-facing surface in rearward portions of the knitted component 140. As such, a grip yarn may not be included on the exterior-facing surface 142 within the first containment area 152*a* or the third containment area 152*c*. Because the forward aspects of the footwear 100 are more likely to be in contact with a ball, it may be more advantageous to include grip yarns on the exterior-facing surface 142 in the forward portions of the knitted component 140, such as in the second containment area 152*b* and fourth containment area 152*d*. Additionally, in some aspects, the grip yarns may be included in exterior-facing surface 142 in a central forefoot region 109 of the knitted component 140 between the second containment area 152*b* and the fourth containment area 152*d*. In some aspects, some portions having the grip yarn on the exterior-facing surface 142, such as the second containment area 152*b* and the fourth containment area 152*d* include a different fusible yarn on the interior-facing surface. This fusible yarn, which is in the form of a mono-filament in one example, may have a different polymeric composition than the grip yarn and, in at least some aspects, forms knitted areas having a lower coefficient of friction than areas formed with the grip yarn. Further, in some aspects, a mono-filament yarn with a different material composition is knit with this fusible yarn on the interior-facing surface. In some aspects, this fusible yarn may be fully or at least partially melted after knitting to form fused areas on the interior-facing surface, which may provide additional abrasion-resistance, water-resistance, and structural support to the wearer's foot.

In some aspects, the grip yarn is not included at all (on the exterior-facing surface 142 or the opposite interior-facing surface) within or above rearward portions of the knitted component 140. Instead, in some aspects, high-tenacity yarns having a greater melting temperature or decomposition temperature than the grip yarn may form the exterior-facing surface 142 and the interior-facing surface of the knitted component 140 in these rearward portions, and the containment areas 152*a* and 152*c* may also include the tensile elements 150 knit or inlaid with the high-tenacity yarns.

In alternative configurations, the knitted component 140 includes a grip yarn on the exterior-facing surface 142 in each of the containment areas 152*a*, 152*b*, 152*c*, and 152*d* of the tensile elements 150 but the exterior-facing surface 142 of areas of the knitted component 140 extending between the containment areas 152*a*-152*d* exclude the grip yarn. For example, the grip yarn may be excluded from the exterior-facing surface 142 in a central forefoot region 109 between the second containment area 152*b* and the fourth containment area 152*d*, in the midfoot region 110 on the medial side 116 between the first containment area 152*a* and the second containment area 152*b*, in the midfoot region 110 on the lateral side 114 between the third containment area 152*c* and the fourth containment area 152*d*, in the heel region 112 on the medial side 116 adjacent the first containment area 152*a*, and in the heel region 112 on the lateral side 114 adjacent the third containment area 152*c*.

As previously stated, one or more additional yarns may be knit (interlooped) with the grip yarn such that the grip yarn and one or more additional yarns form the same courses within the knitted component 140. In various examples, the grip yarn may be knit to form at least part of the exterior-facing surface 142, while a high-tenacity yarn with a greater melting or decomposition temperature than the grip yarn may be knit to form at least part of the interior-facing surface. In courses that include the tensile elements 150, the tensile element 150 may also be knit to form at least part of the exterior-facing surface 142 with the grip yarn or inlaid between courses forming the exterior-facing surface 142 and the interior facing surface. In some aspects, the tensile element 150 is a high-tenacity yarn that may have a different material composition as the second yarn, which also may be a high-tenacity yarn, but it is contemplated that the high-tenacity yarn knit on the interior-facing surface may have the same material composition as the tensile elements 150.

In portions of the midfoot region 110 on the medial side 116 between the first and second containment areas 152*a* and 152*b* and on the lateral side 114 between the third and fourth containment areas 152*c* and 152*d*, the knitted component 140 may not include the grip yarn. Rather, these portions may be formed with mono-filaments knit on both the first needle bed and the second needle bed, where the mono-filaments have a greater melting or decomposition temperature than the melting temperature of the grip yarn. The mono-filaments knit on the first and second needle beds may either have the same material composition or different material compositions. Additionally, in some aspects, a high-tenacity yarn is knit between the first and second needle beds within these portions of the midfoot region 110. The high-tenacity yarn may be knit between the two needle beds by intermittently switching between knitting on the first needle bed with the first mono-filament and knitting on the second needle bed with the second mono-filament.

FIGS. 4A to 4D depict various views of an article of footwear 400 and its features according to another example of this disclosure. The article of footwear 400 includes a sole structure 402 coupled to an upper 404. The sole structure 402 may have the same features described with respect to the sole structure 102 of the article of footwear 100 and may be joined to the upper 404 in a similar way. Additionally, the upper 404 may have the same or similar features as the upper 104 except as otherwise indicated below.

For example, the upper 404 includes a knitted component 440. In various examples, the knitted component 440 forms the entire or substantially the entire upper 404 and may incorporate various types of yarns to impart different properties to separate areas of the upper 404. Any of the types of yarns described as being incorporated into the knitted component 140 may be incorporated into the knitted component 440 with specific examples further discussed below. The knitted component 440 may be formed through any of the processes described for the knitted component 140 and may similarly have a unitary knit structure with various structures being integrally knit to provide different properties to the upper 404. Additionally, in some aspects, the knitted component 440 is radially knit in a similar manner described with respect to the knitted components 140 and 340 such that the knitted component 440 includes radially knit courses extending from an outer perimeter of the knitted component 440 (which may be at the bite-line 406 or extending partially underfoot) to a common portion (such as the throat region 426, which may be adjacent an inner perimeter 434 of the knitted component 440).

Further, similar to examples of the knitted component 140, the knitted component 440 may include radially-extending tensile elements 450 extending from the outer perimeter 424 to the common portion as described above. These tensile elements 450 may provide additional strength and structure to the underlying knit structure of the knitted component 440 due to the material composition and/or manner of integration of the tensile elements 450 into the knitted component 440. Such materials of and/or manners of integrating the tensile elements 450 may be any of the examples described with respect to the tensile elements 150 of the knitted component 140. Additionally, the tensile elements 450 may be arranged in groupings (referred to herein as containment areas) such that the distance between adjacent tensile elements 450 within a single containment area is less than the distance between tensile elements 450 in different containment areas. Examples of the knitted component 440 include at least two containment areas include tensile elements. In one example, the knitted component 440 includes four containment areas: a first containment area 452*a* with tensile elements 150 extending from part of the outer perimeter 424 at least partially in the heel region 412 on the medial side 416 to the common portion, or throat region 426 in the midfoot region 410 on the medial side 416; a second containment area 452*b* with tensile elements 450 extending from part of the outer perimeter 424 at least partially in the forefoot region 408 on the medial side 416 to the common portion, or throat region 426 in the midfoot region 410 on the medial side 416; a third containment area 452*c* with tensile elements 450 extending from part of the outer perimeter 424 at least partially in the heel region 412 on the lateral side 414 to the common portion, or throat region 426 in the midfoot region 410 on the lateral side 414; and a fourth containment area 452*d* with tensile elements 450 extending from part of the outer perimeter 424 at least partially in the forefoot region 408 on the lateral side 414 to the common portion, or throat region 426 in the midfoot region 410 on the lateral side 414. The first, second, third, and fourth containment areas 452*a-d* may generally form an X-shaped configuration on the upper 404 as depicted in the top-down view of the article of footwear 400 in FIG. 4C.

Additionally, in some aspects, additional tensile elements 450 may be located in the forefoot region 408. These tensile elements 450 may extend from an outer perimeter 424 in the forefoot region 408 to the common portion, or throat region 426, in the forefoot region 408. The example depicted in FIGS. 4A-4C include three such additional tensile elements 450 extending in the forefoot region 408 between the second containment area 452*b* and the fourth containment area 452*d*. These tensile elements 450 in the forefoot region 408 may provide additional containment to the front of a wearer's foot, in the toe area, which may be particularly advantageous during activities requiring agility and/or forward motions with sudden or quick stopping. In addition, with the knitted component 440 shown in FIGS. 4A-4D and with any other aspects described herein, additional tensile elements can be included in the forefoot region 408, e.g., with a greater density (e.g., a lesser spacing) of such tensile elements, and with these additional tensile elements extending radially about the common portion, e.g., the throat region 426. In additional aspects, and similarly, a plurality of tensile elements can be included on the medial side 416 between the containment areas 452*a* and 452*b* and/or on the lateral side 414 between the containment areas 452*c* and 452*d*, with these additional tensile elements extending between the outer perimeter 424 and the inner perimeter 434, e.g., in a linear or radial fashion about a common portion, for additional reinforcement and/or containment in these directions.

In further examples, the knitted component 440 is partially formed with a fusible yarn in the same or similar manner described with respect to the knitted component 140. For example, a fusible yarn may be incorporated on an exterior-facing surface 442 in select regions of the knitted component 440 and may be absent from the exterior-facing surface 442 in other regions of the knitted component 440. The fusible yarn may have a lower melting temperature than a temperature of a second yarn, where the temperature of the second yarn is the lower of a decomposition temperature or melting temperature. The second yarn may be either knit with the fusible yarn on the exterior-facing surface or knit to form the interior-facing surface. The fusible yarn in the knitted component 440 may be activated with heat so that the exterior-facing surface 442 of the knitted component 440 includes fused areas (corresponding to areas formed with the fusible yarn on the exterior-facing surface 442) and unfused areas (corresponding to areas excluding the fusible yarn on the exterior-facing surface 442).

Example materials and structures for a fusible yarn described for the knitted component 140 may similarly be used for fusible yarn in the knitted component 440. Additionally, examples of the fusible yarn in the knitted component 440 may be a grip yarn as described with respect to the knitted component 140 such that portions of the knitted component 440 formed with the grip yarn may have a greater coefficient of friction than portions of the knitted component 440 without the grip yarn or with a lower concentration of the grip yarn.

The fusible yarn or, in some aspects, the grip yarn may be knit on the exterior-facing surface 442 within the containment areas 452*a-d*. The fusible yarn may be knit to form the courses that include the tensile elements 450 within these containment areas 452*a-d*. As such, once the fusible yarn is activated (e.g., through heat), the fusible yarn may be fused to the tensile elements 450. For example, the fusible yarn may be a grip yarn having a core with a thermoplastic elastomer coating as described herein, and once heated, the core of the grip yarn is fused to the tensile elements 450 via melting of the thermoplastic elastomer coating. Additionally, aspects of this disclosure may include the fusible yarn being knit on the exterior-facing surface 442 to form the courses that are positioned between adjacent tensile elements 450 within a containment area (e.g., 452*a-d* or any thereof). When fully melted or partially melted, the fusible material of the fusible yarn may flow to fill in spaces between the remaining knitted structures. The use of fusible yarn to create fused areas along courses within the containment area 452*a-d* can help to increase the containment or lock-down provided by the tensile elements 450 as well as provides other benefits, such as increased abrasion-resistance and water-resistance while minimizing or even eliminating the need of additional layers and post-knitting processes. Minimizing or eliminating the need for additional layers helps the upper 104 maintain a light weight. For example, aspects of the upper 104 may have a weight that is about 50 grams or less in some aspects, about 40 grams or less in some aspects, and about 30 grams or less in some aspects. Additionally, in aspects in which the fusible yarn is a grip yarn as disclosed herein, areas of the upper 404 with the grip yarn may enable the wearer to better feel and grip a ball, such as a global football, to provide better ball control to the wearer.

Examples of the knitted component 440 may include the fusible yarn and, in some aspects, grip yarn, in other portions of the knitted component 440 outside of containment areas 452*a-d*. For example, the knitted component 440 may include a grip yarn in the exterior-facing surface 442 in areas adjacent the bite-line 406 between the upper 404 and the sole structure 402 within the midfoot region 410 (e.g., between the first containment area 452*a* and the second containment area 452*b* on the medial side 416 and between the third containment area 452*c* and the fourth containment area 452*d* on the lateral side 414). Similarly, the knitted component 440 may include the grip yarn knit to form the exterior-facing surface 442 in areas adjacent the bite-line 406 in the forefoot region 408 between the second containment area 452*b* and the third containment area 452*c*. These additional areas of the fusible or grip yarn on the exterior-facing surface 442 outside of the containment areas 452*a-d* may extend only partway up the upper 404. For example, as depicted by the stippling in FIGS. 4A-4C, the fusible yarn or grip yarn on the exterior-facing surface 442 outside of the containment areas 452*a* may extend from the bite-line 406 but do not continuously extend to the inner perimeter 434 at the throat region 426. In this way, although the fusible yarn or grip yarn may be knit within courses having the additional tensile elements 450 in the forefoot region 408, such that the fusible or grip yarn does not extend the length of these additional tensile elements 450 in the same manner that the fusible or grip yarn may extend the length of the tensile elements 450 within the containment areas 452*a-d*.

Figure 4A:
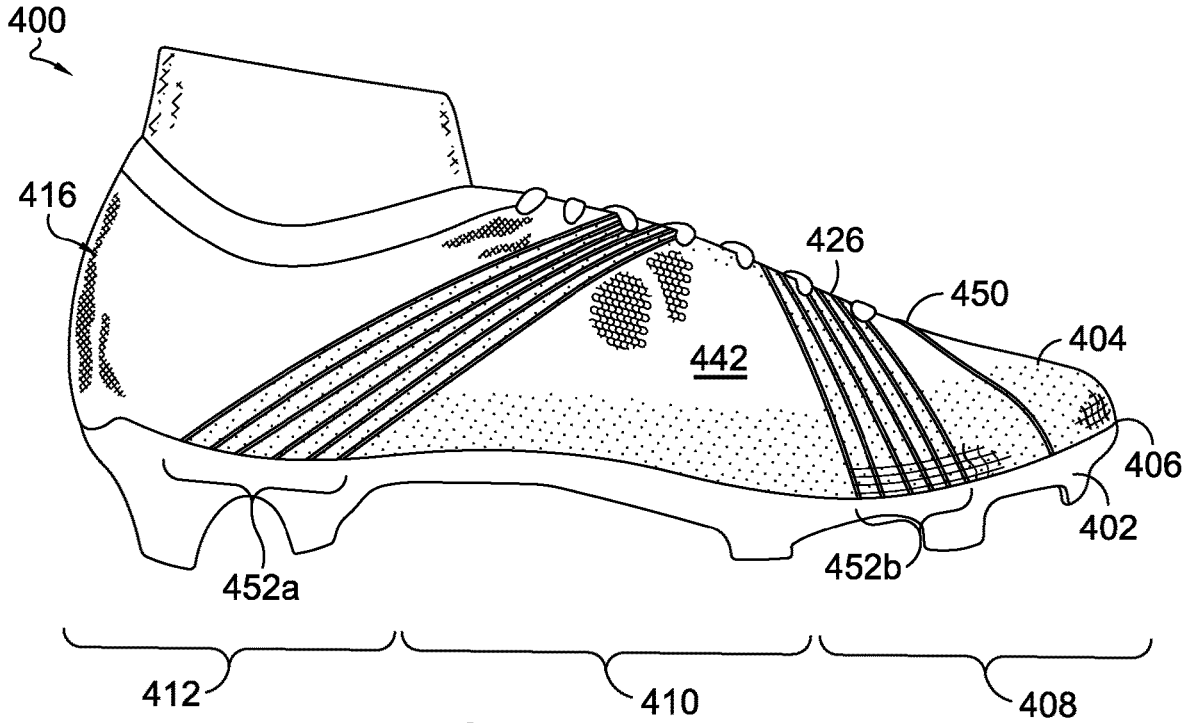
FIGS. 4A-4D depict different views of an article of footwear, in accordance with aspects hereof.
Figure 4B:
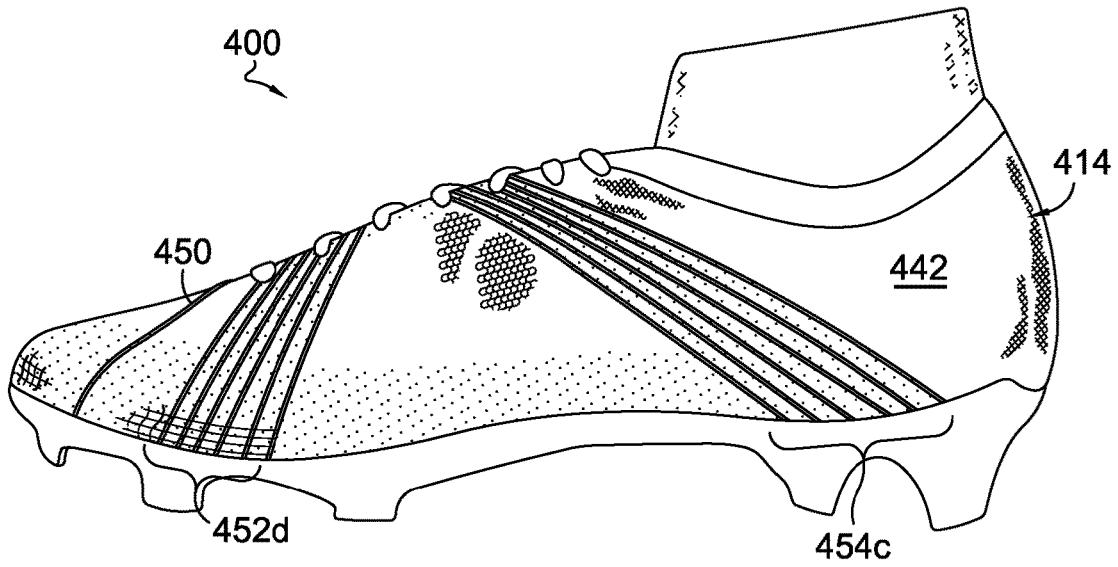
Figure 4C:
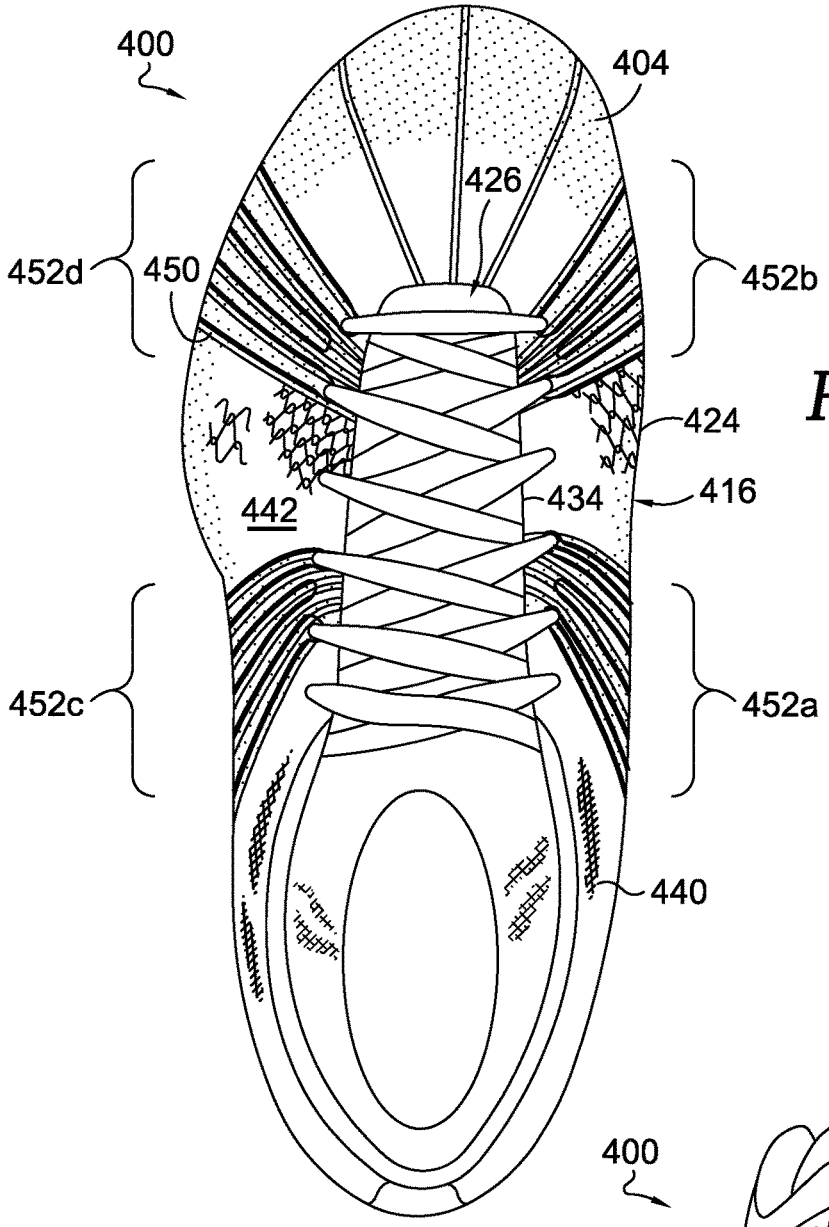
Figure 4D:
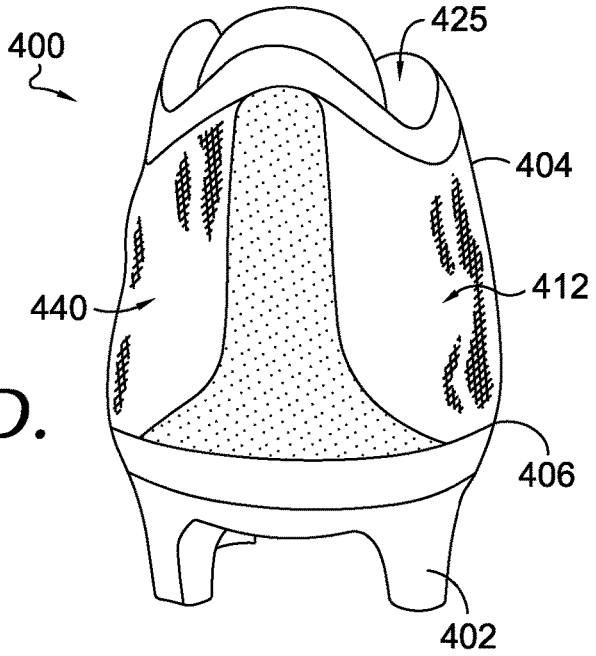

Some examples of the knitted component 440 may also include the fusible yarn or grip yarn knit on the exterior-facing surface 442 along the inner perimeter 434 in the throat region 426. Additionally, as shown in FIG. 4D, the fusible yarn or grip yarn may be knit along a central area in the heel region 412. For example, the upper 404 may include a heel seam where the lateral side 414 is secured to the medial side 416 in the heel region 412, and the fusible yarn or grip yarn may be knit in the exterior-facing surface 442 along the seam, from the bite-line 406 to an ankle opening 425 of the knitted component 440.

As previously stated, one or more additional yarns may be knit (interlooped) with the grip yarn such that the grip yarn and one or more additional yarns form the same courses within the knitted component 440. In various examples, the grip yarn may be knit on a first needle bed (e.g., a front needle bed) while a high-tenacity yarn with a greater melting or decomposition temperature than the grip yarn may be knit on the second needle bed (e.g., a back needle bed). In courses having the tensile elements 450, the tensile element 450 may be knit on the first needle bed with the grip yarn in some aspects or inlaid between the first and second needle beds in other aspects. In some aspects, the high-tenacity yarn knit on the second needle bed has a different material composition as tensile elements 450, but it is contemplated that the high-tenacity yarn knit on the second needle bed may have the same material composition as the tensile elements 450. In portions of the knitted component 440 without grip yarn on the exterior-facing surface 442, the grip yarn may be knit on the second needle bed to be included on the interior-facing surface of the knitted component 440 while the high-tenacity yarn may be knit on the first needle bed to be included on the exterior-facing surface 442.

Some aspects of footwear described herein may include a polymer layer applied to at least part of the exterior-facing surface of a knitted component after knitting. FIG. 5 depicts an example polymer layer 500, and FIG. 6 depicts an example article of footwear 600 with the polymer layer 500 of FIG. 5. A variety of structures may be used for the polymer layer 500, including a polymer film, a polymer mesh, a polymer powder, and non-woven textiles for example. With any of these structures, a variety of polymer materials may be used for the polymer layer 500, including polyurethane, polyester, polyester polyurethane, and/or nylon. Although polymer layer 500 may be formed form a thermoset polymer material, many configurations of the polymer layer 500 are formed from a thermoplastic polymer material (such as thermoplastic polyurethane) such that, the polymer layer 500 may melt when heated and return to a solid state when cooled. As such, the polymer layer 500 formed from a thermoplastic polymer material may be melted, molded, cooled, re-melted, remolded, and cooled again through multiple cycles. The polymer layer 500 formed from a thermoplastic polymer materials may also be welded or thermally bonded to a textile, such as a knitted component as further described below.

FIG. 6 depicts the polymer layer 500 applied to an article of footwear 600 that includes a sole structure 602 secured to an upper 604. The polymer layer 500 lays adjacent to at least part of the exterior-facing surface 642 of the knitted component 640 and is secured to the knitted component 640 to form part of the exterior surface of the upper 604. The knitted component 640 may be in the form of any of the knitted components disclosed herein, including any of the knitted components 140, 340, 440, 840 and 1040. The polymer layer 500 may extend continuously from a forefoot region 608, a midfoot region 610, and a heel region 612 of the article of footwear 600, e.g., covering any portion of each of such areas or all of such areas in different aspects. Further, the polymer layer 500 may extend continuously from a bite-line 606 between the upper 604 and the sole structure 602 to a throat region 626, or may extend a portion of the distance, in different aspects.

As depicted in FIGS. 5 and 6, the polymer layer 500 can include apertures 510 extending through the polymer layer 500 so as to expose underlying portions of the knitted component 640 when the polymer layer 500 is applied to the upper 604. In this way, the apertures 510 allow for certain properties of the knitted component 640 to be utilized when the polymer layer 500 is applied. For example, the exterior-facing surface 642 of the knitted component 640 may be formed at least partially with a grip yarn as described with respect to the knitted components 140 and 440, and areas of the exterior-facing surface 642 formed with the grip yarn may have a greater coefficient of friction compared to areas of the exterior-facing surface 642 without the grip yarn. The apertures 510 in the polymer layer 500 may be positioned to expose those areas with a higher coefficient of friction due to the grip yarn so that a wearer of the footwear 600 may utilize the grip yarn in the knitted component 640 to better grip a ball and have improved ball control. Apertures 510 in the polymer layer 500 may also increase breathability and flexibility of the upper 604.

In additional aspects, a polymer layer (e.g., similar to 500) may cover a different percentage of a knitted component forming part of an upper, e.g., at least 10%, at least 20%, at least 30%, at least 40%, at least 50%, at least 60%, at least 70%, at least 80%, or at least 90% of the knitted the knitted component's surface, e.g., across the entire knitted component, or across each region (e.g., forefoot, heel, medial, and/or lateral). In addition, while apertures 510 are depicted on the polymer layer 500 shown in FIG. 5, in any aspects herein that include a polymer layer, the apertures may be present, but may also be omitted partially or entirely such that grip yarns are instead exposed in areas around the polymer layer. In addition, in different aspects, the polymer layer may overlap edges of areas formed with grip yarns, e.g., that are heat-processed.

Looking still at FIG. 5, areas of the polymer layer 500 can have a varied distribution of apertures 510. For example, apertures 510 may be distributed in only the forefoot region 608 and a forward aspect of the midfoot region 610 while apertures may be absent in the heel region 612 and in posterior aspects of the midfoot region 610, as shown in FIGS. 5 and 6. In other words, a first area of the knitted component 640, which may be located in the forefoot region 608, may have a first surface area covered by the polymer layer 500 while a second area of the knitted component 640, which may be located in the midfoot region 610 and/or heel region 612, may have a surface area covered by the polymer layer 500 that is greater than the first surface area.

Concentrating the apertures 510 to the forward portions of the upper 604 enables access to the grip yarn areas where contact with a ball is most likely while maintaining increased abrasion-resistance, water-resistance, and stability in other areas. Further aspects of the polymer layer 500 may include a graphic design, and omitting apertures in areas of the polymer layer 500 that do not particularly benefit from exposure of the fusible grip material may enable more options for graphic design(s) on the polymer layer 500.

Further, apertures 510 in the polymer layer 500 may have different sizes (e.g., different diameters). For example, the polymer layer 500 includes larger apertures, like aperture 510*a*, positioned closer to the forward end 618 of the upper 604 and smaller apertures, like apertures 510*b*, positioned closer to the midfoot region 610 and/or the throat region 626. In this way, a greater surface area of the knitted component 640 may be exposed through the apertures 510 of the polymer layer 500 in the forefoot region 608 and/or near the forward end 618 of the upper 604 to expose the exterior-facing surface 642 with grip yarn knit, compared to more posterior aspects of the knitted component 640. In addition to or alternatively to varying the size of the apertures 510, the density of apertures 510 in the polymer layer 500 may be varied in different areas to expose more fusible grip material in some areas of the knitted component 640 compared to other areas.

Similarly, the shape of the polymer layer 500 (e.g., the shape of the perimeter of the polymer layer 500) may also be based on where it may be advantageous to create exposure of areas knit with a grip yarn that provides touch characteristics like a greater coefficient of friction. For example, some aspects of the polymer layer 500 may not extend continuously from the bite-line 606 to the throat region 626 in one or more areas of the upper 604. The polymer layer 500 in FIG. 6 extends in the forefoot region 608 from the bite-line 606 but does not fully extend to the forward end 628 of the throat region 626. Instead, the portion of the polymer layer 500 that is anterior to or forward of the throat region 626 extends only partially up the upper 604 from the bite-line 606. In some aspects, the polymer layer 500 may terminate about one-third of the distance from the bite-line 606 to the forward end 628 of the throat region 626, about half of the distance from the bite-line 606 to the forward end 628, or about two-thirds of the distance from the bite-line 606 to the forward end 628. In aspects in which the polymer layer 500 extends only partway up the upper 604 from the bite-line 606 in the forefoot region 608, additional surface area of the knitted component 640 is exposed and, therefore, may expose areas knit with grip yarn to retain touch properties.

Aspects of this disclosure may include methods for manufacturing an upper with a polymer layer, such as the upper 604 of FIG. 6. Doing so may include knitting the knitted component 640, which may include knitting a grip yarn on at least one needle bed so as to form a knitted component 640 with the grip yarn forming at least parts of the exterior-facing surface 642 of the knitted component 640. After the knitted component 640 is knit, the grip yarn on at least the exterior-facing surface 642 may be activated through heat and/or pressure such that the grip yarn at least partially melts and fuses with non-fusible portions of the grip yarn, a second yarn, and/or a tensile element as described with respect to the knitted components 140 and 440. In one example, a heat source, which be applied during through a steaming process, may heat the knitted component 640 to a temperature that is greater than the melting temperature of the grip yarn and less than the melting or decomposition temperature of the second yarn in the knitted component 640. After the grip yarn at least partially melts, the knitted component 640 may be cooled so that the melted fusible material of the grip yarn may solidify. Additionally, the knitted component 640 may be held on a jig, which may include application of tension to the knitted component 640, e.g., from spaced-apart pins extended through apertures in the knitted component 640, during heating and cooling of the knitted component 640.

After activation of the grip yarn in the knitted component 640, the polymer layer 500 may be secured to the knitted component 640. This process may be performed by overlying the knitted component 640 with the polymer layer 500 in between portions of a heat press that compress and heat the knitted component 640 and polymer layer 500 to bond them together. In examples of the article of footwear 600, the polymer layer 500 may have a polymer composition (formed by one or more polymer materials) that has a melting temperature that is less than the melting temperature of the fusible material in the grip yarn of the knitted component 640. Additionally, the polymer layer 500 overlaying the knitted component 640 may be heated to a temperature that is greater than the melting temperature of the polymer layer 500 but less than the melting temperature of the grip yarn. In this way, the fusible polymeric composition from the grip yarn in the knitted component 640 will not be reactivated again (e.g., re-melted) when the polymer layer 500 is bonded to the knitted component 640. After the polymer layer 500 is bonded to the knitted component 640, the polymer layer 500 and knitted component 640 may be formed into the shape of the upper 604 and secured to the sole structure 602.

Figure 7:
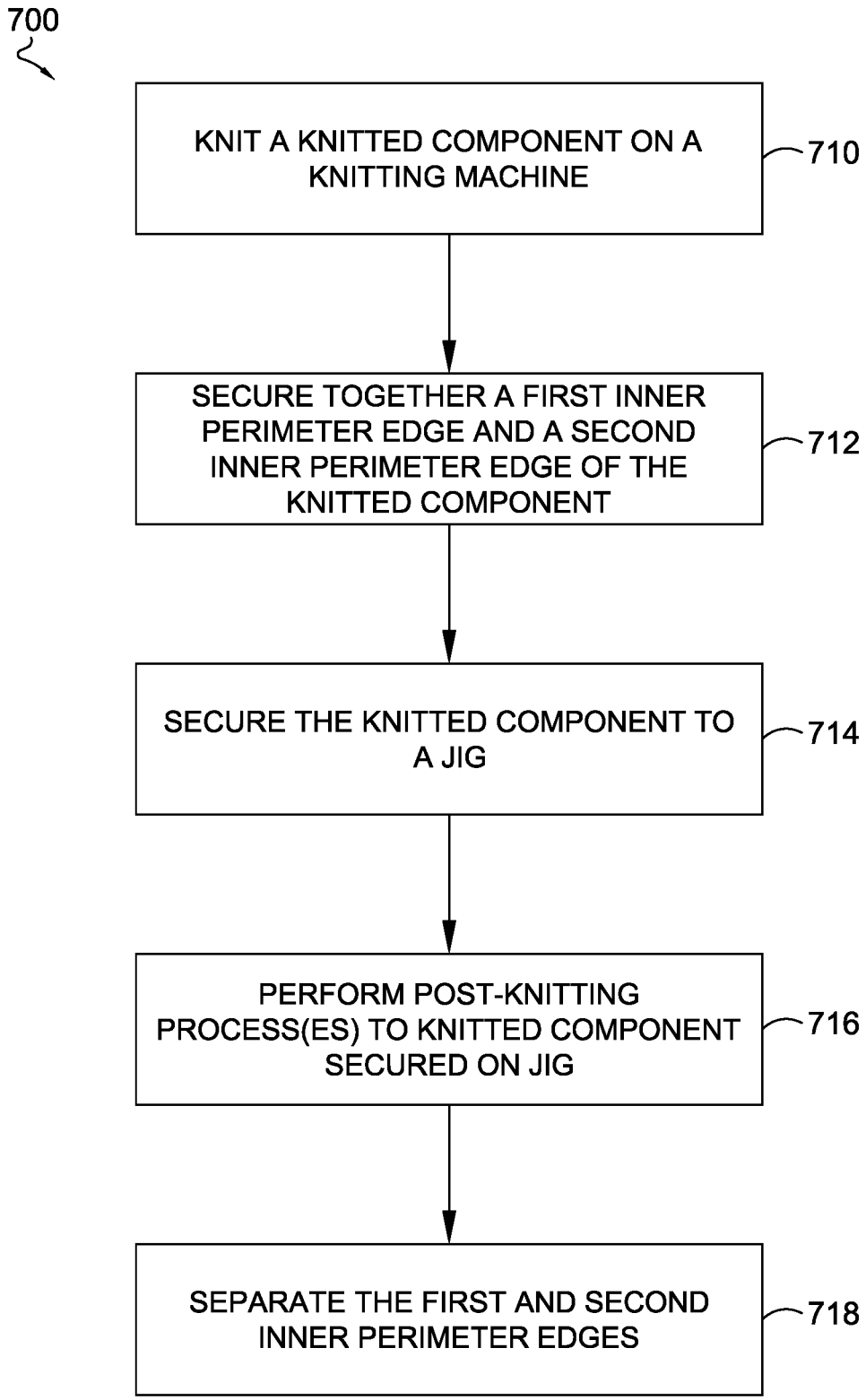
FIG. 7 depicts a block diagram of a method of manufacturing an upper for an article of footwear, in accordance with aspects hereof.
Figure 8:
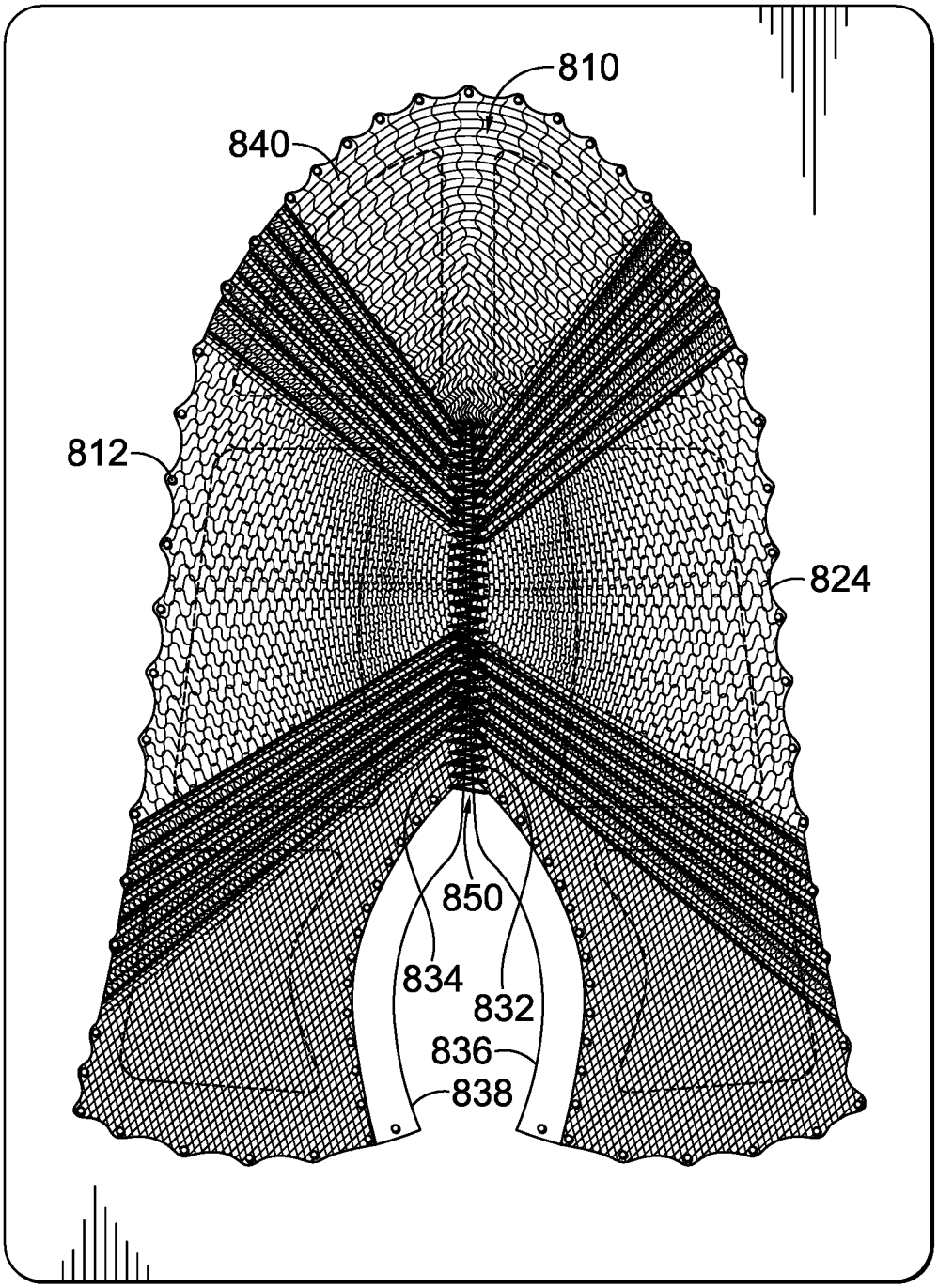
FIG. 8 depicts a knitted component on a jig for manufacturing an upper according to the elements of FIG. 7, in accordance with aspects hereof.

Additional aspects of this disclosure include processes for manufacturing an upper and/or a knitted component for an upper. Particularly, some aspects include steps in manufacturing that reduce scallops on edges of the knitted component without adding additional components to create straight edges. FIG. 7, for example, illustrates a flow diagram depicting an example method 700 of manufacturing an upper for an article of footwear, which may include the upper 104, upper 404, or the upper 604. The steps provided in method 700 are merely illustrative, and method 700 may include additional steps that are not illustrated. FIG. 8 depicts one example knitted component 840 during the method 700 and reference may be made to FIG. 8 to illustrate steps of method 700.

At step 710, a knitted component is knit on a knitting machine. Step 710 may be performed by an automated knitting machine and as such, may be performed and/or controlled using a control unit having a processor or computer communicatively coupled with or integrated into the knitting machine. In example aspects, the knitting machine used to knit the knitted component is a V-bed flat knitting machine having two needle beds—a front needle bed and a back needle bed—that are angled relative to each other to form a V-bed. The front and back needle beds may each include a plurality of individual needles extending across a common plane. A carriage may move feeders, such as standard and/or combination feeders, along the front and back needle beds to supply yarns to needles. Generally, standard feeders and combination feeders both supply yarn for needles to knit, tuck, and/or float, while combination feeders may also supply yarn to inlay through or between knitted structures. Although a flat V-bed knitting machine is described herein, it should be understood that this is one example and that other knitting machines may be used to form the knitted component or a portion thereof.

Further, step 710 may include radially knitting the knitted component on a knitting machine. Radial knitting may be performed as described with the knitted component 340 of FIG. 3. Additionally, step 710 may include incorporating tensile elements, similar to the tensile elements 150 and/or tensile elements 450, into the knit structure of the knitted component. In some example aspects, the tensile elements are inlaid without loops by a combination feeder of the knitting machine and are inlaid between loops formed on the front and/or back beds of the knitting machine. In other examples, the tensile elements may be incorporated by forming a repeating sequence of loop stitches and float stitches with the tensile element along a course as described further with respect to FIG. 9. Additionally, embodiments of step 710 may include knitting the knitted component with any of the yarn types described with respect to the knitted components 140, 440, or 640, and having any of the configurations of the knitted components 140, 540, or 640.

The knitted component formed at step 710 may include a first inner perimeter edge and a second inner perimeter edge.

The first and second inner perimeter edges may be in a throat region. For example, the first inner perimeter edge may be a medial edge of the knitted component in the throat region, and the second inner perimeter edge may be a lateral edge of the knitted component in the throat region. As such, the first and second inner perimeter edges may extend generally parallel to one another.

At step 712, the first inner perimeter edge and the second inner perimeter edges are secured together. In example aspects, the first and second inner perimeter edges are secured together via stitching. For example, FIG. 8 depicts a knitted component 840 on a jig 810 with a first inner perimeter edge 832 and a second inner perimeter edge 834 stitched together to create a seam 850. Note that because the knitted component 840 is on top of the jig 810, the outline of the jig 810 is only seen through the knitted component 840 in FIG. 8.

At step 714, the knitted component is secured to a jig using pins along a portion of a perimeter of the knitted component. For example, pins may be placed along an outer perimeter of the knitted component. Additionally, in some aspects, pins may be placed along a fourth inner perimeter edge and a fifth inner perimeter edge, which are unsecured to one another and may collectively form the ankle opening of the upper once the upper is formed from the knitted component. The first and second inner perimeter edges 832, 834 are not directly pinned to the jig. For example, in FIG. 8, the knitted component 840 is secured to the jig 810 via pins 812 along the outer perimeter 824 of the knitted component 840 and along a third inner perimeter edge 836 and a fourth inner perimeter edge 838.

At step 716, one or more post-knitting processes may be performed on the knitted component while the knitted component is secured to the jig. For example, heat may be applied (e.g., through steaming) to at least partially melt or soften fusible material knit into the knitted component as described with respect to the knitted components 140, 440, and/or 640. Additionally, or alternatively, a separate polymer layer, such as the polymer layer 500 or another similar polymer layer of some size, may be secured (e.g., thermally bonded) to the knitted component while the knitted component is on the jig. Further, the knitted component may cool to solidify thermal bonds while still secured on the jig.

At step 718, following post-knitting processes while the knitted component is secured to the jig, the first and second inner perimeter edges 832, 834 are separated. For example, the stitching between the first and second inner perimeter edges 832, 834 may be removed. Step 718 may be performed by die cutting the knitted component so to cut the seam formed between the first and second inner perimeter edges 832, 834 and, in some aspects, also cut eyelets for laces into the knitted component. This step may be performed while the knitted component is still on the jig or after removing the knitted component from the jig.

Further, aspects of method 700 may also include forming the knitted component into the shape of an upper, which may be performed using a last. Additionally, the upper may be secured to one or more sole structures, such as a strobel, midsole and/or outsole.

Forming an upper from a knitted component in accordance with method 700 can help to ensure clean, straight lines along the throat region. Specifically, stitching the first inner perimeter edge and the second inner perimeter edge in the throat region together prior to securing the knitted component on the jig and application of the post-knitting heat processes removes scallops or curves that may naturally be formed along the first and second inner perimeter edges during the knitting process. When the scallops are not removed prior to heating the knitted component, the heating process may cause the scallop or curvy shape of the edges to be maintained through melting and cooling of fusible yarns and/or application of a polymer (skin) layer. While the scallops may be removed from the edges when the knitted component is pinned to the jig, it would typically require many pins along the first and second inner perimeter edges to effectively remove the scallops, and the use of additional pins adds manufacturing time. Particularly, the time to pin the first and second perimeter edges enough to remove the scallops is greater than the time to stitch the first and second perimeter edges.

Further embodiments of this disclosure relate to a knit structure and knitting method that simulates inlaid tensile elements. Particularly, tensile elements, such as tensile elements 150 and 450 as described herein, may be inlayed into a knit structure such that the tensile elements are floated and/or woven between loops formed by other yarn while the tensile elements are not, themselves, interlooped within the courses. An alternative structure may be knitting in the tensile element into the knit structure in a manner that simulates the strength that may be provided through inlaid tensile elements.

In some aspects of the knitted components, uppers, and articles of footwear discussed herein, a knitted component or portion thereof may include a stretch-lining, e.g., one that is floated, to impart stretch characteristics. In one aspect, the stretch-lining can be located and/or floated along an inner-facing surface of the knitted component.

In addition, in some aspects of the knitted components, uppers, and articles of footwear discussed herein, grip yarns can be located at different areas of an inner-facing surface and/or an outer-facing surface of the knitted component, e.g., being included along a forefoot region, e.g., in a toe area, and/or along a vamp.

In addition, in some aspects of knitted components, uppers, and articles of footwear discussed herein, the forefoot region, e.g., toe and/or vamp, can include yarns and/or textiles (e.g., polyester, nylon) with limited or substantially no stretch characteristics for greater reinforcement, durability, and abrasion-resistance and/or wear-resistance. This can be used in combination with other aspects described herein.

Figure 9:
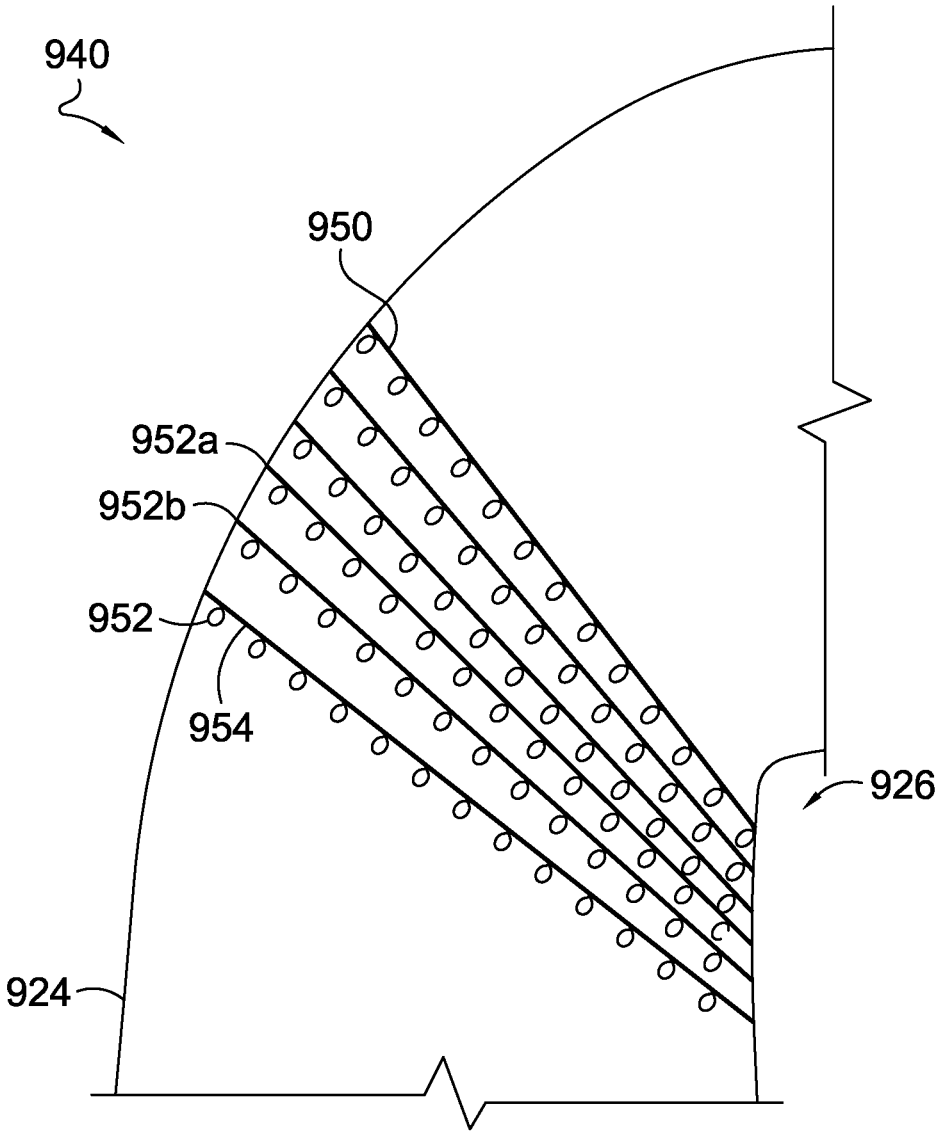
FIG. 9 depicts a close-up view of a portion of an article of footwear with mock inlay structures, in accordance with aspects hereof.

FIG. 9 shows a close-up view of a portion of an example knitted component 940 with tensile elements 950 with a mock or simulated inlaid structure. Particularly, each course of the tensile element 950 includes a sequence of knit stitches 952 (e.g., knitted loops) and float stitches 954, where the sequence is repeated along the length of the course. In example aspects, the sequence includes one knit stitch and a float stitch extending across a plurality of wales. The number of wales that the float stitch extends across may correspond to the number of needles along a needle bed that the tensile element is floated in between two knit stitches. The number of wales that each float stitch extends may be within a range 3 to 8, within a range of 4 to 7, and within a range of 5 to 6. In one example, each float stitch of the tensile element extends across 5 wales. As such, the tensile element may be knit using a knit sequence of one knit stitch formed on one needle and one float stitch extending across five needles.

The incorporation of the many float stitches along the course by the tensile element may help to simulate strength and stretch-resistance imparted when inlaying the tensile elements into the knit structure. However, knitting the tensile elements with occasional knit stitches (loops) may help to keep the tensile elements extend in straighter or cleaner lines along the course. Further, incorporating the tensile elements with knit stitches and floats instead of inlays may be performed with a combination feeder or with a regular feeder on a knitting machine. In this way, this knitting technique provides more flexibility in what knitting machines may be used to form the knitted component 940 and/or how a particular knitting machine is used.

In some aspects, the location of the knit stitch in adjacent courses of the tensile elements 950 may be offset such that they occur at different needle positions. For example, where the knit stitches in the course of tensile element 950*a* is at needle positions 2, 8, 14, the knit stitches in the course of the adjacent tensile element 950*b* may be at 3, 9, 15.

For simplicity, only the tensile elements 950 following the simulated inlaid structure are schematically depicted in FIG. 9, but it should be understood that the courses in the knitted component may include additional yarns knit with the tensile elements 950. For example, the tensile elements 950 may be knit on a first needle bed with another yarn knit on the first needle bed using a different stitch sequence. This other yarn (referred to herein as a first yarn) on the first needle bed may be a fusible yarn (including a grip yarn) as described through this disclosure, a high-tenacity yarn, a mono-filament yarn or a yarn with a combination of these features. The first yarn may be knit using knit stitches or a combination of knit stitches and tuck stitches. In some aspects, the first yarn is looped on a number of consecutive needles on the first needle bed, then tucks on a needle on the second needle bed, and continues to be looped on needles on the first needle bed. The tuck stitch of the first yarn to the second needle bed may help to keep in place the float of the tensile element 950. In some courses, the first yarn may just be knit on the first needle bed without tucking on the second needle bed.

In some aspects, the knitted component 940 is also formed with a second yarn knit on the second needle bed. This second yarn may be knit using knit stitches and/or tucks stitches. In some aspects, the second yarn is knit on the second needle bed at the needle positions in which the first yarn is knit on the first needle bed and switches to being knit on the first needle bed when the first yarn switches to being knit on the second needle bed. Examples of the second yarn may include a fusible yarn (including a grip yarn) as described through this disclosure, a high-tenacity yarn, a mono-filament yarn or a yarn with a combination of these features. In one embodiment, the first yarn is a grip yarn, while the second yarn is a high-tenacity yarn with a higher melting or decomposition temperature than at least the fusible material on the first yarn.

The knitted component 940 of FIG. 9 is radially knit such that the tensile elements 950 extend radially along the courses from the outer perimeter 924 to a common portion, such as the throat region 926. However, it should be understood that the same knit sequence of the tensile elements 950 may be applied in a non-radially knit knitted component, such as where the courses of the tensile elements extend parallel to one another (e.g., such as extending parallel along a medial-to-lateral axis) without converging towards a common portion.

Figure 10:
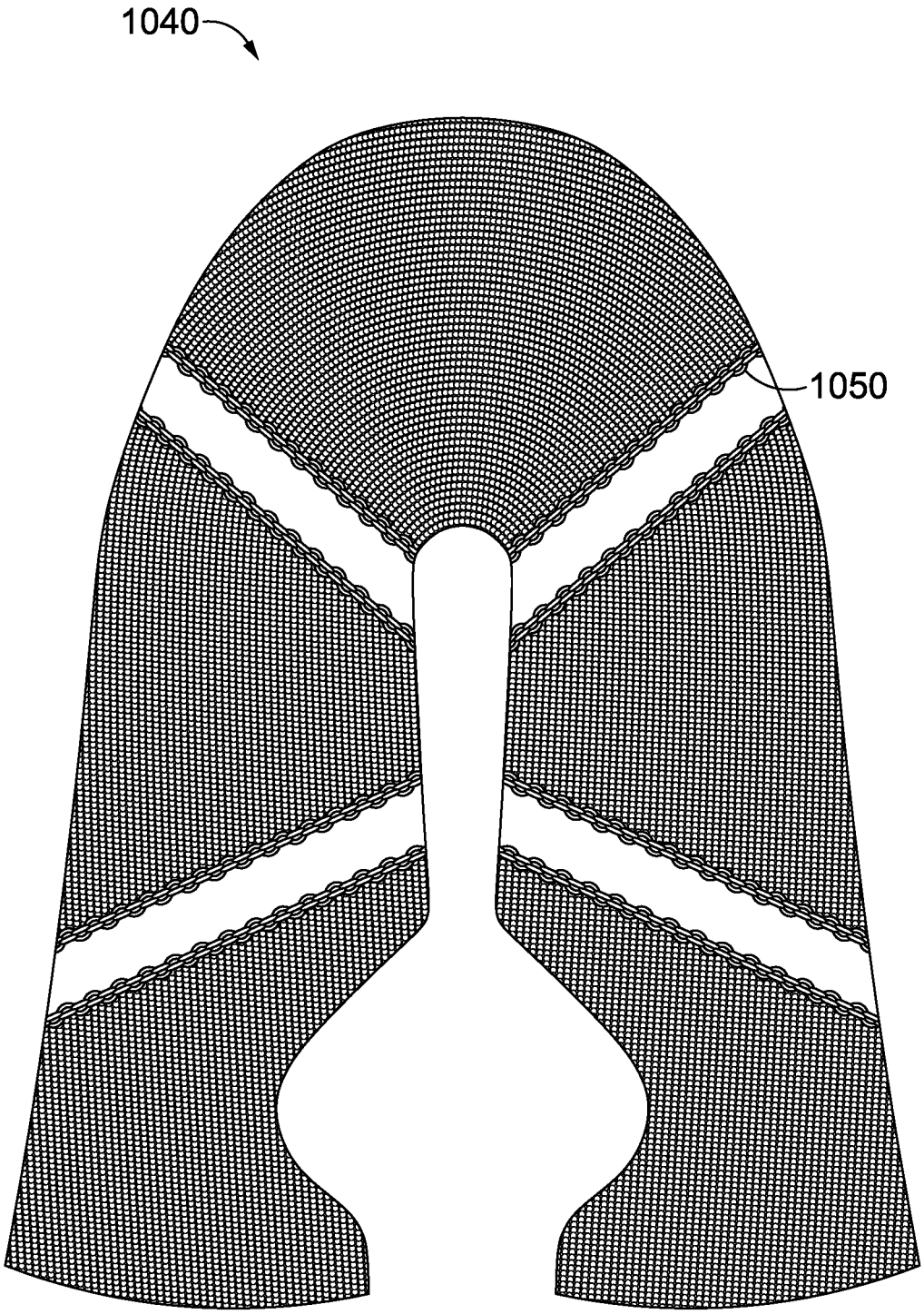
FIG. 10 depicts an example knitted component for an article of footwear, in accordance with aspects hereof.

FIG. 10 depicts another example knitted component 1040 having tensile elements 1050, in accordance with aspects hereof. The knitted component 1040 may be used to form an upper for an article of footwear, such as footwear 100 or footwear 400. The knitted component 1040 which may have any of the features described with other knitted opponents disclosed herein, including the knitted components 140, 340, 440, 640, and 840, and 940, except as indicated below with respect to the tensile elements 1050.

The tensile elements 1050 in the knitted component 1040 may be formed with a cable, such as a braided cable, or a strand with a cross-section having a substantially greater diameter than the cross-sections of other strands forming the knitted component 1040. Additionally, the tensile element 1050 having this structure may be incorporated into the knitted structure through knitting (e.g., interlooping the tensile element 150 with loops of an adjacent course) rather than inlaying between interlooped courses of other yarn(s) without forming loops. For example, the tensile elements 1050 may be knit according to the knit sequence of tensile elements 950 in FIG. 9. As a result, the tensile elements 1050 may form raised structures extending away from a foot-receiving void when the knitted component 1040 is formed into an upper. The raised tensile elements 1050 may create more spin when the raised tensile elements 1050 are in contact with a ball, such as a global football, when the knitted component 1040 is worn on an upper. In some aspects, a polymer layer (e.g., skin) that may include aspects of the polymer layer 500 described with respect to FIGS. 5 and 6, may be applied to the knitted component 1040 and applied over at least part of the raised tensile elements 1050.

Additional Example Properties of the Grip Yarn

As discussed above, knitted components disclosed herein may include the selective incorporation of yarns (referred to above as a grip yarn) as described alone or in combination with other materials (e.g., second yarns or tensile elements that do not fall under the fibers, filaments, and yarns described herein as grip yarn). In certain aspects, the yarns and/or fibers described herein may be used to provide a specific functionality. For example in certain aspects, fiber or yarn as described herein may be fused to form a surface or at least a re-flowed area having water-proof or water-resistant properties, containment properties, particular traction properties, "ball touch" properties, and providing a higher coefficient of friction. In addition to the materials and properties of the grip yarn disclosed above, the following properties may be found in examples of the grip yarn.

In one aspect, a grip yarn, described herein has a break strength of from about 0.6 to about 0.9 kilograms of applied force, or of from about 0.7 to about 0.9 kilograms of applied force, or of about 0.8 to about 0.9 kilograms of applied force, or greater than 0.9 kilograms of applied force.

The grip yarn comprises or consists essentially of a grip material. The grip material is a thermoplastic material which is elastomeric, as the grip material comprises or consists essentially of one or more thermoplastic elastomers. In some aspects, the grip material has a melting temperature that is less than 115 degrees Celsius, less than 110 degrees Celsius, or less than 100 degrees Celsius.

A grip yarn comprising or consisting essentially of the grip material is understood to include a coating of the grip material, or to include one or more grip fibers where each of the individual grip fibers comprises the grip material, or to include both a grip material coating and grip fibers. The grip fibers of the grip yarn can comprise a plurality of short grip fibers, or can comprise a plurality of long grip filaments, or can comprise a single long grip filament (i.e., a mono-filament), or can comprise a combination of short grip fibers and one or more long filaments. Similarly, the grip yarn can comprise a single grip filament, or can comprise a plurality of grip fibers or grip filaments, or can comprise one or more core yarns. When the grip yarn comprises one or more core yarns, each of the one or more core yarns individually may be at least partially coated with the grip material. Alternatively, when the grip yarn comprises one or more core yarns, the one or more core yarns may form a twisted yarn, and the twisted yarn may be at least partially coated with the grip material.

In one aspect, when the grip yarn consists essentially of grip fibers, 95 weight percent or more of the fibers present in the grip yarn are grip fibers. In other aspects, when the grip yarn comprises two or more types of fibers, at least one of the two or more types of fibers are the grip fibers. When the grip yarn comprises two or more types of fibers, the grip fibers may make up at least 10 weight percent, or at least 25 weight percent, or at least 50 weight percent, or at least 75 weight percent of the fibers present in the grip yarn.

In one aspect, the grip yarn includes a core coated by the grip material. The grip yarn core comprises a core material, where the core material comprises a different type of polymer and/or has different properties than the grip material. The core material can be a polymeric material comprising one or more polymers, or can comprise a non-polymeric material. When the core material is polymeric, the polymers present in the core material may be different types of polymers than those present in the grip material. For example, the core material may comprise one or more polyester homopolymers or polyamide homopolymers, while the grip material may be essentially free of polyester homopolymers or polyamide homopolymers. When the core material is a thermoplastic material, the core material may have a higher deflection or melting temperature than the grip material. When the core material is a non-polymeric or a thermoset material, the core material may have a degradation temperature which is higher than the melting temperature of the grip material. The core material may be inelastic or less elastic (e.g., have a lower percent elongation) than the grip material.

In one aspect, the core of the grip yarn comprises one or more fibers. In this aspect, the grip material may fully or partially coat the core. The one or more core fibers can be a plurality of short fibers, such as a plurality of staple-length fibers spun into a single yarn, or a plurality of staple-length fibers spun into two or more yarns, where the two or more yarns are twisted together. The one or more core fibers can be a plurality of long filaments. The plurality of long filaments can be aligned, or can be aligned and entangled. The one or more core fibers can be a single long monofilament.

In one aspect, the grip yarn is a coated yarn, wherein a core yarn comprises a second polymeric composition as a core material and a coating layer disposed on the core yarn, the coating layer comprising the first polymeric composition as a grip material, wherein the first polymeric composition has a grip material melting temperature. In one aspect, the core material is a thermoplastic and has a deformation temperature that is at least 20 degrees Celsius greater, at least 50 degrees Celsius greater, at least 75 degrees Celsius greater, or at least 100 degrees Celsius greater than the grip melting temperature of the first polymeric composition. The grip material comprises or consists essentially of one or more thermoplastic elastomers. Optionally, in addition to comprising the one or more thermoplastic elastomers, the grip material can further comprise one or more additional polymers, or one or more additional non-polymeric additives, or can comprise both. The one or more thermoplastic elastomers of the grip material may include one or more thermoplastic polyurethane (TPU) elastomers, or one or more thermoplastic styrene elastomers, or a combination of both. In some aspect, the one or more thermoplastic elastomers is two or more thermoplastic elastomers, such as, for example, two or more TPU elastomers, or two or more styrene elastomers, or a combination of two TPU elastomers and an styrene elastomer, or a combination of two styrene elastomers and a TPU elastomer.

As used herein, a polymeric composition (such as the grip composition or a core composition) is understood to includes a polymeric component consisting of all the polymers present in the polymeric composition. The polymeric component can consist of a single polymer, or can consist of two or more polymers. In one aspect, the polymeric component consists of one or more polymers of a single type. For example, the polymeric component of the core material can consist of one or more polyesters, or one or more polyethers, or one or more polyamides, or one or more polyurethanes, or one or more polyolefins. The polymeric component of the core material can consist of one or more polyesters. The polymeric component of the core material can consist polyethylene terephthalate (PET). The polymeric component of the grip material can consist of one or more one or more TPU elastomers, or one or more styrene elastomers. The polymeric component of the grip material can consist of one or more polyester-polyurethane elastomers. The polymeric component of the grip material can consist of one or more styrene-butadiene-styrene (SBS) elastomers.

The core material of the core fibers or core yarn may be any material which retains its strength at the temperature at which the grip material is applied to the core fibers or core yarn. The core fibers which are coated with the grip material, and/or the fibers used to form the core yarn, may be natural fibers or regenerated fibers or filaments, or synthetic fibers or filaments. In one aspect, the core fibers or core yarn comprises or consists essentially of natural or regenerated materials such as cotton, silk, wool, or rayon, which are not thermoplastic, and so which have degradation temperatures but not melting or deformation temperatures. In another aspect, the core material of the core fibers or core yarn comprises or consists essentially of one or more synthetic thermosets, such as thermoset polyurethanes or thermoset polyureas, which also have degradation temperatures but not melting or deformation temperatures. In yet another aspect, the core material of the core fibers or core yarn comprises or consists essentially of one or more synthetic thermoplastics such as polyesters, polyamides, polyurethanes, polyolefin, copolymers thereof, and mixtures thereof. In one aspect, the core material comprises or consists essentially of one or more polyesters, or one or more polyamides. In one example, the one or more polyesters comprises or consists essentially of polyethylene terephthalate (PET). In one aspect, the core material is a thermoplastic material, and has a deformation temperature greater than 200 degrees Celsius, or greater than 220 degrees Celsius, or greater than 240 degrees Celsius, or from about 200 degrees Celsius to about 300 degrees Celsius.

In one aspect, the core yarn has a linear density of about 100 denier to about 300 denier, or of about 100 to about 250 denier, or about 100 to about 200 denier, or about 100 to 150 denier, or about 150 to 300 denier, or about 200 to 300 denier, or about 250 to 300 denier. In one aspect, the core yarn has a thickness of about 60 microns to 200 microns, about 60 to 160 microns, about 60 to 120 microns, about 60 to 100 microns, about 100 to 200 microns, or about 140 to 200 microns. The core yarn can include or consist essentially of one or more natural or regenerated fibers. The core yarn can include or consist essentially of a core material comprising one or more synthetic polymers. The one or more synthetic polymers can include polyamides, polyesters, polyethers, polyurethanes, polyolefins, and combinations thereof. The one or more polyurethanes can include or consist essentially of polyurethane terephthalate (PET). The core yarn or the core material or both can have a degradation or deformation temperature at least 20 degrees Celsius greater, at least 50 degrees Celsius greater, at least 75 degrees Celsius greater, or at least 100 degrees Celsius greater than the melting temperature of the grip material. The core yarn or the core yarn material or both can have a degradation or deformation temperature greater than 200 degrees Celsius, greater than 220 degrees Celsius, greater than 240 degrees Celsius, or between about 200 degrees Celsius to about 300 degrees Celsius.

In one aspect, the core yarn has a thickness of about 100 denier to about 200 denier, about 125 denier to about 175 denier, or about 150 denier to 160 denier. In one aspect, the core yarn has a percent elongation of about 20 percent to about 30 percent, about 22 percent to about 30 percent, about 24 percent to about 30 percent, about 20 percent to about 28 percent, or about 20 percent to about 26 percent. In one aspect, the core yarn has a tenacity of about 1 gram per denier to about 10 grams per denier, about 3 grams to about 10 grams per denier, about 5 grams to about 10 grams per denier, about 1 gram to about 7 grams per denier, or about 1 gram to about 5 grams per denier. The core yarn can include or consist essentially of one or more natural or regenerated fibers. The core yarn can include or consist essentially of a core material comprising one or more synthetic polymers. The one or more synthetic polymers can include polyamides, polyesters, polyethers, polyurethanes, polyolefins, and combinations thereof. The one or more polyurethanes can include or consist essentially of polyurethane terephthalate (PET). The core yarn or the core material or both can have a degradation or deformation temperature at least 20 degrees Celsius greater, at least 50 degrees Celsius greater, at least 75 degrees Celsius greater, or at least 100 degrees Celsius greater than the melting temperature of the grip material. The core yarn or the core yarn material or both can have a degradation or deformation temperature greater than 200 degrees Celsius, greater than 220 degrees Celsius, greater than 240 degrees Celsius, or between about 200 degrees Celsius to about 300 degrees Celsius.

In one aspect, the grip yarn may be produced by extruding the coating (e.g., the first polymeric composition as the coating material) onto the core yarn through an annular die or orifice such that the coating layer is axially centered surrounding the core yarn. The thickness of the coating applied to the core yarn may vary depending upon the application of the yarn. In one aspect, the grip yarn has a nominal average outer diameter of up to 1.00 millimeter, or of up to about 0.75 millimeters, or of up to about 0.5 millimeters, or of up to about 0.25 millimeters, or of up to about 0.2 millimeters, or of up to about 0.1 millimeters. In another aspect, the coating has a nominal average outer diameter of about 0.1 millimeters to about 1.00 millimeter, or about 0.1 millimeters to about 0.80 millimeters, or about 0.1 millimeters to about 0.60 millimeters. In another aspect, the coating on the yarn has an average radial coating thickness of about 50 micrometers to about 200 micrometers, or about 50 micrometers to about 150 micrometers, or about 50 micrometers to about 125 micrometers. The core yarn can include or consist essentially of one or more natural or regenerated fibers. The core yarn can include or consist essentially of a core material comprising one or more synthetic polymers. The one or more synthetic polymers can include polyamides, polyesters, polyethers, polyurethanes, polyolefins, or any combinations thereof. The one or more polyurethanes can include or consist essentially of polyurethane terephthalate (PET). The core yarn or the core material or both can have a degradation or deformation temperature at least 20 degrees Celsius greater, at least 50 degrees Celsius greater, at least 75 degrees Celsius greater, or at least 100 degrees Celsius greater than the melting temperature of the grip material. The core yarn or the core yarn material or both can have a degradation or deformation temperature greater than 200 degrees Celsius, greater than 220 degrees Celsius, greater than 240 degrees Celsius, or between about 200 degrees Celsius to about 300 degrees Celsius.

In one aspect, the core yarn has a thickness of about 100 denier to about 200 denier, about 125 denier to about 175 denier, or about 150 denier to 160 denier, and the coating has a nominal average outer diameter of about 0.10 millimeters to about 0.50 millimeters, or of about 0.10 millimeters to about 0.25 millimeters, or of about 0.10 millimeters to about 0.20 millimeters. In one aspect, the core yarn has a thickness of about 100 denier to about 200 denier, about 125 denier to about 175 denier, or about 150 denier to about 160 denier, and the coating has a nominal average outer diameter of about 0.10 millimeters to about 0.50 millimeters, or of about 0.10 millimeters to about 0.25 millimeters, or of about 0.10 millimeters to about 0.20 millimeters. The core yarn can include or consist essentially of one or more natural or regenerated fibers. The core yarn can include or consist essentially of a core material comprising one or more synthetic polymers. The one or more synthetic polymers can include polyamides, polyesters, polyethers, polyurethanes, polyolefins, and combinations thereof. The one or more polyurethanes can include or consist essentially of polyurethane terephthalate (PET). The core yarn or the core material or both can have a degradation or deformation temperature at least 20 degrees Celsius greater, at least 50 degrees Celsius greater, at least 75 degrees Celsius greater, or at least 100 degrees Celsius greater than the melting temperature of the grip material. The core yarn or the core yarn material or both can have a degradation or deformation temperature greater than 200 degrees Celsius, greater than 220 degrees Celsius, greater than 240 degrees Celsius, or between about 200 degrees Celsius to about 300 degrees Celsius.

In a further aspect, the grip yarn has a net total diameter of from about 0.2 to about 0.6 millimeters, or about 0.3 to about 0.5 millimeters, or about 0.4 to about 0.6 millimeters In some aspects, a lubricating oil including, but not limited to, mineral oil or silicone oil is present on the yarn at from about 0.5 percent to about 2 percent by weight, or from about 0.5 percent to about 1.5 percent by weight, or from about 0.5 percent to about 1 percent by weight. In some aspects, lubricating compositions are applied to the surface of the fusible grip yarn before or during the process of forming the textile. In some aspects, the thermoplastic composition and the lubricating composition are miscible when the thermoplastic composition is reflowed and re-solidified in the presence of the lubricating composition. Following reflowing and re-solidification, the reflowed and solidified composition may comprise the lubricating composition.

In a further aspect, the grip yarn has a net total diameter of from 0.2 to 0.6 millimeters, or 0.3 to 0.5 millimeters, or 0.4 to 0.6 millimeters.

In some aspects, a lubricating oil including, but not limited to, mineral oil or silicone oil is present on the yarn at from about 0.5 percent to about 2 percent by weight, or from about 0.5 percent to about 1.5 percent by weight, or from about 0.5 percent to about 1 percent by weight. In some aspects, lubricating compositions are applied to the surface of the grip yarn before or during the process of forming the textile. In some aspects, the thermoplastic composition and the lubricating composition are miscible when the thermoplastic composition is re-flowed and re-solidified in the presence of the lubricating composition. Following reflowing and re-solidification, the re-flowed and solidified composition may comprise the lubricating composition.

In one aspect, the core yarn has a percent elongation of about 8 percent to about 30 percent, about 10 percent to about 30 percent, about 15 percent to about 30 percent, about 20 percent to about 30 percent, about 10 percent to about 25 percent, or about 10 percent to about 20 percent. In one aspect, the core yarn has a tenacity of about 1 gram per denier to about 10 grams per denier, about 2 grams per denier to about 8 grams per denier, about 4 grams per denier to about 8 grams per denier, or about 2 grams per denier to about 6 grams per denier. The core yarn can include or consist essentially of one or more natural or regenerated fibers. The core yarn can include or consist essentially of a core material comprising one or more synthetic polymers. The one or more synthetic polymers can include polyamides, polyesters, polyethers, polyurethanes, polyolefins, or any combinations thereof. The one or more polyurethanes can include or consist essentially of polyurethane terephthalate (PET). The core yarn or the core material or both can have a degradation or deformation temperature at least 20 degrees Celsius greater, at least 50 degrees Celsius greater, at least 75 degrees Celsius greater, or at least 100 degrees Celsius greater than the melting temperature of the grip material. The core yarn or the core yarn material or both can have a degradation or deformation temperature greater than 200 degrees Celsius, greater than 220 degrees Celsius, greater than 240 degrees Celsius, or between about 200 degrees Celsius to about 300 degrees Celsius.

In one aspect, a grip material has a melting temperature from about 100 degrees Celsius to about 210 degrees Celsius, optionally from about 110 degrees Celsius to about 195 degrees Celsius, from about 120 degrees Celsius to about 180 degrees Celsius, or from about 120 degrees Celsius to about 170 degrees Celsius. In another aspect, the grip material has a melting temperature greater than about 120 degrees Celsius and less than about 170 degrees Celsius, and optionally greater than about 130 degrees Celsius, and less than about 160 degrees Celsius.

In a further aspect, when the melting temperature of the grip material is greater than 100 degrees Celsius, the integrity of articles formed from or incorporating the coating material is preserved if the articles briefly encounter relatively high temperatures, for example, during shipping or storage. In another aspect, when the melting temperature of the grip material is greater than 100 degrees Celsius, or greater than 120 degrees Celsius, articles formed from or incorporating the first polymeric composition as the grip material may be steamed without melting or unintentionally fusing any higher-melting temperature (e.g., polyester) components incorporated in the articles for purposes such as fill, zonal surface, or comfort features, as well as yarn used for snugness and fit feature.

In one aspect, when the melting temperature of the grip material is greater than 120 degrees Celsius, items incorporating materials with higher deformation or melting temperatures (e.g., the first or second polymeric composition) are unlikely to soften and/or become tacky during use on a hot paved surface, a court surface, an artificial or natural football pitch, or a similar playing surface, track, or field. In one aspect, the higher the melting temperature of the first or second polymeric composition and the greater its enthalpy of melting, the greater the ability of an article of footwear or athletic equipment incorporating or constructed from the first or second polymeric composition to withstand contact heating excursions, frictional surface heating events, or environmental heating excursions. In one aspect, such heat excursions may arise when the articles contact hot ground, court, or turf surfaces, or from frictional heating that comes from rubbing or abrasion when the articles contact another surface such as the ground, another shoe, a ball, or the like.

In another aspect, when the melting temperature of the grip material is less than about 210 degrees Celsius, or less than 200 degrees Celsius, or less than 190 degrees Celsius, or less than 180 degrees Celsius, or less than 175 degrees Celsius, but greater than 120 degrees Celsius, or greater than 110 degrees Celsius, or greater than 103 degrees Celsius, grip material coated yarns may be melted for the purposes of molding and/or thermoforming a given region of textiles knitted therefrom in order to impart desirable design and aesthetic features in a short period of time.

In one aspect, a melting temperature of the grip material lower than 140 degrees Celsius prevents or mitigates the risk dye migration from package-dyed yarns, such as package-dyed polyester yarns incorporated in the footwear or other articles. In a further aspect, dye migration from package-dyed yarns or fibers is a diffusion-limited process and short periods of exposure to temperatures greater than 140 degrees Celsius, such as during thermoforming, do not extensively damage, discolor, or otherwise render the appearance of the footwear or other articles unacceptable. However, in another aspect, if the melting temperature of the grip material is greater than about 210 degrees Celsius, thermal damage and dye migration may occur.

In one aspect, a high melting enthalpy indicates a longer heating time is required to ensure a polymer or polymeric material is fully melted and will flow well. In another aspect, a low melting enthalpy requires less heating time to ensure full melting and good flow.

In a further aspect, high cooling exotherms indicate rapid transitions from molten to solid. In another aspect, higher recrystallization temperatures indicate polymers or polymeric materials are capable of solidifying at higher temperatures. In one aspect, high-temperature solidification is beneficial for thermoforming. In one aspect, recrystallization above 95 degrees Celsius promotes rapid setting after thermoforming, reduce cycle time, reduce cooling demands, and improve stability of shoe components during assembly and use.

In one aspect, viscosity of the grip material disclosed herein affects the properties and processing of article comprising the grip material. In a further aspect, high viscosities at low shear rates (e.g., less than 1 reciprocal second) indicate resistance to flow, displacement, and more solid-like behavior. In another aspect, low viscosities at higher shear rates (e.g., greater than 10 reciprocal seconds) lend themselves to high-speed extrusion. In one aspect, as viscosity increases, the ability to flow and deform adequately to coat core yarn or a region of a textile incorporating the coated yarn becomes challenging. In another aspect, materials that exhibit high shear thinning indices (e.g., where viscosity at 10 or 100 reciprocal seconds is lower than at 1 reciprocal second) may be challenging to extrude and may melt fracture if coated or extruded at a velocity that is too high.

In certain aspects, the grip yarns exhibit a tenacity greater than 1 gram/denier. In one aspect, the grip yarns exhibit a tenacity of from about 1 gram/denier to about 5 grams/ denier. In one or more aspects, the grip yarns exhibit a tenacity of from about 1.5 grams/denier to about 4.5 grams/denier. In one aspect, the grip yarns exhibit a tenacity of from about 2 grams/denier to about 4.5 grams/denier.

"Tenacity" as used herein refers to a property of a fiber or yarn, and is determined using the respective testing method and sampling procedure described as follows. Specifically, tenacity and elongation of the yarn sample are determined according to the test method detailed in EN ISO 2062 with the pre-load set to 5 grams. Elongation is recorded at the maximum tensile force value applied prior to breaking. Tenacity can be calculated as the ratio of load required to break the specimen to the linear density of the specimen.

In certain aspects, it may be desired to utilize a grip yarn that is suitable for use on commercial knitting equipment. A free-standing shrinkage of a yarn at 50 degrees Celsius is one property that can be predictive of a suitable yarn for use on a commercial knitting machine. In certain aspects, grip yarns can exhibit a freestanding shrinkage when heated from 20 degrees Celsius to 70 degrees Celsius of less than 15 percent. In various aspects, grip yarns can exhibit freestanding shrinkage when heated from 20 degrees Celsius to 70 degrees Celsius of about 0 percent to about 60 percent, about 0 percent to about 30 percent, or about 0 percent to about 15 percent. The term "free-standing shrinkage" as used herein refers to a property of a yarn and a respective testing method described as follows:

Yarn Shrinkage Test. The free-standing shrinkage of yarns can be determined by the following method. A yarn sample is prepared according to the Yarn Sampling Procedure described below, and is cut to a length of approximately 30 millimeters with minimal tension at approximately room temperature (e.g., 20 degrees Celsius). The cut sample is placed in a 50 degrees Celsius or 70 degrees Celsius oven for 90 seconds. The sample is removed from the oven and measured. The percentage of shrink is calculated using the pre- and post-oven measurements of the sample, by dividing the post-oven measurement by the pre-oven measurement, and multiplying by 100.

Yarn Sampling Procedure. Yarn to be tested is stored at room temperature (20 degrees Celsius to 24 degrees Celsius) for 24 hours prior to testing. The first 3 meters of material are discarded. A sample yarn is cut to a length of approximately 30 millimeters with minimal tension at approximately room temperature (e.g., 20 degrees Celsius).

In one or more aspects, the free-standing shrinkage of a yarn at 70 degrees Celsius can be a useful indicator of the ability of a yarn to be exposed to certain environmental conditions without any substantial changes to the physical structure of the yarn. In certain aspects, a grip yarn exhibits a free-standing shrinkage when heated from 20 degrees Celsius to 70 degrees Celsius of from about 0% to about 60%. In one or more aspects, a grip yarn exhibits a free-standing shrinkage when heated from 20 degrees Celsius to 70 degrees Celsius of from about 0% to about 30%. In one aspect, a grip yarn exhibits a freestanding shrinkage when heated from 20 degrees Celsius to 70 degrees Celsius of from about 0% to about 20%.

As discussed above, in certain aspects, the grip material (e.g., first polymeric composition) and the core material (e.g., second polymeric composition) have differing properties. In various aspects, these differing properties allow for the grip fibers and yarns as described herein, during a thermoforming process, to melt and flow, and subsequently cool and solidify into a different structure than the structure they had prior to the thermoforming process (e.g., thermoform from a grip yarn to a reflowed grip material), while an uncoated fiber or yarn may not deform or melt during such a process and can maintain its structure (e.g., as a fiber or a yarn), when the thermoforming process is conducted at a temperature below the melting or deformation temperature of the uncoated fibers or yarns. In such aspects, the reflowed grip material formed from the grip fibers or yarns during the thermoforming process may be integrally connected to the non-altered structure (e.g., a yarn or fiber), which can provide three-dimensional structure and/or other properties targeted to specific spots on an article of footwear.

The grip material of the grip yarn described herein comprises one or more thermoplastic elastomers. In an aspect, an "elastomer" is defined as a material having an elongation at break greater than 400 percent as determined using ASTM D-412-98 at 25 degrees Celsius. In another aspect, the elastomer is formed into a plaque, wherein the plaque has a break strength of from 10 to 35 kilogram-force (kgf), or of from about 10 to about 25 kilogram-force, or of from about 10 to about 20 kilogram-force, or of from about 15 to about 35 kilogram-force, or of from about 20 to about 30 kilogram-force. In another aspect, tensile breaking strength or ultimate strength, if adjusted for cross-sectional area, is greater than 70 kilogram-force per square centimeter, or greater than 80 kilogram-force per square centimeter. In another aspect, the elastomer plaque has a strain to break of from 450 percent to 800 percent, or from 500 to 800 percent, or from 500 to 750 percent, or from 600 to 750 percent, or from 450 to 700 percent. In still another aspect, the elastomer plaque has a load at 100 percent strain of from 3 to 8 kilogram-force per millimeter, or of about 3 to about 7 kilogram-force per millimeter, about 3.5 to about 6.5 kilogram-force per millimeter, or about 4 to about 5 kilogram-force per millimeter.

In one aspect, the elastomer plaque has a toughness of from 850 kilogram-millimeters to 2200 kilogram-millimeters, or of from about 850 kilogram-millimeters to about 2000 kilogram-millimeters, or of from about 900 kilogram-millimeters to about 1750 kilogram-millimeters, or of from about 1000 kilogram-millimeters to about 1500 kilogram-millimeters, or of from about 1500 kilogram-millimeters to about 2000 kilogram-millimeters. In an aspect, the elastomer plaque has a stiffness of from about 35 to about 155, or of from about 50 to about 150, or of from about 50 to about 100, or of from about 50 to about 75, or of from about 60 to about 155, or of from about 80 to about 150. In still another aspect, the elastomer plaque has a tear strength of from about 35 to about 80, or of from about 35 to about 75, or of from about 40 to about 60, or of from about 45 to about 50.

In aspects, exemplary thermoplastic elastomers include homo-polymers and copolymers. The term "polymer" refers to a polymerized molecule having one or more monomer species, and includes homopolymers and copolymers. The term "copolymer" refers to a polymer having two or more monomer species, and includes terpolymers (i.e., copolymers having three monomer species). In certain aspects, the thermoplastic elastomer is a random co-polymer. In one aspect, the thermoplastic elastomer is a block co-polymer. For example, the thermoplastic elastomer may be a block co-polymer having repeating blocks of polymeric units of the same chemical structure (segments) which are relatively harder (hard segments), and repeating blocks of polymeric segments which are relatively softer (soft segments). In various aspects, in block copolymers, including block copolymers having repeating hard segments and soft segments, physical crosslinks may be present within the blocks or between the blocks or both within and between the blocks. Particular examples of hard segments include isocyanate segments and polyamide segments. Particular examples of soft segments include polyether segments and polyester segments. As used herein, the polymeric segment may be a particular type of polymeric segment such as, for example, an isocyanate segment, a polyamide segment, a polyether segment, a polyester segment, and the like. It is understood that the chemical structure of the segment is derived from the described chemical structure. For example, an isocyanate segment is a polymerized unit including an isocyanate functional group. When referring to a block of polymeric segments of a particular chemical structure, the block may contain up to 10 mol percent of segments of other chemical structures. For example, as used herein, a polyether segment is understood to include up to 10 mol percent of non-polyether segments.

In one aspect, the grip material (e.g., the first polymeric composition) comprises a polymeric component consisting of all the polymers present in the grip material. Optionally the polymeric component can comprise two or more polymers.

Two or more polymers can be considered to be of the same "type" of polymer when they share individual segments having chemical structures which fall within the same general polymer structure (e.g., polyester, polyamide, polyolefin, polyurethane, polystyrene, etc.). In one aspect, the shared individual segments may be polyesters, or may be polyamides, or may be polyolefins, or may be polyurethanes, or may be polystyrenes, etc. In accordance with this aspect, the polymeric component can be described as consisting of polyesters, or as consisting of polyamides, or as consisting of polyolefins, or as consisting of polyurethanes, or as consisting of polystyrenes, etc. Two or more polymers can be considered to differ from each other when none of the polymers share segments having chemical structures which fall within the same general polymer structure.

In another aspect, two or more polymers can have a shared chemical structure in that they all include segments having the same chemical structure but each polymer may include a different number of segments so the polymers vary in molecular weight, e.g., they are all forms of polyethylene terephthalate (PET), or they are all forms of nylon 6,6, or they are all forms of polyester-polyurethane copolymers, or they all forms of styrene ethylene/butylene styrene (SEBS) copolymers, etc. In accordance with this aspect, the polymeric component can be described as consisting of PETs, or as consisting of nylon 6,6, or as consisting of polyester-polyurethanes, or as consisting of SEBS copolymers, etc.

In various aspects, the thermoplastic elastomer may include one or more of a thermoplastic copolyester elastomer, a thermoplastic polyether block amide elastomer, a thermoplastic polyurethane elastomer, a polyolefin based-copolymer elastomer, a thermoplastic styrenic copolymer elastomer, a thermoplastic ionomer elastomer, or any combination thereof. In one aspect, the first polymeric composition comprises a thermoplastic elastomeric styrenic copolymer. In a further aspect, the thermoplastic elastomeric styrenic copolymer may be a styrene butadiene styrene (SBS) block copolymer, a styrene ethylene/butylene styrene (SEBS) copolymer, a styrene acrylonitrile (SAN) copolymer, or any combination thereof. In one aspect, grip material comprises a thermoplastic elastomeric polyester polyurethane, a thermoplastic polyether polyurethane, or any combination thereof. In some aspects, the thermoplastic elastomeric polyester polyurethane may be an aromatic polyester, an aliphatic composition, or a combination thereof. It should be understood that other thermoplastic polymeric materials not specifically described below are also contemplated for use in the grip material and/or in the core material as described herein. In one aspect, a grip material comprising a thermoplastic elastomer that has a melting temperature greater than about 110 degrees Celsius and less than about 170 degrees Celsius. In another aspect, a grip material comprising a thermoplastic elastomer has a melting temperature of about 110 degrees Celsius to about 170 degrees Celsius, about 115 degrees Celsius to about 160 degrees Celsius, about 120 degrees Celsius to about 150 degrees Celsius, about 125 degrees Celsius to about 140 degrees Celsius, about 110 degrees Celsius to about 150 degrees Celsius, or about 110 degrees Celsius to about 125 degrees Celsius.

In various aspects, the thermoplastic elastomer has a glass transition temperature (Tg) less than 50 degrees Celsius when determined in accordance with ASTM D3418-97 as described herein below. In some aspects, the thermoplastic elastomer has a glass transition temperature (Tg) of about −60 degrees Celsius to about 50 degrees Celsius, about −25 degrees Celsius to about 40 degrees Celsius, about −20 degrees Celsius to about 30 degrees Celsius, about −20 degrees Celsius to about 20 degrees Celsius, or of about −10 degrees Celsius to about 10 degrees Celsius, when determined in accordance with ASTM D3418-97 as described herein below. In one aspect, the glass transition temperature of the thermoplastic elastomer is selected such that articles incorporating the grip material disclosed herein, thermoplastic material is above its glass transition temperature during normal wear when incorporated into an article of footwear (i.e., the thermoplastic elastomer is in its more rubbery and less brittle state).

In one aspect, the thermoplastic elastomer comprises: (a) a plurality of first segments; (b) a plurality of second segments; and, optionally, (c) a plurality of third segments. In various aspects, the thermoplastic elastomer is a block copolymer. In some aspects, the thermoplastic elastomer is a segmented copolymer. In further aspects, the thermoplastic elastomer is a random copolymer. In still further aspects, the thermoplastic elastomer is a condensation copolymer.

In a further aspect, the thermoplastic elastomer has a weight average molecular weight of about 50,000 Daltons to about 1,000,000 Daltons; about 50,000 Daltons to about 500,000 Daltons; about 75,000 Daltons to about 300,000 Daltons; about 100,000 Daltons to about 200,000 Daltons.

In a further aspect, the thermoplastic elastomer has a ratio of first segments to second segments from about 1:1 to about 1:2 based on the weight of each of the first segments and the second segments; or of about 1:1 to about 1:1.5 based on the weight of each of the first segments and the second segments.

In a further aspect, the thermoplastic elastomer has a ratio of first segments to third segments from about 1:1 to about 1:5 based on the weight of each of the first segments and the third segments; about 1:1 to about 1:3 based on the weight of each of the first segments and the third segments; about to about 1:2 based on the weight of each of the first segments and the third segments; about to about 1:3 based on the weight of each of the first segments and the third segments.

In a further aspect, the thermoplastic elastomer has first segments derived from a first component having a number-average molecular weight of about 250 Daltons to about 6 ( )( )( ) Daltons; about 400 Daltons to about 6,000 Daltons; about 350 Daltons to about 5,000 Daltons; or about 500 Daltons to about 3,000 Daltons.

In some aspects, the thermoplastic elastomer comprises phase separated domains. For example, a plurality of first segments can phase-separate into domains comprising primarily the first segments. Moreover, a plurality of second segments derived from segments having a different chemical structure can phase-separate into domains comprising primarily the second segments. In some aspects, the first segments can comprise hard segments, and the second segments can comprise soft segments. In other aspects, the thermoplastic elastomer can comprise phase separated domains comprising a plurality of first copolyester units.

In one aspect, prior to thermoforming, the grip material or the one or more thermoplastic elastomers of the grip material or both have a glass transition temperature of from about 20 degrees Celsius to about −60 degrees Celsius. In one aspect, prior to thermoforming, the grip material or the one or more thermoplastic elastomers of the grip material or both have a Taber Abrasion Resistance of from about 10 milligrams to about 40 milligrams as determined by ASTM D3389. In one aspect, prior to thermoforming, the grip material or the one or more thermoplastic elastomers of the grip material or both have a Durometer Hardness (Shore A) of from about 60 to about 90 as determined by ASTM D2240. In one aspect, prior to thermoforming, the grip material or the one or more thermoplastic elastomers of the grip material or both have a specific gravity of from about 0.80 g/cm$^3$ to about 1.30 g/cm$^3$ as determined by ASTM D792. In one aspect, prior to thermoforming, the grip material or the one or more thermoplastic elastomers of the grip material or both have a melt flow index of about 2 grams/10 minutes to about 50 grams/10 minutes at 160 degrees Celsius using a test weight of 2.16 kilograms. In one aspect, prior to thermoforming, the grip material or the one or more thermoplastic elastomers of the grip material or both have a melt flow rate greater than about 2 grams/10 minutes at 190 degrees Celsius or 200 degrees Celsius when using a test weight of 10 kilograms. In one aspect, prior to thermoforming, the grip material or the one or more thermoplastic elastomers of the grip material or both have a modulus of about 1 megapascal to about 500 megapascals.

Example Thermoplastic Polyurethane Elastomers

In certain aspects, the one or more thermoplastic elastomers as used in the grip material of the grip yarn comprise or consist essentially of one or more thermoplastic polyurethane (TPU) elastomers. The thermoplastic polyurethane elastomer may be a thermoplastic polyurethane co-polymer comprising hard segments and soft segments, including blocks of hard segments and blocks of soft segments. The hard segments may comprise or consist of segments derived from an isocyanate. In the same or alternative aspects, the soft segments may comprise or consist of segments derived from a polyol, such as, for example, polyether segments, or polyester segments, or a combination of polyether segments and polyester segments. In one aspect, the one or more thermoplastic elastomers comprise or consist essentially of an elastomeric thermoplastic polyurethane including hard segments and soft segments, such as an elastomeric thermoplastic polyurethane having repeating blocks of hard segments and repeating blocks of soft segments.

In aspects, the one or more thermoplastic polyurethane elastomer is produced by polymerizing one or more isocyanates with one or more polyols to produce polymer chains having carbamate linkages (—N(CO)O—), where the segments derived from isocyanate(s) each preferably include two or more isocyanate (—NCO) groups per segment, such as 2, 3, or 4 isocyanate groups per segment (although, single-functional isocyanates can also be optionally included, e.g., as chain terminating units). Additionally, the segments derived from isocyanates can also be chain extended with one or more chain extenders to bridge two or more isocyanate functional groups.

The term "aliphatic" refers to a saturated or unsaturated organic molecule that does not include a cyclically conjugated ring system having delocalized pi electrons. Examples of suitable aliphatic diisocyanates for producing the thermoplastic polyurethane elastomers include hexamethylene diisocyanate (HDI), isophorone diisocyanate (IPDI), butylenediisocyanate (BDI), bisisocyanatocyclohexylmethane (HMDI), 2,2,4-tri methylhexamethylene diisocyanate (TMDI), bisisocyanatomethylcyclohexane, bisisocyanatomethyltricyclodecane, norbornane diisocyanate (N DI), cyclohexane diisocyanate (CHDI), 4,4'-dicyclohexylmethane diisocyanate (H12MDI), diisocyanatododecane, lysine diisocyanate, and combinations thereof.

The term "aromatic" refers to a cyclically conjugated ring system having delocalized pi electrons, which exhibits greater stability than a hypothetical ring system having localized pi electrons. Examples of suitable aromatic diisocyanates for producing the thermoplastic polyurethane elastomers include toluene diisocyanate (TDI), TDI adducts with trimethyloylpropane ($^{TM}$P), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (N DI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some aspects, the thermoplastic polyurethane elastomers are substantially free of aromatic groups.

In particular aspects, the thermoplastic polyurethane elastomers are produced from diisocyanates including HMDI, TDI, MDI, H12 aliphatics, and combinations thereof. For example, the grip material can comprise one or more thermoplastic polyurethane elastomers produced from diisocynates including HMDI, TDI, MDI, $H_{12}$ aliphatics, and combinations thereof.

In certain aspects, thermoplastic polyurethane elastomers which are crosslinked (e.g., partially crosslinked polyurethane elastomers which retain thermoplastic properties) or which can be crosslinked, can be used in accordance with the present disclosure. It is possible to produce crosslinked or crosslinkable polyurethane elastomers using multi-functional isocyanates. Examples of suitable triisocyanates for producing the polyurethane elastomers include TDI, HDI, and IPDI adducts with trimethyloylpropane (TMP), uretdiones (i.e., dimerized isocyanates), polymeric MDI, and combinations thereof.

When a chain extender is used to form the thermoplastic polyurethane elastomer, the particular chain extender polyol used, can be, for example, an aliphatic, aromatic, or polyether. Examples of suitable chain extender polyols for producing the one or more thermoplastic polyurethane elastomers include ethylene glycol, lower oligomers of ethylene glycol (e.g., diethylene glycol, triethylene glycol, and tetraethylene glycol), 1,2-propylene glycol, 1,3-propylene glycol, lower oligomers of propylene glycol (e.g., dipropylene glycol, tripropylene glycol, and tetrapropylene glycol), 1,4-butylene glycol, 2,3-butylene glycol, 1,6-hexanediol, 1,8-octanediol, neopentyl glycol, 1,4-cyclohexanedimethanol, 2-ethyl-1,6-hexanediol, 1-methyl-1,3-propanediol, 2-methyl-1,3-propanediol, dihydroxyalkylated aromatic compounds (e.g., bis(2-hydroxyethyl) ethers of hydroquinone and resorcinol, xylene-a,a-diols, bis(2-hydroxyethyl) ethers of xylene-a,a-diols, and combinations thereof.

Optionally, in some examples, the one or more thermoplastic polyurethane elastomers include a thermoplastic polyurethane elastomer having relatively high degree of hydrophilicity. For example, the thermoplastic polyurethane elastomer can be a thermoplastic polyether polyurethane which includes segments including a polyether group, a polyester group, a polycarbonate group, an aliphatic group, or an aromatic group, wherein the aliphatic group or aromatic group is substituted with one or more pendant group having relatively greater degree of hydrophilicity (i.e., relatively "hydrophilic" groups). The relatively "hydrophilic" groups can be selected from the group consisting of hydroxyl, polyether, polyester, polylactone (e.g., polyvinylpyrrolidone (PVP)), amino, carboxylate, sulfonate, phosphate, ammonium (e.g., tertiary and quaternary ammonium), zwitterion (e.g., a betaine, such as poly(carboxybetaine (pCB) and ammonium phosphonates such as phosphatidylcholine), and combinations thereof. In such examples, this relatively hydrophilic group or segment can form portions of the backbone of the thermoplastic polyurethane elastomer, or can be grafted to the backbone as a pendant group. In some examples, the pendant hydrophilic group or segment can be bonded to the aliphatic group or aromatic group through a linker.

In some examples, at least one segment of the thermoplastic polyurethane elastomer includes a polyether segment (i.e., a segment having one or more ether groups). Suitable polyethers include, but are not limited to polyethylene oxide (PEO), polypropylene oxide (PPO), polytetrahydrofuran (PTHF), polytetramethylene oxide (P TmO), and combinations thereof. The term "alkyl" as used herein refers to straight chained and branched saturated hydrocarbon groups containing one to thirty carbon atoms, for example, one to twenty carbon atoms, or one to ten carbon atoms. The term $C_n$, means the alkyl group has "n" carbon atoms. For example, $C_4$ alkyl refers to an alkyl group that has 4 carbon atoms. $C_{1-7}$ alkyl refers to an alkyl group having a number of carbon atoms encompassing the entire range (i.e., 1 to 7 carbon atoms), as well as all subgroups (e.g., 1-6, 2-7, 1-5, 3-6, 1, 2, 3, 4, 5, 6, and 7 carbon atoms). Non-limiting examples of alkyl groups include, methyl, ethyl, n-propyl, isopropyl, n-butyl, sec-butyl (2-methylpropyl), t-butyl (1,1-dimethylethyl), 3,3-dimethylpentyl, and 2-ethylhexyl. Unless otherwise indicated, an alkyl group can be an unsubstituted alkyl group or a substituted alkyl group.

In some aspects, the one or more thermoplastic polyurethane elastomer includes one or more polyester segments. The one or more polyester segment can be derived from the polyesterification of one or more dihydric alcohols (e.g., ethylene glycol, 1,3-propylene glycol, 1,2-propylene glycol, 1,4-butanediol, 1,3-butanediol, 2-methylpentanediol-1,5,diethylene glycol, 1,5-pentanediol, 1,5-hexanediol, 1,2-dodecanediol, cyclohexanedimethanol, and combinations thereof) with one or more dicarboxylic acids (e.g., adipic acid, succinic acid, sebacic acid, suberic acid, methyladipic acid, glutaric acid, pimelic acid, azelaic acid, thiodipropionic acid and citraconic acid and combinations thereof). The polyester segment also can be derived from polycarbonate prepolymers, such as poly(hexamethylene carbonate) glycol, poly(propylene carbonate) glycol, poly(tetramethylene carbonate)glycol, and poly(nonanemethylene carbonate) glycol. Suitable polyesters can include, for example, polyethylene adipate (PEA), poly(1,4-butylene adipate), poly (tetramethylene adipate), poly(hexamethylene adipate), polycaprolactone, polyhexamethylene carbonate, poly(propylene carbonate), poly(tetramethylene carbonate), poly (nonanemethylene carbonate), and combinations thereof.

In various aspects, the thermoplastic polyurethane elastomer includes one or more polycarbonate segments. The one or more polycarbonate segments can be derived from the reaction of one or more dihydric alcohols (e.g., ethylene glycol, 1,3-propylene glycol, 1,2-propylene glycol, 1,4-butanediol, 1,3-butanediol, 2-methylpentanediol-1,5, diethylene glycol, 1,5-pentanediol, 1,5-hexanediol, 1,2-dodecanediol, cyclohexanedimethanol, and combinations thereof) with ethylene carbonate.

As described herein, the thermoplastic polyurethane elastomer can be physically cross-linked through e.g., nonpolar or polar interactions between the urethane or carbamate groups on the polymers. In these aspects, the soft segment can be covalently bonded to the hard segment. In some aspects, the thermoplastic polyurethane elastomer having physically crosslinked hard and soft segments can be a hydrophilic thermoplastic polyurethane elastomer (i.e., a thermoplastic polyurethane elastomer including hydrophilic groups as disclosed herein).

In one aspect, prior to thermoforming, the thermoplastic polyurethane elastomer is an aromatic polyester thermoplastic elastomeric polyurethane or an aliphatic polyester thermoplastic elastomeric polyurethane having the following properties: (1) a glass transition temperature glass transition temperature of from about 20 degrees Celsius to about −60 degrees Celsius; (2) a Taber Abrasion Resistance of from about 10 milligrams to about 40 milligrams as determined by ASTM D3389; (3) a Durometer Hardness (Shore A) of from about 60 to about 90 as determined by ASTM D2240; (4) a specific gravity of from about 0.80 g/cm$^3$ to about 1.30 g/cm$^3$ as determined by ASTM D792; (5) a melt flow index of about 2 grams/10 minutes to about 50 grams/10 minutes at 160 degrees Celsius using a test weight of 2.16 kilograms; (6) a melt flow rate greater than about 2 grams/10 minutes at 190 degrees Celsius or 200 degrees Celsius when using a test weight of 10 kilograms; and (7) a modulus of about 1 megapascal to about 500 megapascals.

Commercially available thermoplastic polyurethane elastomers suitable for the present use include, but are not limited to those under the tradename "TECOPHILIC", such as TG-500, TG-2000, SP-80A-150, SP-93A-100, SP-60D60 (Lubrizol, Countryside, IL), "ESTANE" (e.g., 58238, T470A; Lubrizol, Countryside, IL), and "ELASTOLLAN" (e.g., 9339, 1370A; BASF).

Example Thermoplastic Styrenic Copolymer Elastomers

In certain aspects, the one or more thermoplastic elastomers comprise or consist essentially of one or more thermoplastic elastomeric styrenic polymers, including one or more thermoplastic styreinic copolymers. Examples of these copolymers include, but are not limited to, styrene butadiene styrene (SBS) block copolymers, styrene ethylene/butylene styrene (SEBS) copolymers, polyacetal (POM) copolymers, styrene acrylonitrile (SAN) copolymers, and combinations thereof. Exemplary commercially available thermoplastic elastomeric styrenic copolymers include MONOPRENE IN5074, SP066070, and SP16975 (Teknor Apex, Pawtucket, RI, USA), which are styrene ethylene/butylene styrene (SEBS) resins. In some aspects, blends, alloys, and mixtures of the one or more thermoplastic elastomers are be melt compatible or can be compatibilized with additives, oils, or grafted chemical moieties in order to achieve miscibility.

In another aspect, the one or more thermoplastic elastomeric styrenic copolymers can comprise or consist essentially of a SBS block copolymer comprising a first polystyrene block, a polybutadiene block, and a second polystyrene block.

In another aspect, the one or more thermoplastic elastomer can comprise or consist essentially of a SEBS block copolymer, where the SEBS block copolymer comprises a first polystyrene block, a polyolefin block, wherein the polyolefin block comprises alternating polyethylene blocks and polybutylene blocks, and a second polystyrene block In one aspect, the SEBS copolymer or copolymers have a density from about 0.88 grams per cubic centimeter to about 0.92 grams per cubic centimeter. In a further aspect, the SEBS copolymer or copolymers can be as much as 15 to 25 percent less dense than cross-linked rubbers, cross-linked polyurethanes, and thermoplastic polyurethane materials. In aspects where the polymeric component of the grip material comprises or consists essentially of one or more SEBS copolymers, the grip material is less dense than when other thermoplastic elastomers such as TPU elastomers are used, A less dense grip material offers weight savings and per part cost savings for the same material of volume employed while achieving similar performance.

Reference to "a" chemical compound" refers to one or more molecules of the chemical compound, rather than being limited to a single molecule of the chemical compound. Furthermore, the one or more molecules can or cannot be identical, so long as they fall under the category of the chemical compound. Thus, for example, "a polyamide" is interpreted to include one or more polymer molecules of the polyamide, where the polymer molecules may or may not be identical (e.g., different molecular weights and/or isomers).

The terms "at least one" and "one or more of" an element are used interchangeably, and have the same meaning that includes a single element and a plurality of the elements, and can also be represented by the suffix "(s)" at the end of the element. For example, "at least one polyamide", "one or more polyamides", and "polyamide(s)" can be used interchangeably and have the same meaning.

Unless otherwise specified, temperatures referred to herein are determined at standard atmospheric pressure (i.e., 1 ATM).

Property Analysis and Characterization Procedures

Evaluation of various properties and characteristics described herein are by various testing procedures as described below.

Sample Coefficient of Friction. The static or dynamic coefficient of friction (COF) of a textile or plaque sample can be determined using test method ASTM D1894. In this method, a sample is cut to size and mounted on the sled, and a 100 gram weight plate is placed on the sled. During the test, the weighted sled is pulled across a test surface of the material being tested. For example, static and dynamic wet and dry COF may be determined by pulling the sled across a concrete surface to determine the COF of the sample and concrete. The coefficient of friction of the sample against that surface is captured by recording the normal force (100 grams plus sled weight) and measuring the applied force required to drag the sled across the test surface. The coefficient of friction (COF) is then calculated from the ratio of the two forces. Dry COF is determined by testing a dry sample against a dry testing surface, and wet COF is determined by testing a sample wetted with water by soaking it in room temperature water for 10 minutes against a test surface wetted with room temperature water.

Textile-Ball Coefficient of Friction Test. The static and dynamic coefficient of friction (COF) of a sample prepared using the Component Sampling Procedure or the Textile Sampling Procedure described below against a sample from a panel of a "MERLIN" football (NIKE Inc., Beaverton, OR, USA) can be determined using a modified version of test method ASTM D1894 as described for the Sample Coefficient of Friction. In this method, the sample is cut to size and mounted on an acrylic substrate, and the ball material is cut to size and mounted on the sled. Once the ball material has been mounted on the sled, the sled has a contact footprint of 3.9 inches by 1 inch, and a weight of approximately 0.402 kilograms. During the test, the sample and ball material are positioned with the external-facing surface of the ball material contacting the surface of the sample which is intended form the external-facing surface of an article of footwear, and the sled is pulled across the sample. Dry samples and dry ball material are used to determine the static or dynamic dry COF. To determine the static or dynamic wet COF, the sample and the ball material are both soaked in room temperature water for 10 minutes immediately prior to testing. Each measurement is repeated at least 3 times, and the results of the runs are averaged.

Melting and Glass Transition Temperature Test. The melting temperature and/or glass transition temperature are determined for a sample prepared according to Material Sampling Procedure described below, using a commercially available Differential Scanning calorimeter ("DSC") in accordance with ASTM D3418-97. Briefly, a 10-60 milligram sample is placed into an aluminum DSC pan and then the lid is sealed with a crimper press. The DSC is configured to scan from −100 degrees Celsius to 225 degrees Celsius with a 20 degree Celsius/minute heating rate, hold at 225 degrees Celsius for 2 minutes, and then cool down to 25 degrees Celsius at a rate of −20 degrees Celsius/minute. The DSC curve created from this scan is then analyzed using standard techniques to determine the glass transition temperature and the melting temperature. Melting enthalpy is calculated by integrating the melting endotherm and normalizing by the mass of the sample. Crystallization enthalpy upon cooling is calculated by integrating the cooling endotherm and normalizing by the mass of the sample.

Deformation Temperature Test. The Vicat softening temperature is determined for a sample prepared according to Material Sampling Procedure or the Component Sampling Procedure described below, according to the test method detailed in ASTM™ D1525-09 Standard Test Method for Vicat Softening Temperature of Plastics, preferably using Load A and Rate A. Briefly, the Vicat softening temperature is the temperature at which a flat-ended needle penetrates the specimen to the depth of 1 millimeter under a specific load. The temperature reflects the point of softening expected when a material is used in an elevated temperature application. It is taken as the temperature at which the specimen is penetrated to a depth of 1 millimeter by a flat-ended needle with a 1 square millimeter2 circular or square cross-section. For the Vicat A test, a load of 10 Newtons (N) is used, whereas for the Vicat B test, the load is 50 Newtons. The test involves placing a test specimen in the testing apparatus so that the penetrating needle rests on its surface at least 1 millimeter from the edge. A load is applied to the specimen per the requirements of the Vicat A or Vicat B test. The specimen is then lowered into an oil bath at 23° C. degrees Celsius. The bath is raised at a rate of 50 degrees Celsius or 120 degrees Celsius per hour until the needle penetrates 1 millimeter. The test specimen must be between 3 and 6.5 millimeter thick and at least 10 millimeter in width and length. No more than three layers can be stacked to achieve minimum thickness.

Melt Flow Index Test. The melt flow index is determined for a sample prepared according to the Material Sampling Procedure described below according to the test method detailed in ASTM D1238-13 Standard Test Method for Melt Flow Rates of Thermoplastics by Extrusion Plastometer, using Procedure A described therein. Briefly, the melt flow index measures the rate of extrusion of thermoplastics through an orifice at a prescribed temperature and load. In the test method, approximately 7 grams of the material is loaded into the barrel of the melt flow apparatus, which has been heated to a temperature specified for the material. A weight specified for the material is applied to a plunger and the molten material is forced through the die. A timed extrudate is collected and weighed. Melt flow index values are calculated in g/10 min for a given applied load and applied temperature. As described in ASTM D1238-13, melt flow index may be determined at 160 degrees Celsius using a weight of 2.16 kg, or at 200 degrees Celsius using a weight of 10 kg.

Molten Polymer Viscosity Test. The test is conducted using 2 millimeter plaques or films prepared according to the Plaque or Film Sampling Procedure described below. A circular die is used to cut 50 millimeter specimen discs of from the plaque or film. Test specimens are mounted on a 50 millimeter diameter aluminum parallel plate on an ARES-G2 (displacement controlled) rheometer. The top plate is lowered so that the test specimens are in contact with both disc surfaces under a defined normal force load and the stage is heated to 210 degrees Celsius. Samples are equilibrated until molten, for a defined dwell time of minutes, and oscillatory shear frequency sweeps are applied at low strain amplitudes to gather rate-dependent data. The ratio of the applied shear stress required to generate the oscillatory motion at a given shear frequency rate yields the measured viscosity value. Shear rate-dependent viscosity data can be gathered from 0.1 reciprocal seconds to 1000 reciprocal seconds.

Plaque Modulus Test. The modulus for sample prepared according to the Plaque or Film Sampling Procedure described below is determined according to the test method detailed in ASTM D412-98 Standard Test Methods for Vulcanized Rubber and Thermoplastic Rubbers and Thermoplastic Elastomers-Tension, with the following modifications. The sample dimension is the ASTM D412-98 Die C, and the sample thickness used is 2.0 millimeters plus or minus 0.5 millimeters. The grip type used is a pneumatic grip with a metal serrated grip face. The grip distance used is 75 millimeters. The loading rate used is 500 millimeters/minute. The modulus (initial) is calculated by taking the slope of the stress (MPa) versus the strain in the initial linear region. This test may also be used to determine other tensile properties such as break strength, strain to break, load at 100 percent strain, toughness, stiffness, tear strength, and the like.

Yarn Denier and Thickness Test. To determine denier, a sample of yarn is prepared according to the Yarn Sampling Procedure described below. A known length of the yarn sample and its corresponding weight are measured. This is converted to grams per 9000 meters of yarn. To determine the thickness of a coated yarn, the yarn is first cut with a razor and observed under a microscope, where coating thickness relative to core yarn diameter is determined to scale.

Yarn Modulus, Tenacity, and Elongation Test. The modulus for a yarn is determined for a sample prepared according to the Yarn Sampling Procedure described above, and tested according to the test method detailed in EN ISO 2062 (Textiles-Yarns from Packages)-Determination of Single-End Breaking Force and Elongation at Break Using Constant Rate of Extension (CRE) Tester. The following modifications to the test method are used. 5 test specimens are prepared with a sample length of 600 millimeters. The equipment used is an Instron Universal Testing System. Instron Pneumatic cord and Thread Grips or similar pneumatic grips are installed, with a grip distance of 250 millimeters. Grip distance is set to 145+1 millimeter and gauge length is set at 250+2 millimeters when using Instron Pneumatic Cord and Thread Grips. The pre-loading is set to 5 grams and the loading rate used is 250 millimeters/minute. The modulus (initial) is calculated by taking the slope of the stress (MPa) versus the strain in the initial linear region. Maximum tensile force value is recorded. Tenacity and elongation of the yarn sample are determined according to the test method detailed in EN ISO 2062 with the pre-load set to 5 grams. Elongation is recorded at the maximum tensile force value applied prior to breaking. In some aspects, tenacity is calculated as the ratio of load required to break the specimen to the linear density of the specimen.

Specific Gravity Test. The specific gravity (SG) is determined according to the test method detailed in ASTM D792 using volume displacement. For instance, SG is measured for samples taken using the Plaque Sampling Procedure, or the Component Sampling Procedure, using a digital balance or a Densicom Tester (Qualitest, Plantation, Florida, USA). Each sample is weighed (g) and then is submerged in a distilled water bath (at 22 degrees C. plus or minus 2 degrees C.). To avoid errors, air bubbles on the surface of the samples are removed, e.g., by wiping isopropyl alcohol on the sample before immersing the sample in water, or using a brush after the sample is immersed. The weight of the sample in the distilled water is recorded. The specific gravity is calculated with the following formula:

$$S.G. = \frac{\text{Weight of the sample in air (g)}}{\text{Weight of sample in air (g)} - \text{WEight of sample in water (g)}}$$

Durometer Hardness Test. The hardness of a material can be determined for a sample according to the test method detailed in ASTM D-2240 Durometer Hardness, using a Shore A scale.

Yarn Shrinkage Test. The free-standing shrinkage of yarns can be determined by the following method. A yarn sample is prepared according to the Yarn Sampling Procedure described below, and is cut to a length of approximately 30 millimeters with minimal tension at approximately room temperature (e.g., 20 degrees Celsius). The cut sample is placed in a 50 degrees Celsius or 70 degrees Celsius oven for 90 seconds. The sample is removed from the oven and measured. The percentage of shrink is calculated using the pre- and post-oven measurements of the sample, by dividing the post-oven measurement by the pre-oven measurement, and multiplying by 100.

Stoll Abrasion Test. Abrasion resistance, including abrasion resistance simulating footwear upper scuffing, can be measured using the Stoll abrasion test, using samples prepared according to the Component Sampling Procedure, the Plaque or Film Sampling Procedure, or the Textile Sampling Procedure described below. The minimum number of samples for Stoll abrasion testing is 3. Samples used herein were hand cut or die cut into circles having a 112 millimeter diameter. The Stoll abrasion test is described more fully in ASTM D3886 and can be performed on the Atlas Universal Wear Tester. In the Stoll abrasion test, an abrading medium is moved over the stationary, mounted test sample and the visual appearance of the sample is monitored. The Stoll abrasion test is performed under pressure to simulate wear under normal usage.

DIN Abrasion Test. Samples are prepared according to the Component Sampling Procedure, the Plaque or Film Sampling Procedure, or the Textile Sampling Procedure described below Abrasion loss is tested on cylindrical samples with a diameter of 16±0.2 millimeters and a minimum thickness of 6 millimeters cut using a ASTM standard hole drill. The abrasion loss is measured using Method B of ASTM D 5963-97a on a Gotech GT-7012-D abrasion test machine. The tests are performed as 22 degrees Celsius with an abrasion path of 40 meters. The Standard Rubber #1 used in the tests has a density of 1.336 grams per cubic centimeter ($g/cm^3$). The smaller the abrasion loss volume, the better the abrasion resistance.

Water Penetration Test. Water penetration for a sample is determined as follows, using for a sample prepared according to the Component Sampling Procedure, the Plaque or Film Sampling Procedure, or the Textile Sampling Procedure described below. The specimen to be tested is mounted on a support base with a surface at a 45 degree angle to the horizontal. The support base includes a 152 millimeter diameter specimen holder inner ring. A specimen is allowed to equilibrate in the laboratory environment for at least 2 hours prior to testing. Test specimens are cut into 220 millimeter diameter circles. Thicker or harder materials such as leather or stiff synthetic leather will have 3 notches cut into the outer edge of the sample. Specimens may be hand cut or die cut. Test specimens for softer materials are cut to the same size, with length direction marked on the test specimens. Backing paper is prepared from white or off-white paper towels, coffee filters, or similar thin, absorbent papers. Backing paper is also cut into 220 millimeter diameter circles. One backing paper is prepared per test specimen and backing paper is not reused. The backing paper and a specimen are placed in a sample fixture, which is in turn placed in a spray testing device. The sample length direction should be parallel with the water flow direction. A funnel is adjusted to a height of 6 inches (152.4 millimeters) between a spray nozzle and the test specimen. The spray nozzle must be over the center of the test specimen. 250±2 milliliters of distilled water are added to the funnel, which causes water to spray onto the test specimen. Within 10 seconds of spraying ending, the top surface is evaluated for water repellency. After the top surface is evaluated, the sample fixture is removed from the support base and the backing paper is evaluated to determine if water penetrated through the sample. Water penetration is reported after visual assessment and samples are rated as "pass" or "fail" according to the degree of wetting. If no sticking or wetting of the top surface is observed, if slight random sticking or wetting of the top surface is observed, or if wetting of the top surface is observed at spray points, the sample is considered to pass. Further wetting beyond the spray points and/or including the back surface indicates the sample has failed the water penetration test.

Textile-Ball Impact Test. Test samples of textiles are prepared according to the Component Sampling Procedure or the Textile Sampling Procedure described below. A 10 inch by 8 inch test sample of the textile is mounted on the outer surface on a metal cylinder having a 10 inch circumference. The test sample and cylinder are mounted on the swinging arm of a robot, the swinging arm is swung at a rate of 50 miles per hour, and impacts the equator of a stationary ball. The ball used is a regulation size Nike "MERLIN" football inflated to 0.80 bar. A high speed video camera is used to record the ball position immediately following the impact. Using the position in space and rotation of the ball across multiple frames of the images recorded by the high-speed video camera, software is then used to calculate the velocity and spin rate of the ball immediately after impact. Each measurement is repeated at least 3 times, and the results of the runs are averaged.

Upper-Ball Impact Test. A whole men's size 10.5 football boot, or the upper of a men's size 10.5 football boot, is mounted on the swinging arm of a robot, and positioned so the ball impacts the boot on the medial side of the vamp, on or near the laces (when the boot includes a lacing structure), and the upper impacts the equator of the ball when the singing arm of the robot is swung at a rate of 50 miles per hour. The ball used is a regulation size Nike "MERLIN" football inflated to 0.80 bar. A high speed video camera is used to record the ball position immediately following the impact. Using the position in space and rotation of the ball across multiple frames of the images recorded by the high-speed video camera, software is then used to calculate the velocity and spin rate of the ball immediately after impact. Each measurement is repeated at least 3 times, and the results of the runs are averaged.

Sampling Procedures

Using the Tests described above, various properties of the materials disclosed herein and articles formed therefrom can be characterized using samples prepared with the following sampling procedures:

Material Sampling Procedure. The Material Sampling Procedure can be used to obtain a neat sample of a polymeric composition or of a polymer, or, in some instances, a sample of a material used to form a polymeric composition or a polymer. The material is provided in media form, such as flakes, granules, powders, pellets, and the like. If a source of the polymeric material or polymer is not available in a neat form, the sample can be cut from a component or element containing the polymeric material or polymer, such as a composite element or a sole structure, thereby isolating a sample of the material.

Plaque or Film Sampling Procedure. A sample of a polymeric composition or a polymer is prepared. A portion of the polymer or polymeric composition is then be molded into a film or plaque sized to fit the testing apparatus. For example, when using a Ross flexing tester, the plaque or film sample is sized to fit inside the Ross flexing tester used, the sample having dimensions of about 15 centimeters (cm) by 2.5 centimeters (cm) and a thickness of about 1 millimeter (mm) to about 4 millimeters (mm) by thermoforming the polymeric composition or polymer in a mold. For a plaque sample of a polymer, the sample can be prepared by melting the polymer, charging the molten polymer into a mold, re-solidifying the polymer in the shape of the mold, and removing the solidified molded sample from the mold. Alternatively, the sample of the polymer can be melted and then extruded into a film which is cut to size. For a sample of a polymeric composition, the sample can be prepared by blending together the ingredients of the polymeric composition, melting the thermoplastic ingredients of the polymeric composition, charging the molten polymeric composition into a mold, re-solidifying the polymeric composition in the shape of the mold, and removing the solidified molded sample from the mold. Alternatively, the sample of the polymer material can be prepared by mixing and melting the ingredients of the polymeric composition, and then the molten polymeric composition can be extruded into a film which is cut to size. For a film sample of a polymer or polymeric composition, the film is extruded as a web or sheet having a substantially constant film thickness for the film (within ±10 percent of the average film thickness) and cooled to solidify the resulting web or sheet. A sample having a surface area of 4 square centimeters is then cut from the resulting web or sheet. Alternatively, if a source of the film material is not available in a neat form, the film can be cut from a substrate of a footwear component, or from a backing substrate of a co-extruded sheet or web, thereby isolating the film. In either case, a sample having a surface area of 4 square centimeters is then cut from the resulting isolated film.

Component Sampling Procedure. This procedure can be used to obtain a sample of a material from a component of an article of footwear, an article of footwear, a component of an article of apparel, an article of apparel, a component of an article of sporting equipment, or an article of sporting equipment, including a sample of a polymeric composition or of a textile, or a portion of a textile, such as thermoformed network. A sample including the material in a non-wet state (e.g., at 25 degrees Celsius and 20 percent relative humidity) is cut from the article or component using a blade. If the material is bonded to one or more additional materials, the procedure can include separating the additional materials from the material to be tested. For example, to test a material on a ground-facing surface of sole structure, the opposite surface can be skinned, abraded, scraped, or otherwise cleaned to remove any adhesives, yarns, fibers, foams, and the like which are affixed to the material to be tested. The resulting sample includes the material and may include any additional materials bonded to the material.

The sample is taken at a location along the article or component that provides a substantially constant material thickness for the material as present on the article or component (within plus or minus 10 percent of the average material thickness), such as, for an article of footwear, in a forefoot region, midfoot region, or a heel region of a ground-facing surface. For many of the test protocols described above, a sample having a surface area of 4 square centimeters (cm2) is used. The sample is cut into a size and shape (e.g., a dogbone-shaped sample) to fit into the testing apparatus. In cases where the material is not present on the article or component in any segment having a 4 square centimeter surface area and/or where the material thickness is not substantially constant for a segment having a 4 square centimeter surface area, sample sizes with smaller cross-sectional surface areas can be taken and the area-specific measurements are adjusted accordingly.

Yarn Sampling Procedure. Yarn to be tested is stored at room temperature (20 degrees Celsius to 24 degrees Celsius) for 24 hours prior to testing. The first 3 meters of material are discarded. A sample yarn is cut to a length of approximately 30 millimeters with minimal tension at approximately room temperature (e.g., 20 degrees Celsius).

Textile Sampling Procedure. A textile to be tested is stored at room temperature (20 degrees Celsius to 24 degrees Celsius) for 24 hours prior to testing. The textile sample is cut to size as dictated by the test method to be used, with minimal tension at approximately room temperature (e.g., 20 degrees Celsius).

EXAMPLE CLAUSES

Clause 1: An upper comprising: a knitted component having a plurality of interlooped courses defining a plurality of wedged-shaped portions of the knitted component, each of the plurality of wedge-shaped portions being defined by a portion of an outer perimeter of the knitted component, a portion of an inner perimeter of the knitted component, a first knit course extending from the outer perimeter to the inner perimeter and a second knit course extending from the outer perimeter to the inner perimeter.

Clause 2: The upper of clause 1, wherein the portion of the inner perimeter defining a wedge-shaped portion has a shorter length than the portion of the outer perimeter defining the wedge-shaped portion.

Clause 3: The upper of any of clauses 1 to 2, wherein each wedge-shaped portion includes full-length courses positioned between the first course and the second course and extending from the outer perimeter to the inner perimeter and includes partial-length courses positioned between the first course and the second course and extending from the outer perimeter and terminating before the inner perimeter.

Clause 4: The upper of any of clauses 1 to 3, wherein at least some of the wedge-shaped portions of the knitted component form a forefoot region of the upper.

Clause 5: The upper of any of clauses 1 to 4, wherein at least some of the wedge-shaped portions of the knitted component form a midfoot region of the upper.

Clause 6: The upper of any of clauses 1 to 3, wherein at least some of the wedge-shaped portions of the knitted component form a heel region of the upper.

Clause 7: The upper of any of clauses 1 to 6, wherein the knitted component includes a containment area comprising a first material that is at least partially fused to one or more interlooped yarns of the knitted component, wherein the first material comprises a thermoplastic elastomer.

Clause 8: The upper of clause 7, wherein the first material is at least partially fused with one or more interlooped yarns of the knitted component on an exterior-facing surface of the upper.

Clause 9: The upper of any of clauses 7 to 8, wherein portions of the knitted component having the first material have a different coefficient of friction relative to portions of the knitted component without the first material.

Clause 10: The upper of clause 9, wherein portions of the knitted component having the first material have a greater coefficient of friction relative to portions of the knitted component without the first material.

Clause 11: The upper of any of clauses 7 to 10, wherein the containment area comprises at least one tensile element forming at least one of the one or more yarns at least partially fused to the first material.

Clause 12: The upper of any of clauses 7 to 11, wherein the containment area is a first containment area positioned on a lateral side of the upper and at least partially located in the forefoot region, wherein the upper further comprises a second containment area extending on a medial side of the upper and at least partially located in the forefoot region.

Clause 13: The upper of clause 12, wherein the first material is at least partially fused to one or more interlooped yarns in the first containment area, the second containment area, and in a portion of the forefoot region between the first containment area and the second containment area.

Clause 14: The upper of any of clauses 7 to 13, wherein the first material forms a coating that includes the thermoplastic elastomer, the coating surrounding a core yarn having a second material that excludes the thermoplastic elastomer and has a greater melting temperature than the first material.

Clause 15: The upper of any of clauses 7 to 14, wherein the thermoplastic elastomer is a thermoplastic polyurethane.

Clause 16: The upper of any of clauses 7 to 14, wherein the thermoplastic elastomer is a styrene ethylene/butylene styrene (SEBS).

Clause 17: An upper comprising: a knitted component forming at least a forefoot region and a midfoot region of the upper and having an outer perimeter, the forefoot region being integrally knit with the midfoot region, the knitted component having an exterior-facing surface and an interior-facing surface opposite the exterior-facing surface, each course of the knitted component in the forefoot region and the midfoot region extending in a direction from the outer perimeter towards a common portion of the knitted component such that courses in the forefoot region extend diagonally relative to courses in the midfoot region; the knitted component having a containment area extending from the outer perimeter towards the common portion, the containment area comprising a first material that is at least partially fused to one or more interlooped yarns of the knitted component, the first material comprising a thermoplastic elastomer.

Clause 18; The upper of clause 17, wherein the first material is located on the exterior-facing surface of the knitted component.

Clause 19: The upper of any of clauses 17 to 18, wherein the containment area has a different coefficient of friction than portions of the knitted component without the first material.

Clause 20: The upper of any of clauses 17 to 19, wherein the containment area has a greater coefficient of friction than portions of knitted component without the first material.

Clause 21: The upper of any of clauses 17 to 20, wherein the thermoplastic elastomer is a thermoplastic polyurethane.

Clause 22: The upper of any of clauses 17 to 20, wherein the thermoplastic elastomer is a styrene ethylene/butylene styrene (SEBS).

Clause 23: The upper of any of clauses 17 to 22, wherein the common portion is a throat area.

Clause 24: The upper of any of clauses 17 to 23, wherein the knitted component forms a heel region of the upper and each course within the heel region extends in a direction towards the common portion.

Clause 25: The upper of any of clauses 17 to 24, wherein the containment area includes a plurality of adjacent courses and extends from the outer perimeter in the forefoot region to the common portion in the midfoot region.

Clause 26: The upper of any of clauses 17 to 25, wherein the containment area is a first containment area positioned on a lateral side of the upper, wherein the upper further comprises a second containment area extending from the outer perimeter in the forefoot region on a medial side of the upper to the common portion in the midfoot region on the medial side of the upper, the first containment area and the second containment area each having a greater coefficient of friction than a portion of the knitted component without the first material.

Clause 27: The upper of clause 26, wherein upper further comprises a third containment area extending from the outer perimeter in a heel region on a lateral side of the upper to the common portion in the midfoot region on the lateral side of the upper, and a fourth containment area extending from the outer perimeter in the heel region on a medial side of the upper to the common portion in the midfoot region on the medial side, the third containment area and the fourth containment area each having a greater coefficient of friction than the portion of the knitted component without the thermoplastic elastomer material.

Clause 28: The upper of clause 27, wherein the first containment area, the second containment area, the third containment area, and the fourth containment area are each separated from one another by portions of the knitted component without the thermoplastic elastomer material on the exterior-facing surface.

Clause 29: The upper of clause 27, wherein the exterior-facing surface of the knitted component includes one or more areas along an outer perimeter of the knitted component that includes the thermoplastic elastomer material that is at least partially fused to one or more interlooped yarns, wherein the one or more areas along the outer perimeter are located between the first containment area and the third containment area, between the first containment area and the second containment area, and between the second containment area and the fourth containment area, wherein the one or more areas along the outer perimeter extend from the outer perimeter and terminate below the common portion.

Clause 30: The upper of any of clauses 17 to 29, wherein the yarns at least partially fused to the first material includes a core yarn having a second material that excludes the thermoplastic elastomer and has a higher melting temperature than the first material.

Clause 31: The upper of any of clauses 17 to 29, wherein the one or more yarns at least partially fused to the first material includes a coated yarn having a core with a coating comprising the first material.

Clause 32: The upper of any of clauses 17 to 31, wherein the one or more yarns at least partially fused to the first material includes at least one tensile element extending from the outer perimeter towards the common portion.

Clause 33: The upper of clause 32, wherein the one or more yarns includes a core yarn and a second yarn, each having a higher melting temperature than the first material, the at least one tensile element comprises a strand inlaid along a course formed by loops of the core yarn and the second yarn.

Clause 34: The upper of clause 33, wherein at least one tensile element comprises a strand forming a repeating sequence of knitted stitches and float stitches along a course within the containment area.

Clause 35: The upper of any of clauses 17 to 34, wherein the one or more yarns includes a high-tenacity yarn and a core yarn, each having a higher melting temperature than the first material. the high-tenacity yarn having a tenacity of at least 5 grams per denier.

Clause 36: The upper of clause 35, wherein a portion of the exterior-facing surface of the knitted component adjacent the containment area excludes the first material and comprises the high-tenacity yarn.

Clause 37: The upper of any of clauses 17 to 36, wherein the upper has a weight of 30 grams or less.

Clause 38: The upper of any of clauses 17 to 37, further comprising a polymer layer extending over at least part of an exterior surface of the knitted component, the polymer layer comprising a polymer material with a lower melting temperature than the first material.

Clause 39: The upper of clause 38, wherein the polymer layer extends over at least part of the containment area and includes a plurality of apertures exposing portions of the containment area.

Clause 40: An article of footwear comprising the upper of any clauses 17 to 39, wherein the upper is secured to a sole structure.

Clause 41: An upper comprising: a knitted component forming at least a forefoot region and a midfoot region of the upper and having an outer perimeter, the forefoot region being integrally knit with the midfoot region, each course of the knitted component in the forefoot region and the midfoot region extending in a direction from the outer perimeter towards a common portion of the knitted component such that courses in the forefoot region extend diagonally relative to courses in the midfoot region; the knitted component having a first area and a second area each having courses extending from the outer perimeter towards the common portion, the first area comprises a first yarn having a first material with a first melting temperature and the second area comprises a second yarn having a second material with a second melting temperature that is greater than the first melting temperature, the first material being absent from the second area.

Clause 42: The upper of clause 41, wherein the common portion is a throat area.

Clause 43: The upper of any of clauses 41 to 42, wherein the first yarn comprises a core with a coating formed of the first material, the coating forming at least a partially fused surface in the first area.

Clause 44: The upper of any of clauses 41 to 43, wherein the first area has a greater coefficient of friction than the second area.

Clause 45: The upper of any of clauses 41 to 44, wherein the first material comprises a thermoplastic elastomer.

Clause 46: The upper of clause 45, wherein the thermoplastic elastomer is a thermoplastic polyurethane.

Clause 47: The upper of clause 45, wherein the thermoplastic elastomer is a styrene ethylene/butylene styrene (SEBS).

Clause 47: The upper of any of clauses 41 to 47, wherein the first area extends from the forefoot region to the midfoot region on a lateral side of the upper.

Clause 49: The upper of clauses 48, further comprising a third area extending on the medial side from the forefoot region to the midfoot region, the third area comprising the first yarn, wherein the first area and the third area are separated by the second area.

Clause 50: The upper of clause 49, wherein the first area and the third area each include at least one tensile element extending from the outer perimeter towards the common portion.

Clause 51: The upper of clause 50, wherein the at least one tensile element comprises a strand inlaid along a course of interlooped yarns.

Clause 52: The upper of clause 50, wherein the at least one tensile element comprises a strand forming a repeating sequence of knitted stitches and float stitches along a course of the interlooped yarns.

Clause 53: The upper of any of clauses 49 to 52, wherein the upper further comprises a fourth area on the lateral side and extending from a heel region to the midfoot region and a fifth area on a medial side and extending from the heel region to the midfoot region, the fourth area and fifth area each comprising the first yarn.

Clause 54: An article footwear comprising upper of any clauses 41 to 53, wherein the upper is secured to a sole structure.

Clause 55: An upper comprising: a knitted component comprising an exterior-facing surface and an interior-facing surface, a first area of the exterior-facing surface of the knitted component comprising having a first material that is absent from a second area of the exterior-facing surface of the knitted component, the first area having a greater coefficient of friction than the second area; and a polymer layer extending over part of the exterior-facing surface of the knitted component, the polymer layer including apertures and wherein portions of the first material in the first area are exposed through at least some of the apertures.

Clause 56: The upper of clause 55, wherein the first area comprises a thermoformed network of interlooped yarns formed of a core yarn and a coating comprising the first material that is fused within the thermoformed network of interlooped yarns.

Clause 57: The upper of any of clauses 55 to 56, wherein the first material comprises a thermoplastic elastomer.

Clause 58: The upper of any of clauses 55 to 57, wherein the polymer layer comprises a second material having a lower melting temperature than the first material.

Clause 59: The upper of any of clauses 55 to 58, wherein the polymer layer extends over a forefoot region, a midfoot region, and a heel region of the upper.

Clause 60: The upper of clause 59, wherein the polymer layer extends over a greater portion of the heel region than the forefoot region.

Clause 61: The upper of any of clauses 55 to 60, wherein the polymer layer extends over a greater portion of the midfoot region than the forefoot region.

Clause 62: The upper of any of clauses 55 to 61, wherein the polymer layer extends in the forefoot region from a bite-line where the upper meets a sole structure and terminates before a forward end of a throat region of the upper.

Clause 63: The upper of any of clauses 55 to 62, wherein the apertures in the polymer layer are positioned at least in a forefoot region.

Clause 64: The upper of any of clauses 55 to 63, wherein the apertures in the polymer layer are positioned in at least a midfoot region.

Clause 65: The upper of any of clauses 55 to 64, wherein the apertures are excluded from a heel region.

Clause 66: The upper of any of clauses 55 to 65, wherein the apertures in the polymer layer comprise apertures of different sizes.

Clause 67: The upper of clause 66, wherein the polymer layer includes apertures in a forefoot region of the upper that are larger than apertures in the polymer layer within a midfoot region of the upper.

Clause 68: The upper of any of clauses 55 to 67, wherein a density of apertures varies within the polymer layer.

Clause 69: The upper of any of clauses 55 to 68, wherein the first area has a first percentage of surface area that covered by the polymer layer, and the second area has a second percentage of surface area that is covered by the polymer layer, the second percentage being greater than the first percentage.

Clause 70: The upper of any of clauses 55 to 69, wherein the polymer layer includes a graphic design.

Clause 71: An article of footwear comprising the upper of any clauses 55 to 70, wherein the upper is secured to a sole structure.

Clause 72: An upper comprising: a knitted component forming at least the midfoot region of the upper and a throat area, the knitted component having a first course extending continuously from the outer perimeter to the throat area, the first course comprising a first yarn and a tensile element, the tensile element knit with a sequence of one or more knitted stitches and a float stitch extending a plurality of wales, wherein the sequence is repeated a number of times between the outer perimeter and the throat area, the quantity of wales in the plurality of wales being greater than a number of knitted stitches within the sequence.

Clause 73: The upper of clause 72, wherein the tensile element has at least one of a greater diameter, greater tensile strength, or greater tenacity compared to the first yarn.

Clause 74: The upper of any of clauses 72 to 73, wherein the knitted component includes groupings of tensile elements that each form the sequence.

Clause 75: The upper of clause 74, wherein courses of the tensile elements within each grouping are separated from one another by courses without floats stitches.

Clause 76: The upper of any of clauses 72 to 75, wherein the first yarn and the second yarn are included within the exterior-facing surface of the knitted component.

Clause 77: The upper of clause 76, wherein the first course is knit with a third yarn that forms an interior-facing surface of the knitted component.

Clause 78: The upper of any of clauses 72 to 77, wherein at least part of the tensile element within the first course is at least partially fused with a polymer material of the first yarn.

Clause 79: The upper of any of clauses 72 to 78, wherein the knitted component further forms a forefoot region of the upper, wherein each course of the knitted component in the forefoot region and the midfoot region extends in a direction from the outer perimeter towards the throat area of the knitted component such that courses in the forefoot region extend diagonally relative to courses in the midfoot region.

Clause 80: An article of footwear comprising the upper of any clauses 75 to 79, wherein the upper is secured to a sole structure.

Clause 81: An upper comprising: a knitted component forming at least a forefoot region and a midfoot region of the upper and having an outer perimeter, the forefoot region being integrally knit with the midfoot region, each course of the knitted component in the forefoot region and the midfoot region extending in a direction from the outer perimeter towards a common portion of the knitted component such that courses in the forefoot region are angled relative to courses in the midfoot region; the knitted component comprising a first material that is at least partially fused to one or more interlooped yarns, the first material comprising a thermoplastic elastomer.

Clause 82: The upper of clause 81, wherein the knitted component has an exteriorfacing surface and an interior-facing surface opposite the exterior-facing surface, and wherein the knitted component includes containment areas on the exterior-facing surface, the containment areas having a different coefficient of friction than remaining areas of the upper.

Clause 83: The upper of clause 82, wherein the one or more interlooped yarns include a partially melted coated yarn with a partially melted coating around a core, wherein the first material forms the partially melted coating.

Clause 84: The upper of clause 83, wherein the one or more interlooped yarns include containment areas include tensile elements knit with the partially melted coated yarn.

Clause 85: The upper of clause 84, wherein the knitted component includes at least one containment area without tensile elements, the containment areas with the tensile elements having a different coefficient of friction on an exterior-facing surface of the knitted component than the containment areas without tensile elements.

As used herein, a recitation of "and/or" with respect to two or more elements should be interpreted to mean only one element, or a combination of elements. For example, "element A, element B, and/or element C" may include only element A, only element B, only element C, element A and element B, element A and element C, element B and element C, or elements A, B, and C. In addition, "at least one of element A or element B" may include at least one of element A, at least one of element B, or at least one of element A and at least one of element B. Further, "at least one of element A and element B" may include at least one of element A, at least one of element B, or at least one of element A and at least one of element B.

This detailed description is provided in order to meet statutory requirements. However, this description is not intended to limit the scope of the invention described herein. Rather, the claimed subject matter may be embodied in different ways, to include different steps, different combinations of steps, different elements, and/or different combinations of elements, similar or equivalent to those described in this disclosure, and in conjunction with other present or future technologies. The examples herein are intended in all respects to be illustrative rather than restrictive. In this sense, alternative examples or implementations can become apparent to those of ordinary skill in the art to which the present subject matter pertains without departing from the scope hereof.

What is claimed is:

1. An upper, comprising:

a knitted component forming at least a forefoot region and a midfoot region of the upper and having an outer perimeter, the forefoot region being integrally knit with the midfoot region, the knitted component having an exterior-facing surface and an interior-facing surface opposite to the exterior-facing surface, each course of the knitted component in the forefoot region and in the midfoot region extending in a direction from the outer perimeter towards a common portion of the knitted component such that courses in the forefoot region extend diagonally relative to courses in the midfoot region, the common portion being a throat area, and the knitted component comprising a containment area extending from the outer perimeter towards the common portion, the containment area comprising a first material that is at least partially fused to one or more interlooped yarns of the knitted component, the first material comprising a thermoplastic elastomer.

2. The upper of claim 1, wherein the first material is located on the exterior-facing surface of the knitted component.

3. The upper of claim 1, wherein the containment area has a different coefficient of friction than portions of the knitted component without the first material.

4. The upper of claim 1, wherein the containment area has a greater coefficient of friction than portions of the knitted component without the first material.

5. The upper of claim 1, wherein the thermoplastic elastomer is a thermoplastic polyurethane, or wherein the thermoplastic elastomer is a styrene ethylene/butylene styrene (SEBS).

6. The upper of claim 1, wherein the throat area extends along a longitudinal axis of the upper and between a medial side and a lateral side of the upper.

7. The upper of claim 1, wherein the knitted component forms a heel region of the upper and each course within the heel region extends in a direction towards the common portion.

8. The upper of claim 1, wherein the containment area includes a plurality of adjacent courses and extends from the outer perimeter in the forefoot region to the common portion in the midfoot region.

9. The upper of claim 1, wherein the containment area is a first containment area positioned on a lateral side of the upper, wherein the upper further comprises a second containment area extending from the outer perimeter in the forefoot region on a medial side of the upper to the common portion in the midfoot region on the medial side of the upper, the first containment area and the second containment area each having a greater coefficient of friction than a portion of the knitted component without the thermoplastic elastomer.

10. The upper of claim 9, wherein the upper further comprises a third containment area extending from the outer perimeter in a heel region on a lateral side of the upper to the common portion in the midfoot region on the lateral side of the upper, and a fourth containment area extending from the outer perimeter in the heel region on a medial side of the upper to the common portion in the midfoot region on the medial side, the third containment area and the fourth containment area each having a greater coefficient of friction than a portion of the knitted component without the first material.

11. The upper of claim 10, wherein the first containment area, the second containment area, the third containment area, and the fourth containment area are each separated from one another by portions of the knitted component without the first material on the exterior-facing surface.

12. The upper of claim 11, wherein the exterior-facing surface of the knitted component includes one or more areas along the outer perimeter of the knitted component that comprise the thermoplastic elastomer that is at least partially fused to the one or more interlooped yarns, wherein the one or more areas along the outer perimeter are located between the first containment area and the third containment area, between the first containment area and the second containment area, and between the second containment area and the fourth containment area, wherein the one or more areas along the outer perimeter extend from the outer perimeter and terminate below the common portion.

13. The upper of claim 1, wherein the one or more interlooped yarns at least partially fused to the first material include a core yarn having a second material that excludes the thermoplastic elastomer and has a higher melting temperature than the first material.

14. The upper of claim 1, wherein the one or more interlooped yarns at least partially fused to the first material include a coated yarn having a core with a coating comprising the first material.

15. The upper of claim 1, wherein the one or more interlooped yarns at least partially fused to the first material comprise at least one tensile element extending from the outer perimeter towards the common portion.

16. The upper of claim 15, wherein the one or more interlooped yarns include a core yarn and a second yarn, each having a higher melting temperature than the first material, the at least one tensile element comprising a strand inlaid along a course formed by loops of the core yarn and the second yarn.

17. The upper of claim 15, wherein the at least one tensile element comprises a strand forming a repeating sequence of knitted stitches and float stitches along a course within the containment area.

18. The upper of claim 1, wherein the one or more interlooped yarns comprise a high-tenacity yarn and a core yarn, each having a higher melting temperature than the first material, the high-tenacity yarn having a tenacity of at least 5 grams per denier.

19. The upper of claim 18, wherein a portion of the exterior-facing surface of the knitted component adjacent to the containment area excludes the first material and comprises the high-tenacity yarn.

20. The upper of claim 1, further comprising a polymer layer extending over at least part of an exterior surface of the knitted component, the polymer layer comprising a polymer material with a lower melting temperature than the first material.

21. The upper of claim 20, wherein the polymer layer extends over at least part of the containment area and includes a plurality of apertures exposing portions of the containment area.

22. An article of footwear comprising the upper of claim 1, wherein the upper is secured to a sole structure.

* * * * *